US005612723A

United States Patent [19]

Shimura et al.

[11] Patent Number: 5,612,723

[45] Date of Patent: Mar. 18, 1997

[54] ULTRASONIC PRINTER

[75] Inventors: Takaki Shimura; Atsuo Iida; Yoshihiko Kaiju; Hirofumi Nakayasu; Masao Hiyane, all of Kawasaki, Japan

[73] Assignee: Fujitsu Limited, Kanagawa, Japan

[21] Appl. No.: 208,470

[22] Filed: Mar. 8, 1994

[30] Foreign Application Priority Data

May 14, 1993 [JP] Japan ..... 5-113359
Feb. 14, 1994 [JP] Japan ..... 6-017657

[51] Int. Cl.[6] ..... B41J 2/04

[52] U.S. Cl. ..... 347/46; 347/7; 347/13; 347/15; 347/89

[58] Field of Search ..... 347/6, 7, 9–15, 347/22, 27, 29, 33, 44, 46, 48, 94, 68, 89

[56] References Cited

U.S. PATENT DOCUMENTS

| | | | |
|---|---|---|---|
| 4,308,547 | 12/1981 | Lovelady et al. | 347/46 |
| 4,636,814 | 1/1987 | Terasawa | 347/7 |
| 4,751,530 | 6/1988 | Elrod et al. | 347/46 |
| 4,929,963 | 5/1990 | Balazar | 347/89 |
| 5,041,849 | 8/1991 | Quate et al. | 347/46 |
| 5,329,293 | 7/1994 | Liker | 347/11 |
| 5,339,101 | 8/1994 | Rawson et al. | 347/46 |

FOREIGN PATENT DOCUMENTS

| | | | |
|---|---|---|---|
| 0273664 | 7/1988 | European Pat. Off. . | |
| 3039164 | 5/1981 | Germany . | |
| 3528926 | 11/1989 | Germany . | |
| 3608016 | 9/1990 | Germany . | |
| 55-95192 | 7/1980 | Japan | 347/12 |
| 2-107447 | 4/1990 | Japan | 347/14 |
| 2-103152 | 4/1990 | Japan | 347/46 |
| 2-184443 | 7/1990 | Japan . | |
| 3-199049 | 8/1991 | Japan . | |
| 4-191050 | 7/1992 | Japan . | |
| 5-8399 | 1/1993 | Japan | 347/44 |

*Primary Examiner*—Joseph W. Hartary

[57] ABSTRACT

There is provided an ultrasonic printer in which convergent ultrasounds are radiated to emit an ink near a convergent point of the convergent ultrasounds in the form of an ink droplet and deposit the ink droplet on a recording medium such as a paper sheet, thereby performing a recording on the recording medium with multiple ink dots, with higher resolution. The ultrasonic printer has a plurality of ultrasonic transducers which transmit phase-controlled ultrasonic waves to form an convergent ultrasonic acoustic beam.

34 Claims, 46 Drawing Sheets

ULTRASONIC PRINTER

BACKGROUND OF THE INVENTION

1. Field of the Invention

The present invention relates to an ultrasonic printer in which convergent ultrasounds are radiated to emit an ink near a convergent point of the convergent ultrasounds in the form of an ink droplet and deposit the ink droplet on a recording medium such as a paper sheet, thereby performing a recording on the recording medium with multiple ink dots.

2. Description of the Related Art

Recently, there has been widely applied an ink jet printer adapted for recording by means of directly emitting a particle of ink or an ink droplet onto a recording medium such as a paper sheet. Such an ink jet printer has many advantageous points such that a high speed printing is available, a lower noise printing is available, there is little a restriction to the recording medium, it is easy to provide a coloring, and so on.

In this type of ink jet printer, on the other hand, it happens during a recess in printing that a viscosity of ink on a nozzle of an ink jet recording head is increased, or during the printing that a bubble enters the nozzle. Such increase in viscosity of the ink and the occurrence of the bubble in the nozzle can cause such troubles when the printing starts, as hard ejection of the ink, printing with some dots missing and clogging on the nozzle when the ink hardens, and such troubles would eventually cause a deficient recording head. In view of the foregoing, there are taken the necessary measures or backup such as a capping in which nozzles are capped, when the printing is not performed, to prevent evaporation of water of the ink, a wiping in which excess ink on the nozzle is wiped, and a suction purging in which the nozzle is covered with a suction cap, when a power supply is turned on or when needed, to remove inks of which viscosities have been increased or inks into which bubbles are mixed. To enable the backup operation, however, the prior printers involve such problems that the structure of the printers is complicated and in addition, cost of the product increases.

Further, the prior printers suffer from the following drawbacks. Part of inks adheres an edge of an orifice of a nozzle with stain and hardens thereon, so that a flying direction of inks is varied to cause a dot deviation. This leads to a disturbance of print, and in case of a color printing leads to the change of hue.

Furthermore, the prior ink jet printers each are provided with an ink chamber and nozzles, which adopt a scheme in which the ink chamber is compressed with a piezoelectricity to eject inks from the nozzles, or another scheme in which the ink chamber is heated by a heater to emit inks. However, according to such prior ink jet printers, it takes a lot of time to refill inks of a nozzle chamber on a repetitive basis, and thus there is a restriction in time to eject the successive ink droplet.

In case of a nozzle fashion, since a diameter of the nozzle is fixed, a size of the ink droplet is substantially determined. Thus, in this case, it is difficult to change a size of print dots.

Further, in case of a nozzle fashion, if clogging occurs on even one of the nozzles, the recording head becomes unavailable in its entirety. Consequently, in case of the nozzle fashion, there is often adopted a throw-away type of head in which the head and an ink tank are formed in a single unitary body. Thus, in this case, since there is a structure as articles for consumption, the print cost or running cost increases.

To solve these problems, it is desired to provide a new type of printing system which needs no nozzles, and be simple in structure and inexpensive.

As an example of a printing system satisfying these requirements, recently, there is proposed an ultrasonic printer. An acoustic lens or the like are used to project an ultrasonic acoustic beam toward a free surface of a pool of liquid from beneath so as to focus on the surface of the pool, so that individual droplets of liquid are released from the surface of the pool. This principle has been applied to the ultrasonic printer, using ultrasonic acoustic beams to release small droplets of inks from pools of ink and to eject the droplets onto a recording medium such as paper sheets for printing.

FIG. 59 is a perspective view of a recording head of the prior art ultrasonic printer, and FIG. 60 is a cross sectional view of the recording head shown in FIG. 59, with the recording head being submerged in a pool of ink for operation (refer to U.S. Pat. No. 4,751,530).

Referring to FIGS. 59 and 60, the recording head comprises an array of precisely positioned spherical acoustic lenses 12 for launching a plurality of converging acoustic beams into a pool of ink. The acoustic lenses 12 are defined by small, generally spherically shaped indentations which are formed in the upper surface of an acoustic solid substrate 10. An ultrasonic acoustic transducer 14 is deposited on or otherwise maintained in intimate mechanical contact with the opposite or lower surface of the substrate 10 in such a manner that it is located over against the associated acoustic lens 12. When the ultrasonic acoustic transducer 14 is excited to generate ultrasonic acoustic waves, as shown in FIG. 60, the ultrasonic acoustic waves are propagated through the substrate 10 and curved by the acoustic lens 12 in a direction to converge, since the substrate 10 is constructed of a material having a higher velocity of sound relative to the ink 16, so that the ultrasonic acoustic waves are converged near the free surface **16*a* of the ink 16. In this manner, an ink droplet is ejected from the free surface 16*a*** toward a recording sheet. The ejected ink droplet has a dot diameter which is approximately the same as the spot diameter of the converged ultrasonic acoustic waves. With such an ink droplet, the corresponding one dot of recording is implemented. When the ink droplet is deposited on the recording sheet, the size of the formed ink droplet will be expanded approximately twice as large as the size of the particle of the ink droplet.

FIG. 61 is a schematic diagram showing a functional structure of another embodiment of the prior art ultrasonic printer used to print bar codes (refer to U.S. Pat. No. 4,308,547).

Referring to FIG. 61, Ink 22 held in a reservoir 20 is applied to an ink conveying belt 26 by a roller 24. The ink conveying belt 26 is formed in an endless structure and circulated by rollers 28. An array of ultrasonic acoustic transducers 30 is centered on the ink conveying belt 26. The ultrasonic acoustic transducer 30 in the shape of a cylindrical segment is mechanically coupled to a wedge shaped acoustic medium as a concentrator. When ultrasonic acoustic waves are radiated from any of the ultrasonic acoustic transducers 30, the ultrasonic acoustic waves are concentrated owing to the cylindrical configuration of the transducer, so that an ink droplet is ejected from the ink conveying belt 26 via a slit 34 to a recording sheet 36, thereby implementing the recording on the recording sheet 36.

In the ultrasonic printers shown in FIGS. 59 and 60, the recording head comprises an array of precisely positioned spherical acoustic lenses 12 and an array of ultrasonic acoustic transducers 14, each element being associated with one dot. There are needs to supply to the respective transducers energy sufficient for ejecting ink droplets, and to focus the ultrasonic acoustic waves to a sufficiently small spot, for example, about 0.03 mm ϕ, in order to attain a higher resolution. Consequently, it is necessary for configurations of the ultrasonic acoustic transducers 14, and the acoustic lenses 12 to have sizes such extent that the conditions as noted above are satisfied, for example, 1 mm angle and 1 mm ϕ, respectively. By the way, there is a conflict between arranging 1 mm angle of ultrasonic acoustic transducer 14 and 1 mm ϕ of acoustic lense 12 per dot and implementing a high resolution printer capable of performing recording of, for example, 0.06 mm in dot pitch. In order to solve this conflict, there has been proposed such a system that multi recording heads (e.g. 16 rows) as shown in FIG. 59 are arranged in a stagger-like configuration so that the dot pitch is less than an arrangement pitch of the ultrasonic acoustic transducer. However, the provision of such many recording heads will involve an enlargement of the printer and a dramatical cost-up in manufacture.

Also in the prior ultrasonic printers shown in FIG. 61, it is necessary for each of the ultrasonic acoustic transducers 30 to radiate ultrasonic acoustic waves having energy which is sufficient to eject ink droplets. This results in a significant large arrangement pitch. Further, if the length (the size in a horizontal direction in FIG. 61) of the ultrasonic acoustic transducer 30 is elongated and the arrangement pitch is shortened by the corresponding elongated length, the spot diameter will be expanded as the arrangement pitch is shortened, since the spot diameter of the ultrasonic acoustic waves in an arrangement direction depends on a directivity of the ultrasonic acoustic waves. Thus, while the ultrasonic printer shown in FIG. 61 is suitable for a rough printing such as bar codes, it is difficult to apply it to the ultrasonic printer capable of implementing a higher resolution as mentioned above.

SUMMARY OF THE INVENTION

In view of the foregoing, it is therefore an object of the present invention to provide an ultrasonic printer capable of performing a higher resolution of recording.

From another point of view, such a type of ultrasonic printer that ink droplets are ejected from a surface of inks involves essentially no problem as to clogging of nozzles, since it is no nozzles. Thus, it is possible to expect an implementation of a printing system which is simple in structure and inexpensive. However, to actually assemble the ultrasonic printer, there still remains various problems.

Hitherto, as techniques for solving the various problems which will occur when the ultrasonic printers are actually constructed, the following technologies have been proposed:

(1) The liquid level of inks is detected by laser measurement means so that the liquid level of inks is controlled with greater accuracy (Japanese Patent Laid Open Gazette No. 166545/1988).

(2) The flying velocity of ink droplets is detected, and the liquid level of inks is controlled in accordance with a detection value by means of regulating an amount of projection of a piston member (Japanese Patent Laid Open Gazette No. 191050/1992).

(3) The liquid temperature of inks is controlled by heater means mounted in an adjacent relation with a liquid droplet ejector in a print head (Japanese Patent Laid Open Gazette No. 199049/1991).

It is another object of the present invention, to actually assemble an ultrasonic printer, to propose more practical and broader technologies for solving the various problems, comparing with the proposals as mentioned above.

To achieve the above-mentioned objects,according to the present invention, there is provided a first ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(1) a plurality of ultrasonic transducers for radiating ultrasonic acoustic waves;

(2) drive circuits each for driving an associated one of said plurality of ultrasonic transducers; and (3) a control circuit for controlling said drive circuits in such a manner that at least part of plural ultrasonic transducers among said plurality of ultrasonic transducers are driven with at least two or more phases mutually different to converge the ultrasonic acoustic waves radiated from said plural ultrasonic transducers on a predetermined position.

Where it is preferable so arranged that said control circuit has a plurality of counters each for counting a number of clock pulses of a predetermined reference clock, and transmits to said drive circuits each a timing signal for instructing drive of the associated one of said ultrasonic transducers in timing when a counted value of the associated counter reaches a respective predetermined value.

Further it is preferable that said plurality of ultrasonic transducers are arranged in a predetermined arrangement direction in the form of array, and it is acceptable that said plurality of ultrasonic transducers are arranged in a predetermined arrangement direction over a recording width in its entirety. To implement the printer, it is acceptable that said printer further comprises a movement mechanism for moving relatively said recording medium and said ultrasonic transducers in a direction intersecting the arrangement direction.

The printer further comprises converging means for converging the ultrasonic waves radiated from said ultrasonic transducers in a direction intersecting the arrangement direction. It is acceptable that said converging means is an acoustic lens which varies in its thickness in the intersecting direction; an acoustic horn; an acoustic Fresnel lens; the ultrasonic transducer itself having an ultrasonic wave radiation surface which is formed with a recess shaped configuration with respect to the intersecting direction. It is preferable that said converging means is provided with an acoustic absorption member for absorbing from among the ultrasonic waves radiated from said ultrasonic transducer components which do not contribute to formation of the convergent ultrasonic waves.

Further, it is preferable that said control circuit controls said drive circuits in such a manner that when at least part of plural ultrasonic transducers of said an array of ultrasonic transducers are segmented into a plurality of blocks each including a plurality of ultrasonic transducers and excluding any ultrasonic transducers included in other blocks, the convergent ultrasonic wave is formed on each block in one time of cycle for ejecting ink droplets, or in such another manner that when at least part of plural ultrasonic transducers of said an array of ultrasonic transducers are segmented into a plurality of blocks one of which includes a plurality of ultrasonic transducers, part of these being included also in another block, and the another block including a plurality of ultrasonic transducers, the convergent ultrasonic wave is formed on each block in one time of cycle for ejecting ink droplets.

Further, it is acceptable that said control circuit controls said drive circuits in such a way that in one cycle for ejecting ink droplets recording over the whole width of said an array of ultrasonic transducers in the arrangement direction is performed.

It is acceptable that said control circuit controls said drive circuits to form dots with a dot pitch smaller than an arrangement pitch of said an array of ultrasonic transducers. It is also a preferable aspect that said control circuit controls said drive circuits so that a pitch of the dots in the arrangement direction can be varied.

It is still acceptable that said control circuit controls said drive circuits in such a manner that to form one and another of two dots which are adjacent each other in the arrangement direction, even number and odd number of ultrasonic transducers are driven, so that dots having a pitch of one half of an arrangement pitch of ultrasonic transducers may be formed.

Still further, it is acceptable that said control circuit controls said drive circuits so that the dot pitch in the arrangement direction can be varied. When the dot pitch is varied, preferable, the dot size is also varied.

A system of the above-mentioned first ultrasonic printer, that is, a system in which to emit one drop of ink, a plurality of ultrasonic transducers are used to eject ultrasonic acoustic waves undergone a phase control, may be referred to as "phased array system", hereinafter.

To achieve the above-mentioned objects, according to the present invention, there is provided the second ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(4) a plurality of ultrasonic transducers for radiating ultrasonic acoustic waves;

(5) drive circuits each for driving an associated one of said plurality of ultrasonic transducers; and (6) a sensor for measuring an amount involved in inks; and (7) a control circuit for controlling said drive circuits in such a manner that said ultrasonic transducers are driven in accordance with the amount involved in inks which is measured by said sensor.

While the term "an amount involved in inks" is used in broader conception in the present invention, said sensor (6) may measure as the amount involved in inks at least one from among a level of a liquid surface of inks, a liquid temperature of inks, a viscosity of inks, a specific gravity of inks, a density of inks, a velocity of ultrasonic acoustic waves travelling in inks, and an attenuation factor of ultrasonic acoustic waves travelling in inks.

Said ultrasonic transducers (4) may serve as said sensor (6), too.

It is preferable that said control circuit (7) controls said drive circuits (5) to adjust at least one selected from among groups of drive voltages for driving said ultrasonic transducers (4) and drive burst times in accordance with the amount involved in inks detected by the sensor (6).

Said control circuit (7) may control said drive circuits in such a manner that at least part of plural ultrasonic transducers among said plurality of ultrasonic transducers are driven with at least two or more phases mutually different to converge the ultrasonic acoustic waves radiated from said plural ultrasonic transducers on a predetermined position, and further said control circuit controls said drive circuits (5) to adjust at least one selected from among groups of said phases and a number of said ultrasonic transducers to be driven for ejecting a drop of ink droplet, in accordance with the amount involved in inks detected by the sensor (6).

The second ultrasonic printer according to the present invention is provided with various aspects as set forth below:

(2-1) Having ink temperature sensor, drive voltages of the ultrasonic transducers are controlled in accordance with the temperature liquid of inks;

(2-2) Having ink temperature sensor, drive burst time of the ultrasonic transducers are controlled in accordance with the temperature liquid of inks;

(2-3) Having ink temperature sensor, a number of the ultrasonic transducers to be driven to eject one drop of ink are controlled in accordance with the temperature liquid of inks;

(2-4) In the phased array system, an ink viscosity is calculated based on an ink temperature and a velocity of ultrasonic acoustic waves passing through the inks, or an ink viscosity sensor is provided, a number of the ultrasonic transducers to be driven to eject one drop of ink are controlled in accordance with the ink viscosity;

(2-5) In the phased array system, a phase pattern is controlled in accordance with a velocity of inks;

(2-6) In the phased array system, a phase pattern is controlled in accordance with a liquid surface of inks;

(2-7) Having an attenuation factor measurement mechanism for measuring an attenuation factor of ultrasonic acoustic waves (it may be referred to as "attenuation factor of inks" hereinafter) which travel in inks, drive voltages of the ultrasonic transducers are controlled in accordance with the attenuation factor;

(2-8) Having an attenuation factor measurement mechanism for measuring an attenuation factor of inks, drive burst time of the ultrasonic transducers are controlled in accordance with the attenuation factor;

(2-9) Having an attenuation factor measurement mechanism for measuring an attenuation factor of inks, a number of the ultrasonic transducers to be driven to eject one drop of ink are controlled in accordance with the attenuation factor.

To achieve the above-mentioned objects, according to the present invention, there is provided the third ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(8) a sensor for measuring a first amount involved in inks; and (9) an ink control mechanism for controlling a second amount involved in the inks in accordance with the first amount involved in inks which is detected by said sensor.

It is preferable that said sensor measures as the first amount involved in inks a level of a liquid surface of inks, and also that said ink control mechanism controls as the second amount involved in inks at least one selected from among groups of a heat energy amount in unit time for heating inks, a level of a liquid surface of inks, an ink supply amount and an ink discharge amount.

The third ultrasonic printer according to the present invention is provided with various aspects as set forth below:

(3-1) Having ink temperature sensor, an ink heat amount is controlled in accordance with the temperature liquid of inks;

(3-2) Having ink temperature sensor, a level of liquid surface of inks is controlled in accordance with the temperature liquid of inks; and (3-3) Having ink temperature sensor, an ink discharge amount is controlled in accordance with the temperature liquid of inks.

To achieve the above-mentioned objects, according to the present invention, there is provided the fourth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(10) a sensor for measuring an amount involved in inks;

(11) determining means for determining whether or not the amount involved in inks, which is detected by said sensor, is within a predetermined range; and

(12) output means for issuing, when it is determined by said determining means that the amount involved in inks, which is detected by said sensor, is out of the predetermined range, a message representative of this information.

It is preferable that said sensor measures as the amount involved in inks at least one selected from among groups of a level of a liquid surface of inks, a density of inks and an attenuation factor of ultrasonic waves travelling in inks.

The fourth ultrasonic printer according to the present invention is provided with various aspects as set forth below:

(4-1) Having an ink density sensor, when the inks exceed in density a predetermined value, a message informing an operator of the necessity of ink exchange is output;

(4-2) Measuring an attenuation factor of ultrasonic acoustic waves passing through the inks, when the attenuation factor exceeds a predetermined value, a message informing an operator of the necessity of ink exchange is output; and (4-3) Having ink level sensor, when an ink level does not reach a desired level even if inks are supplied to an ink reservoir, a message informing an operator of the necessity of replenishment for inks is output.

To detect the density of inks, there are several aspects as shown below by way of example:

(4-4) Having a reflection photosensor, the ink density is detected in accordance with a quantity of reflected light;

(4-5) Having a transmission photosensor, the ink density is detected in accordance with a quantity of transmission light;

(4-6) Having a specific gravity meter, the ink density is detected in accordance with a specific gravity of inks.

To achieve the above-mentioned objects, according to the present invention, there is provided the fifth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(13) an ink reservoir for reserving inks through which the convergent ultrasonic acoustic waves travels;

(14) a reserve tank for saving inks;

(15) an ink circulation mechanism for providing such a circulation for inks that the inks saved in said reserve tank are supplied to said ink reservoir and the inks supplied to said ink reservoir are discharged to said reserve tank;

(16) a sensor for measuring an amount involved in the inks supplied to said ink reservoir;

(17) determining means for determining whether or not the amount involved in the inks, which is detected by said sensor, is within a predetermined range; and

(18) an ink circulation control circuit for controlling said ink circulation mechanism in such a manner that when it is determined by said determining means that the amount involved in the inks, which is detected by said sensor, is out of the predetermined range, the inks supplied to said ink reservoir are exchanged by the inks saved in said reserve tank.

It is preferable that said sensor measures as the amount involved in the inks at least one selected from among groups of a density of inks and an attenuation factor of the ultrasonic waves travelling in the inks.

The fifth ultrasonic printer according to the present invention is provided with various aspects as set forth below:

(5-1) Having an ink density sensor, when the inks exceed in density a predetermined value, the inks are exchanged by inks in the reserve tank; and (5-2) Measuring an attenuation factor of ultrasonic acoustic waves travelling the inks, when the attenuation factor exceeds a predetermined value, the inks are exchanged.

To achieve the above-mentioned objects, according to the present invention, there is provided a fifth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(19) an ink reservoir for reserving inks through which the convergent ultrasonic acoustic waves travels, said ink reservoir having a slit shaped aperture used for ink droplet discharge; and

(20) a cleaning mechanism for performing a cleaning for said ink reservoir as to its portions near the liquid surface of the inks supplied to said ink reservoir.

It is acceptable that said cleaning mechanism has a wiper which is movable in a longitudinal direction of said slit shaped aperture used for ink droplet discharge so as to wipe said ink reservoir as to its portions near the liquid surface of the inks supplied to said ink reservoir. Further, said ultrasonic transducers used for radiation of the ultrasonic waves may serve as said cleaning mechanism, too, by means of radiating ultrasonic waves having an energy less than that with which the inks supplied to said ink reservoir are emitted in the form of ink droplet, so as to wipe said ink reservoir as to its portions near the liquid surface of the inks supplied to said ink reservoir.

In cleaning by means of radiation of the ultrasonic waves, in case of the prior ultrasonic printer as shown in FIG. 59, it is acceptable to radiate weak ultrasonic acoustic waves in such an extent that no ink droplet is ejected, whereas, in case of the phased array system, a relatively stronger ultrasonic acoustic waves may be radiated so far as there is avoided such a situation that energy of the ultrasonic acoustic waves is concentrated on a point.

To achieve the above-mentioned objects, according to the present invention, there is provided the seventh ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(21) a plurality of ultrasonic transducers for radiating ultrasonic acoustic waves;

(22) drive circuits each for driving an associated one of said plurality of ultrasonic transducers; and

(23) receiving circuits each for receiving reflected ultrasonic acoustic waves returned to an associated one of said plurality of ultrasonic transducers; and

(24) a measuring circuit for attaining an amount involved in inks based on received signals received by said receiving circuit.

It is preferable that said measuring circuit measures as the amount involved in inks at least one from among a level of a liquid surface of inks, a liquid temperature of inks, a viscosity of inks, a specific gravity of inks, a density of inks, a velocity of ultrasonic acoustic waves travelling in inks, and an attenuation factor of ultrasonic acoustic waves travelling in inks.

The seventh ultrasonic printer according to the present invention is provided with various aspects as set forth below:

(7-1) Using received signals, measure the state of inks such as a liquid temperature of inks, a viscosity of inks, a specific gravity of inks, a density of inks, etc.

(7-2) Using received signals, measure an attenuation factor of ultrasonic acoustic waves travelling in inks;

(7-3) Using received signals, measure a velocity of ultrasonic acoustic waves travelling in inks; and (7-4) Using received signals, measure a level of liquid surface of inks.

To achieve the above-mentioned objects, according to the present invention, there is provided the eighth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(25) a plurality of ultrasonic transducers for radiating ultrasonic acoustic waves;

(26) drive circuits each for driving an associated one of said plurality of ultrasonic transducers; and

(27) receiving circuits each for receiving reflected ultrasonic acoustic waves returned to an associated one of said plurality of ultrasonic transducers; and

(28) condition selecting means for selecting a print condition from among mutually different conditions in such a manner that prior to printing of dot formation on the recording medium, said ultrasonic transducers are driven under mutually different conditions to measure received signals at the driving time.

While the "conditions" in (28) are not restricted by the specific conditions, it is preferable that said condition selecting means selects as the condition at least one from among a level of a liquid surface of inks and a center frequency of the ultrasonic waves radiated from said ultrasonic transducers.

Otherwise, in case of said eighth printer further comprises a control circuit for controlling said drive circuits in such a manner that at least part of plural ultrasonic transducers among said plurality of ultrasonic transducers are driven with at least two or more phases mutually different to converge the ultrasonic acoustic waves radiated from said plural ultrasonic transducers on a predetermined position, it is acceptable that said condition selecting means selects as the condition the phases.

The eighth ultrasonic printer according to the present invention is provided with various aspects as set forth below:

(8-1) In the phased array system, prior to the start of printing, received signals are measured while a phase pattern of signals to be applied to ultrasonic transducers is varied little by little. When the printing is actually performed, the signals of the phase pattern with which a maximum amplitude of received signals is derived, are applied to the ultrasonic transducers;

(8-2) Prior to the start of printing, received signals are measured while a frequency of signals to be applied to ultrasonic transducers is varied little by little. When the printing is actually performed, the signals of the frequency with which a maximum amplitude of received signals is derived, are applied to the ultrasonic transducers; and (8-3) Prior to the start of printing, received signals are measured while a level of liquid surface of inks, when ultrasonic transducers is driven, is varied little by little. When the printing is actually performed, the printing is performed with adjustment of the level of liquid surface of inks with which a maximum amplitude of received signals is derived.

To achieve the above-mentioned objects, according to the present invention, there is provided the ninth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(29) a dot adjusting mechanism for adjusting at least one from among a level of a liquid surface of inks, a level of the convergent point, a beam diameter of the ultrasonic acoustic waves at the convergent point and a number of ink droplets to be elected toward a same point on the recording medium.

The ninth ultrasonic printer according to the present invention is provided with various aspects as set forth below:

(9-1) A particle diameter of an emitted ink droplet is varied by means of moving a liquid surface in a vertical line with respect to a convergent point of ultrasonic waves;

(9-2) In the phased array system, a phase pattern is adjusted so that a convergent point of ultrasonic waves to be radiated is formed upper or lower with respect to a liquid surface;

(9-3) In the phased array system, a blooming is given so that a focal point of ultrasonic waves radiated is not exactly formed on a liquid surface; and (9-4) Varying a number of ink droplets emitted toward the same point on a recording medium by means of varying a time duration of drive burst signals to be applied to ultrasonic transducers.

To achieve the above-mentioned objects, according to the present invention, there is provided the tenth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(30) an ink reservoir for reserving inks through which the convergent ultrasonic acoustic waves travels, said ink reservoir having an aperture used for ink droplet discharge; and

(31) a shutter capable of optionally opening and closing said aperture used for ink droplet discharge.

The tenth ultrasonic printer according to the present invention is provided with various aspects as set forth below:

(10-1) The shutter is so arranged that it is enabled to close by an elastic member and open by an actuator. When a supply of energy to the actuator is stopped, the shutter is closed by an elastic force of the elastic member;

(10-2) At the recess of printing, the shutter closes the opening of the ink reservoir;

(10-3) In the state of closing the shutter, ultrasonic transducers are driven for heating inks or cleaning the opening of the ink reservoir; and (10-4) After the printing, the first time later, the opening of the ink reservoir is closed by the shutter, and the second time later, the inks are withdrawn from the ink reservoir.

To achieve the above-mentioned objects, according to the present invention, there is provided the eleventh ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(32) a plurality of ultrasonic transducers for radiating ultrasonic acoustic waves;

(33) drive circuits each for driving an associated one of said plurality of ultrasonic transducers;

(34) an ink reservoir for reserving inks through which the convergent ultrasonic acoustic waves travels;

(35) a reserve tank for saving inks;

(36) an ink circulation mechanism for providing such a circulation for inks that the inks saved in said reserve tank are supplied to said ink reservoir and the inks supplied to said ink reservoir are discharged to said reserve tank; and

(37) a control circuit for controlling said drive circuits in such a manner that when the inks supplied to said ink reservoir are discharged to said reserve tank, said ultrasonic transducers emit ultrasonic progressive waves toward an ink discharge port of said ink reservoir.

To achieve the above-mentioned objects, according to the present invention, there is provided the twelfth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(38) a plurality of ultrasonic transducers for radiating ultrasonic acoustic waves;

(39) drive circuits each for driving an associated one of said plurality of ultrasonic transducers;

(40) an ink reservoir for reserving inks through which the convergent ultrasonic acoustic waves travels;

(41) a reserve tank for saving inks;

(42) an ink circulation mechanism for providing such a circulation for inks that the inks saved in said reserve tank are supplied to said ink reservoir and the inks supplied to said ink reservoir are discharged to said reserve tank; and (43) a filter for removing particles derived from the recording medium and mixed into the inks, said filter being provided on an ink channel between said ink reservoir and said reserve tank.

To achieve the above-mentioned objects, according to the present invention, there is provided an thirteenth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(44) an ink reservoir for reserving inks through which the convergent ultrasonic acoustic waves travels, said ink reservoir having on its top a first slit shaped aperture, a cavity having a width wider than said first aperture, said cavity being provided on the top of said first aperture, and a second slit shaped aperture having a width narrower than said cavity, said second slit being provided on the top of said cavity.

To achieve the above-mentioned objects, according to the present invention, there is provided the fourteenth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(45) an ink reservoir for reserving inks through which the convergent ultrasonic acoustic waves travels, said ink reservoir having on its top a slit shaped aperture; and

(46) a skew regulation mechanism for regulating a skew with respect to a longitudinal direction of said ink reservoir.

To achieve the above-mentioned objects, according to the present invention, there is provided the fifteenth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(47) an ink reservoir for reserving inks through which the convergent ultrasonic acoustic waves travels, said ink reservoir having on its top a slit shaped aperture used for ink discharge;

(48) a reserve tank for saving inks;

(49) an ink circulation mechanism for providing such a circulation for inks that the inks saved in said reserve tank are supplied to said ink reservoir and the inks supplied to said ink reservoir are discharged to said reserve tank;

(50) a skew sensor for detecting a skew of said ink reservoir with respect to a longitudinal direction of said aperture used for ink discharge; and

(51) an ink circulation control circuit for controlling said ink circulation mechanism in such a manner that when said skew sensor detects a skew which exceeds a predetermined tolerance, the inks supplied to said ink reservoir are discharged into said reserve tank.

The fifteenth ultrasonic printer according to the present invention is provided with various aspects as set forth below:

(15-1) Having the skew sensor, prior to supplying the inks to the recording head, it is determined whether the skew is present, and if yes, no inks is supplied from the first; and (15-2) Having the skew sensor, during the printing, it is determined whether the skew is present, and if yes, the printing is interrupted and inks are returned to the reserve tank.

With respect to the detection of the skew, there are aspects as set forth below by way of example:

(15-3) Level sensors each for measuring a level of an ink surface are disposed at both the ends of the ink reservoir.

With respect to the level sensors, there are aspects as set forth below by way of example:

(15-4) A reflection photosensor is disposed to face in a perpendicular to the liquid surface of inks;

(15-5) A reflection photosensor is disposed to face in a horizontal direction with respect to the liquid surface of inks;

(15-6) A light emitting device and a light intercepting device are disposed in a face-to face configuration through an ink surface in a horizontal direction with respect to the liquid surface of inks.

To achieve the above-mentioned objects, according to the present invention, there is provided the sixteenth ultrasonic printer in which convergent ultrasonic acoustic waves are radiated to emit an ink near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots. The ultrasonic printer comprises:

(52) a plurality of ultrasonic transducers for radiating ultrasonic acoustic waves;

(53) drive circuits each for driving an associated one of said plurality of ultrasonic transducers;

(54) an ink reservoir for reserving inks through which the convergent ultrasonic acoustic waves travels;

(55) a reserve tank for saving inks;

(56) an ink circulation mechanism for providing such a circulation for inks that the inks saved in said reserve tank are supplied to said ink reservoir and the inks supplied to said ink reservoir are discharged to said reserve tank; and

(57) a heater for heating inks, provided on an ink channel between said ink reservoir and said reserve tank.

The first ultrasonic printer according to the present invention is to drive a plurality of ultrasonic transducers with shifting a phase, so that the ultrasonic acoustic waves radiated from the plurality of ultrasonic transducers interfere with each other to form a convergent ultrasonic acoustic wave under control of shifting the phase. Thus, the ink near the convergent point is ejected and deposited on a recording medium, so that a dot is formed and the gathered dots form images such as characters, graphic patterns and the like. In the ultrasonic printer according to the present invention, since a plurality of ultrasonic transducers are used for formation of a single dot, there is needed no ability for individual one of those ultrasonic transducers to radiate so much energy that it ejects an ink droplet. This feature makes it possible to reduce an arrangement pitch of the ultrasonic transducers. Further, according to the ultrasonic printer according to the present invention, as described above, the phase controlled ultrasonic waves are radiated from the plurality of ultrasonic transducers. Thus, it is possible to form a dot of which dot pitch is smaller than an arrangement pitch of the ultrasonic transducers under control of the phase. In this manner, according to the present invention, it is possible to provide a higher resolution of printer, for example, of 0.06 mm in pitch of dots.

Further, the second ultrasonic printer according to the present invention is to measure an amount involved in inks, and drive the ultrasonic transducers in accordance with the measured amount involved in inks. This feature makes it possible to prevent the disturbance of printing due to the variation of the amount involved in inks, thereby permitting a stable or reliable printing.

Further more, the third ultrasonic printer according to the present invention is to measure a first amount involved in inks, and control a second amount involved in inks in accordance with the measured amount involved in inks. This feature makes it possible to prevent the variation of the amount involved in inks, thereby permitting a stable or reliable printing.

Still further, the fourth ultrasonic printer according to the present invention is to measure an amount involved in inks, and determine whether or not the measured amount is in a predetermined limit, and if not, issue the message representative of this information. This feature makes it possible to prevent the printing from being carried out in unstable conditions.

Still further, the fifth ultrasonic printer according to the present invention is to measure an amount involved in inks, and determine whether or not the measured amount is in a predetermined range, and if not, exchange inks in the reservoir. This feature makes it possible to prevent the printing from being carried out in unstable conditions.

Still further, the sixth ultrasonic printer according to the present invention is to have a cleaning mechanism for cleaning the ink reservoir, whereby the stable printing is permissible.

Still further, the seventh ultrasonic printer according to the present invention is to receive the ultrasonic waves returned to a plurality of ultrasonic transducers and attain an amount involved in inks in accordance with the received signals. Thus, there is no need to individually provide sensors for measuring the amount involved in the inks. This feature makes it possible to simplify the structure of the apparatus, reduce the cost in manufacturing and enhance the reliability of the apparatus.

Still further, the eighth ultrasonic printer according to the present invention is to drive the ultrasonic transducers under mutually different conditions, prior to printing, and measure the received signals at the driving time to select a condition when printed. This feature makes it possible to compensate for a variation factor each printing and thus to expect a stable or reliable printing.

Still further, the ninth ultrasonic printer according to the present invention is to have a dot regulation mechanism as mentioned above item (29), whereby a regulation of dot sizes is permissible.

Still further, the tenth ultrasonic printer according to the present invention is to have a shutter, whereby an evaporation of inks is prevented and thus stable printing is available. In addition, if the ultrasonic transducers are driven in condition that the shutter is closed, it would be possible to perform heating and cleaning for inks with relatively strong power, without inviting the stain on the periphery owing to ejection of inks.

Still further, the eleventh ultrasonic printer according to the present invention is to have a control circuit for radiating ultrasonic progressive waves as mentioned in above item (37). This feature makes it possible to completely discharge also inks which would be remaining on the ink reservoir when the inks were withdrawn from the ink reservoir. Thus, it is possible to expect a stable printing in the subsequent printing.

Still further, the twelfth ultrasonic printer according to the present invention is to have a filter as mentioned in above item (43). This feature makes it possible to remove the foreign object such as paper particles mixed into the inks derived from the recording medium. Thus, the inks are maintained in a stable condition and it is possible to perform a stable printing.

Still further, the thirteenth ultrasonic printer according to the present invention is to have an ink reservoir, as described in the above item (44), which is provided with a first slit shaped aperture, a relatively wider cavity and a second slit shaped aperture. Consequently, even if an external force is applied to the printer to jump inks inside, the jumped inks will enter the cavity, and thus there is reduced the possibility such that the recording medium or the like are stained.

Still further, the fourteenth ultrasonic printer according to the present invention is to have a skew regulation mechanism for regulating the skew with respect to the longitudinal direction of the ink reservoir. This feature makes it possible to expect a stable printing even if the printer is placed on a pedestal which is inclined a little.

Still further, the fifteenth ultrasonic printer according to the present invention is to withdraw inks from the ink reservoir, when a skew exceeding a tolerance is detected, and inhibits the printer from performing the printing operation. This feature makes it possible to avoid an unstable printing.

Finally, the sixteenth ultrasonic printer according to the present invention is to have a heater for heating inks on an ink channel, so that the inks are heated in mid way of supplying the inks to the ink reservoir. This feature makes it possible to reduce the standby time required until a printing start.

DESCRIPTION OF THE PREFERRED EMBODIMENTS

Hereinafter, there will be described embodiments of the present invention.

Figure 1:
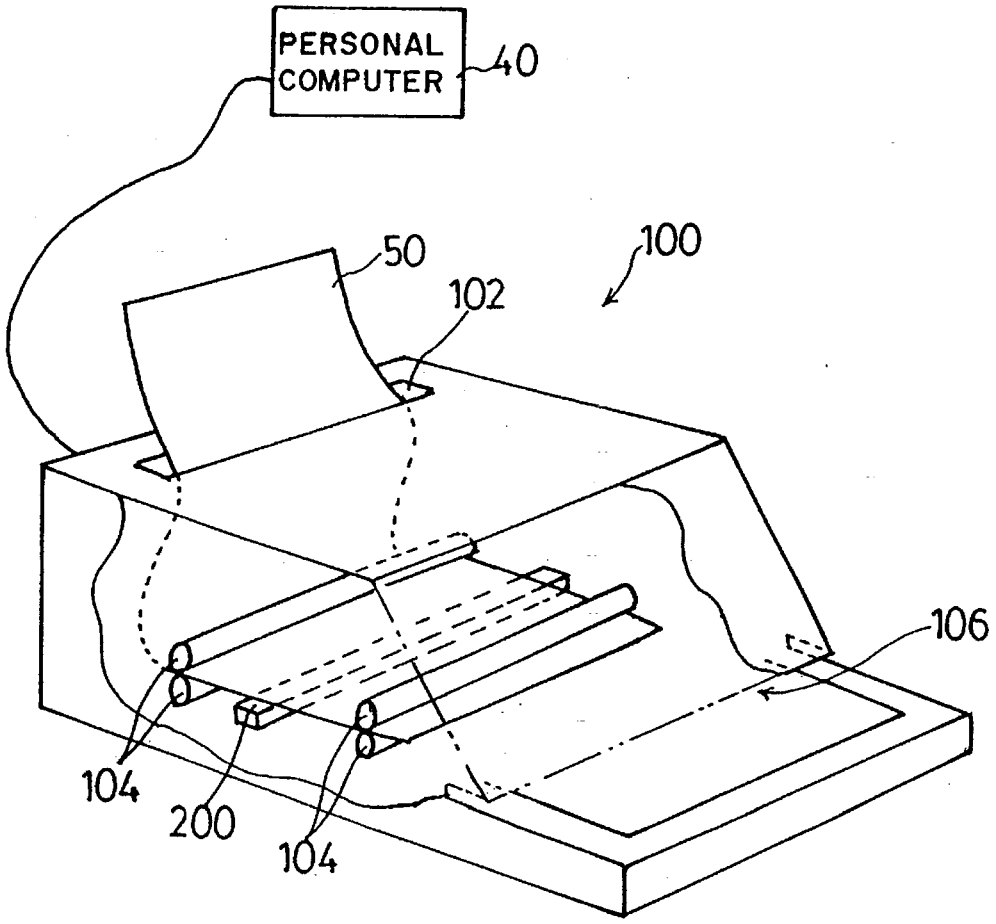
FIG. 1 is a perspective view of an ultrasonic printer according to an embodiment of the present invention, partially showing the section.

FIG. 1 is a perspective view of an ultrasonic printer according to an embodiment of the present invention, partially showing the section.

In FIG. 1, the ultrasonic printer 100 is connected to a personal computer 40 from which information (referred to as recording information, hereinafter) for character printing, graphics recording and the like is transmitted to the ultrasonic printer 100. The ultrasonic printer 100 is provided with a sheet feed aperture 102 at the top rear portion thereof, through which aperture 102 a recording sheet 50 is inserted.

The inserted recording sheet 50 is pinched and driven by rollers 104, and transferred forward, with passing through a top of a recording head 200 in mid way of the transfer. While the recording sheet 50 is passing through the top of the recording head 200, a recording on the recording sheet is performed based on recording information transferred from the personal computer 40, and thereafter the recording sheet 50 undergone the recording process is discharged from a delivery aperture 106 provided on the front of the printer.

Incidentally, while FIG. 1 shows an example in which the recording sheet 50 is conveyed, it is acceptable that the recording sheet 50 is moved relative to the recording head 200, and thus the recording head 200 is moved.

Figure 2:
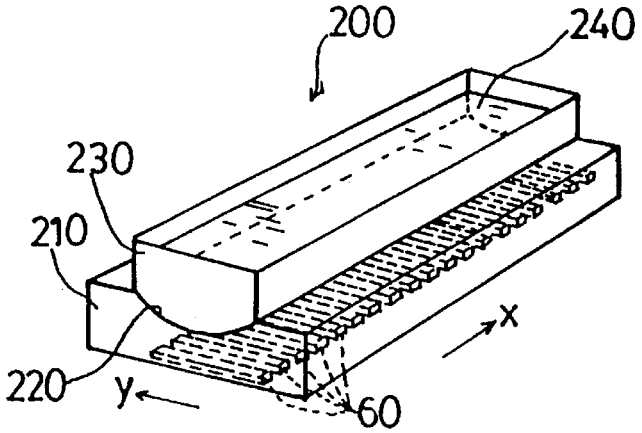
FIG. 2 is an enlarged perspective view of a recording head.

FIG. 2 is an enlarged perspective view of the recording head 200.

An array of ultrasonic transducers 60 is deposited on or otherwise maintained in intimate contact with the lower surface of an acoustic medium 210 in a predetermined array direction (a direction X in FIG. 2). There is formed on the upper surface of the acoustic medium 210 an acoustic cylindrical lens 220 having a semi-cylindrical configuration of recess provided with a curvature with respect to a direction Y perpendicularly intersecting the array direction X. The acoustic medium 210 is constructed of a material having a higher velocity of ultrasonic acoustic waves travelling through the inside of acoustic medium 210 relative to the velocity of ultrasonic waves travelling through the inside of inks. Thus, the acoustic cylindrical lens 220 serves to converge the ultrasonic waves travelling through the inside of acoustic medium 210 in the direction Y.

An ink reservoir 230 is fixed on the top of the semi-cylindrical configuration of recess of the acoustic cylindrical lens 220. The ink reservoir 230 is filled with inks 240. The recording sheet 50 (FIG. 1) travels just right above the ink reservoir 230.

It is now assumed by way of example that a high resolution, with dot size 0.06 mm and dot pitch 0.06 mm, of recording is performed on the recording sheet 50, a center frequency of the ultrasonic waves radiated from the ultrasonic transducers 60 is given by 50 MHz, and an arrangement pitch of the ultrasonic transducers 60 is given by the 0.06 mm.

Further, assuming that a recording width is of 200 mm, and the recording head 200 is fixed, the recording head 200 is 200 mm long in the direction X, and a number of arranged ultrasonic transducers 60 is 3200 pieces.

Furthermore, it is assumed that a formation of one dot needs 16 pieces of ultrasonic transducers 60, that is, a drive aperture is 1.00 mm long.

While FIG. 1 shows the embodiment in which the ultrasonic printer is provided with the fixed recording head 200, it is acceptable to modify the arrangement in such a manner that a moving mechanism for moving the recording head 200 in the direction X is provided, and thus the corresponding shortened recording head is provided, thereby reducing a number of ultrasonic transducers 60.

In accordance with a principle which will be described later, the ultrasonic waves radiated from the 16 pieces of ultrasonic transducer 60 are concentrated on the neighborhood of a free surface of the inks into a beam width 0.03 mm, so that a droplet having a particle diameter 0.03 mm is ejected. When the droplet of particle diameter 0.03 mm is deposited on the recording sheet 50, a dot having a dot size 0.06 mm as mentioned above is recorded. Incidentally, since drawing of a model of the ultrasonic waves radiated from the 16 pieces of ultrasonic transducers 60 will be troublesome, hereinafter the model may occasionally be drawn and explained in such an abbreviation that the ultrasonic waves are radiated from relatively few ultrasonic transducers 60, for example, 4 pieces or 6 pieces, to form a single convergent ultrasonic wave.

Figure 3:
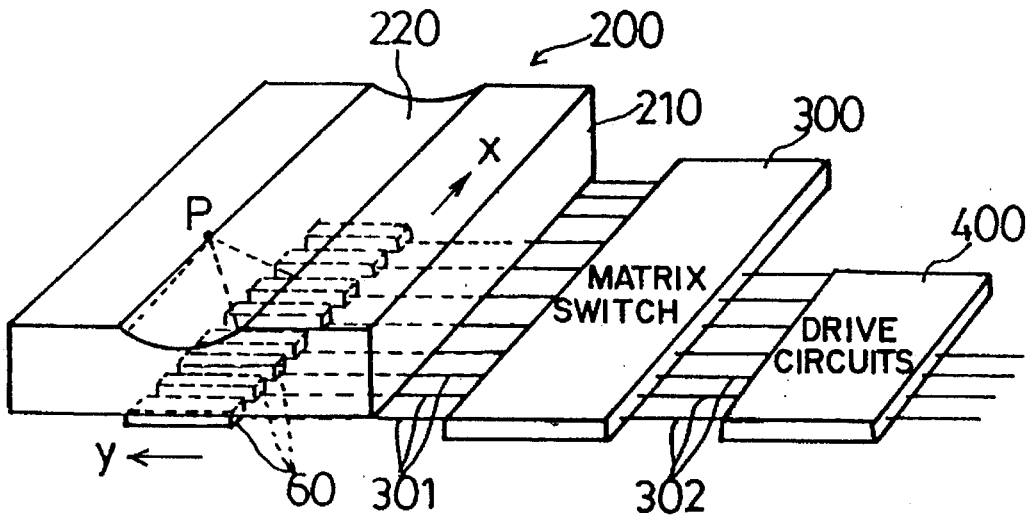
FIG. 3 is a diagram of a recording head, removing an ink reservoir, and a circuit connected to the recording head.

FIG. 3 is a diagram of a recording head, removing an ink reservoir, and a circuit connected to the recording head.

Connected to the multiple ultrasonic transducers 60 constituting the recording head 200 are lead wires 301 extended from matrix switches 300, respectively. Lead wires 302 of the input side of the matrix switch 300 are connected to drive circuits 400 which receive timing signals each representative of timing for driving the associated ultrasonic transducer 60, the timing signals being built based on recording information entered from the personal computer 40 shown in FIG. 40. The matrix switches 300 and the drive circuits 400 will be described later.

To form a single convergent ultrasonic acoustic wave, for example, 6 pieces of ultrasonic transducers 60 from among the multiple ultrasonic transducers 60 shown in FIG. 3 are driven, so that the 6 pieces of ultrasonic transducers 60 of interest radiate the ultrasonic waves, respectively. The radiated ultrasonic waves concentrate on a position P corresponding to a free surface of ink into a small spot such as one having, for example, a spot diameter 0.03 mm, by means of the acoustic cylindrical lens 220 with respect to the direction X, and in addition the following principle with respect to the direction Y. Such principle will be explained hereinafter.

Figure 4:
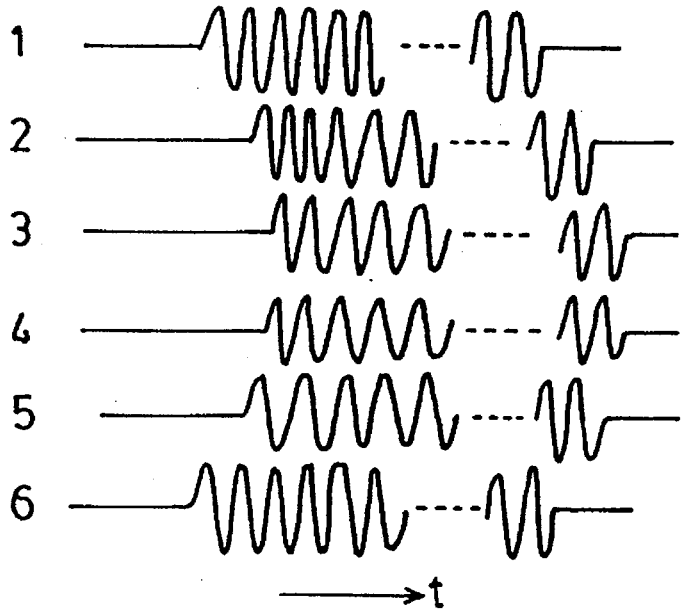
FIG. 4 is an explanatory view useful for understanding a principle of converging of ultrasonic acoustic waves in a direction X.

FIG. 4 is an explanatory view useful for understanding a principle of converging ultrasonic acoustic waves in a direction X. In FIG. 4, there are shown drive waveforms for driving 6 pieces of ultrasonic transducers 60, respectively, and in addition waveforms of ultrasonic waves radiated from these ultrasonic transducers 60, respectively.

Referring to FIG. 4, an axis of abscissas represents a time axis t. First, both edges of ultrasonic transducers 60 among 6 pieces of ultrasonic transducers 60 are initiated in driving, and thereafter, sequentially, the inner ultrasonic transducers 60 are driven. Thus, the ultrasonic waves radiated from these ultrasonic transducers 60 are equivalent to ultrasound spherical waves which are formed when ultrasound plane waves passed through an acoustic lens, so that the ultrasonic waves radiated from those ultrasonic transducers 60 are converged on a predetermined point P. Now, a sequentially phase shifted drive pattern as shown in FIG. 4 is referred to as a "phase pattern", hereinafter. By means of varying such a phase pattern, it is possible to converge the ultrasonic waves radiated from the driven 6 pieces of ultrasonic transducers 60 on not only a point on a vertical line traversing a center of those ultrasonic transducers 60, but also a point which is deviated from such a vertical line in the direction X.

Figure 5:
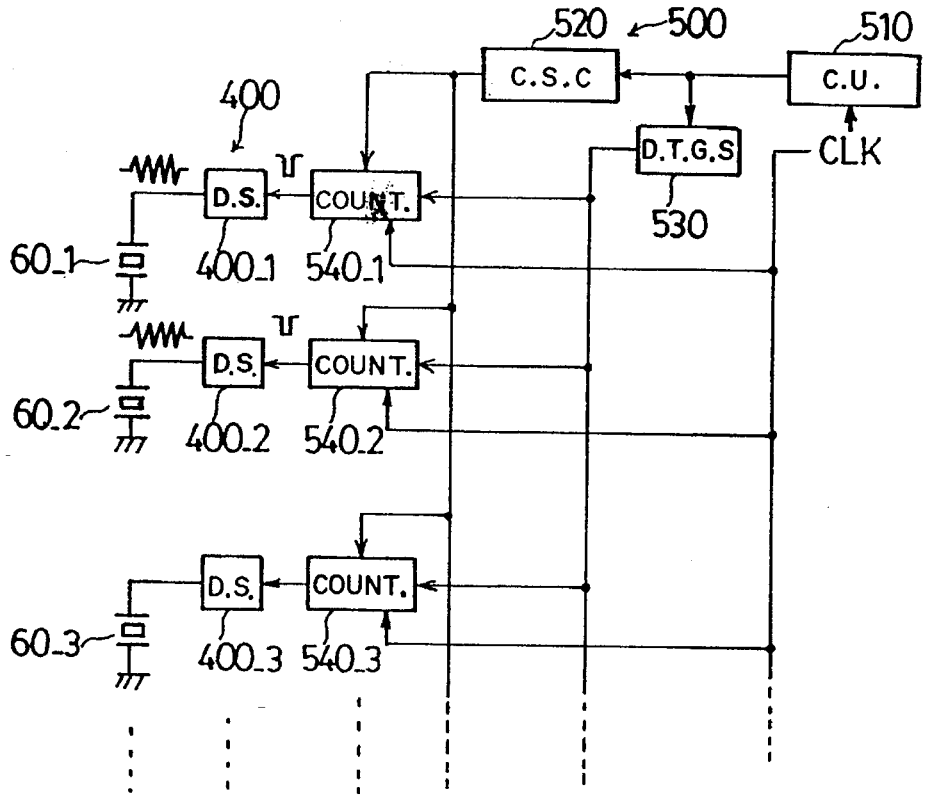
FIG. 5 is a circuit diagram of the drive circuit shown in FIG. 3 and a control circuit connected to the drive circuit.

FIG. 5 is a circuit diagram of the drive circuit 400 shown in FIG. 3 and a control circuit connected to the drive circuit. To simplify the structure, in FIG. 5, there is depicted in such a way that the matrix switch 300 is removed, and the respective ultrasonic transducers 60 are driven directly by the drive circuit 400. It is noted that there is a need to distinguish the multiple ultrasonic transducers 60 from each other, they are denoted as ultrasonic transducers 60_1, 60_2, . . . , 60_n, . . . , likewise, among the drive circuits 400, drive circuits for driving the ultrasonic transducers 60_1, 60_2, . . . , 60_n, . . . are denoted as 400_1, 400_2, . . . , 400_n, . . . , hereinafter. This notation may also be applied for other circuits, members and the like, which will be described later.

The control circuit 500 is operative on the basis of a reference clock CLK. If an ultrasound frequency is given with 50 MHz as noted above, there is need to provide a reference clock CLK having 200 MHz as a clock frequency.

The control circuit 500 is provided with a number of counters 540_1, 540_2, 540_3, . . . . Prior to radiation of the ultrasonic waves, a control unit 510 constituting the control circuit 500 transmits to a counter set circuit 520 the respective counter set values for the counters 540_1, 540_2, 540_3, . . . . The counter set circuit 520 sets the received counter set values to the associated counters 540_1, 540_2, 540_3, . . . , respectively. Thereafter, a drive timing generating circuit 530 transmits, upon receipt of an instruction of the control unit 510 in a predetermined timing immediately before the emission of the ultrasonic waves, count enable signals to instruct an initiation of counting operation for the reference clock CLK to the counters 540_1, 540_2, 540 _3, . . . , respectively. Upon receipt of the count enable signals, the counters 540_1, 540_2, 540_3, . . . initiate the counting operation for reference clock CLK, respectively. When the counting value reaches the count set value, in the respective timings, the counters 540_1, 540_2, 540_3, . . . transmit the timing signals to the drive circuits 400_1, 400_2, 400_3, . . . . The drive circuits 400_1, 400_2, 400_3, . . . issue and output the respective drive signals to drive the associated ultrasonic transducers 60_1, 60_2, 60_3, . . . in the associated timings. In this manner, the ultrasonic transducers 60_1, 60_2, 60_3, . . . each radiate an ultrasonic wave having a predetermined phase pattern.

Figure 6:
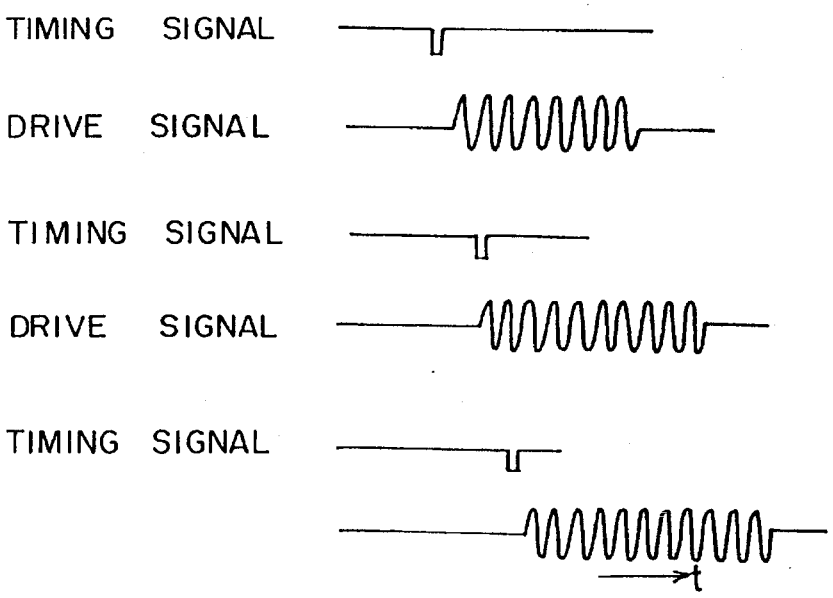
FIG. 6 is a wave form chart showing a relation between timing signals and drive signals.

FIG. 6 is a signal wave form chart showing a relation between timing signals and drive signals, an axis of abscissas being representative of a time axis t.

The drive circuits 400_1, 400_2, 400_3, . . . make up, upon receipt of mutually different timing signals as shown in FIG. 6, the respective drive signals which are mutually different in phase. Consequently, by means of controlling the issuance of the respective timing signals, in other words, adjusting the counter set values to the respective counters 540_1, 540_2, 540_3, . . . , for example, the ultrasonic waves having phase patterns as shown in FIG. 4 are radiated and converged on a predetermined point.

The control circuit 500 has as mentioned above, a plurality of counters 540_1, 540_2, 540_3, . . . for the number of clock pulses of the reference clock CLK, and is so arranged that when the counting value reaches the count set value, in the respective timings, the counters 540_1, 540_2, 540_3, . . . transmit the timing signals to instruct driving of the respective ultrasonic transducers 60_1, 60_2, 60_3, . . . to the drive circuits 400_1, 400_2, 400_3, . . . . Therefore, this arrangement has, in comparison with the case that analog delay lines are used to form the phase patterns, advantageous points such that the control is easier since the digital processing is applied, and the system is inexpensive.

Figure 7:
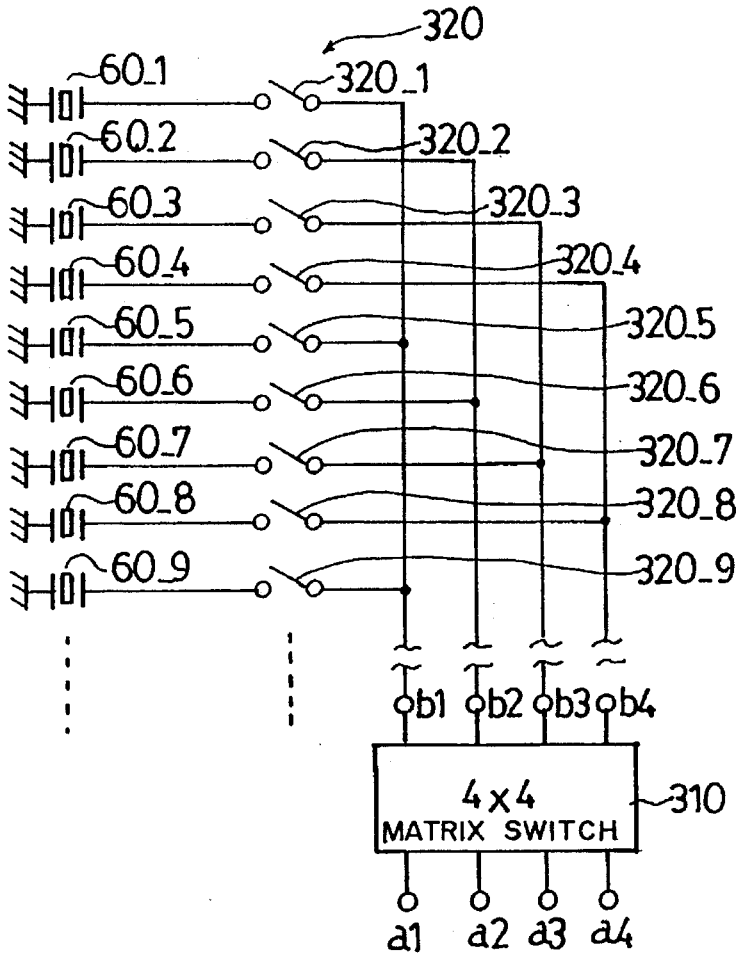
FIG. 7 is a view showing an arrangement of matrix switches shown in FIG. 3.

FIG. 7 is a view showing an arrangement of matrix switches 300 shown in FIG. 3, in which there are exemplarily so arranged that 4 pieces of ultrasonic transducers 60 are used to form a single convergent ultrasonic wave.

The matrix switch 300 has 4 input terminals a1, a2, a3 and a4, and 4 output terminals b1, b2, b3 and b4. The matrix switch 300 comprises a matrix switch 310 capable of optionally connecting these inputs and outputs, and contacts 320 associated with the respective ultrasonic transducers 60_1, 60_2, 60_3, . . . . As shown in FIG. 7, connected to the contacts b1, b2, b3 and b4 of the matrix switch 310 contacts 320_1, 320_5, 320_9, . . . , which are connected to each other every fourth pieces; 320_2, 320_6, . . . ; 320_3, 320_7, . . . ; and 320_4, 320_8, . . . , respectively.

Figure 8:
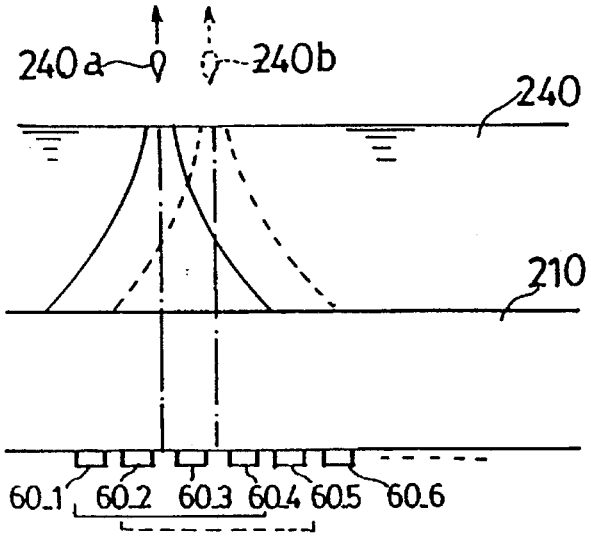
FIG. 8 is a diagram useful for explanation of a shift of convergent ultrasonic acoustic waves by change-over of the matrix switches.

FIG. 8 is a diagram useful for explanation of a shift of convergent ultrasonic acoustic waves by change-over of the matrix switch 300.

The input terminals a1, a2, a3 and a4 of the matrix switch 310 are connected to the output terminals b1, b2, b3 and b4, respectively, and only four contacts 320_1, 320_2, 320_3 and 320_4 of the contacts 320 conduct. In this state, drive signals each having a predetermined phase pattern are supplied to the input terminals a1, a2, a3 and a4. As a result, the entered drive signals are applied to the ultrasonic transducers 60_1, 60_2, 60_3 and 60_4, respectively, so that the ultrasonic transducers 60_1, 60_2, 60_3 and 60_4 eject ultrasonic waves, respectively. The ultrasonic waves ejected from these ultrasonic transducers 60_1, 60_2, 60_3 and 60_4 travel, as shown in FIG. 8, through the inside of the acoustic medium 210 and the inside of inks, and converge on the neighborhood of a free surface of inks 240, so that an ink droplet 240*a* is ejected from the convergent point.

Next, the matrix switch 310 is changed over in connection to connect the input terminals a1, a2, a3 and a4 to the output terminals b2, b3, b4 and b1, respectively, while the contact 320_1 is disconnected, instead the contact 320_5 is connected. In this condition, drive signals each having the same phase pattern as the previous one are supplied to the input terminals a1, a2, a3 and a4. As a result, the entered drive signals are applied to the ultrasonic transducers 60_2, 60_3, 60_4 and 60_5, respectively, so that the ultrasonic transducers 60_2, 60_3, 60_4 and 60_5 eject ultrasonic waves, respectively. The ultrasonic waves ejected from these ultrasonic transducers 60_2, 60_3, 60_4 and 60_5 travel, as depicted by broken lines in FIG. 8, through the inside of the acoustic medium 210 and the inside of inks, and converge on the point deviated from the previous convergent point by the corresponding one arrangement pitch of the ultrasonic transducers 60, so that an ink droplet 240*b* is ejected from the shifted convergent point.

In this manner, the matrix switch 310 and the contacts 320 are sequentially switched while the drive signals are supplied, so that a line of dots are recorded.

The matrix switch 300, arranged as shown in FIG. 7, comprises 3200 pieces of ultrasonic transducers 60, and supposing that 16 pieces of ultrasonic transducers 60 are driven to form a single convergent ultrasonic wave, a matrix switch having 16 pieces of input and output terminals, and 3200 pieces of contacts. This is a sufficient level for implementation of the system in practice.

Figure 9:
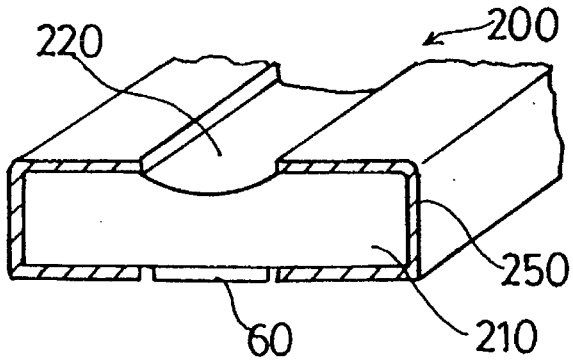
FIG. 9 is a perspective view of a recording head, removing an ink reservoir, according to another example.

FIG. 9 is a perspective view of a recording head, removing an ink reservoir, according to another example.

In FIG. 9, there is shown a recording head 200 having an acoustic medium 210 of which the periphery is covered with an acoustic absorption member 250, except for the ultrasonic transducer 60 and the acoustic lens 220. When the acoustic medium 210 is covered with the acoustic absorption member 250 in this manner, absorbed are components, which will not contribute to the formation of the convergent ultrasonic waves, from among the ultrasonic waves radiated from the ultrasonic transducers 60. This structure makes it possible to reduce the ultrasonic waves as a noise component, and thus to prevent the useless dots from being formed, for example, owing to the fact that standing waves of the ultrasonic waves are formed within the acoustic medium 210 and then emitted to eject ink droplets.

Figure 10A:
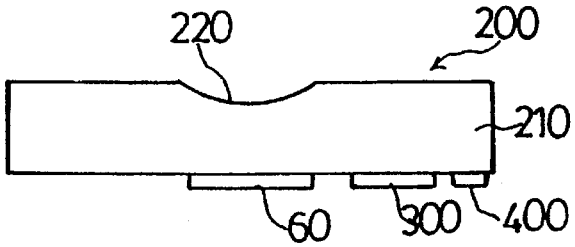
FIG. 10A is a perspective view of a recording head, removing an ink reservoir, according to further another example.
Figure 10B:
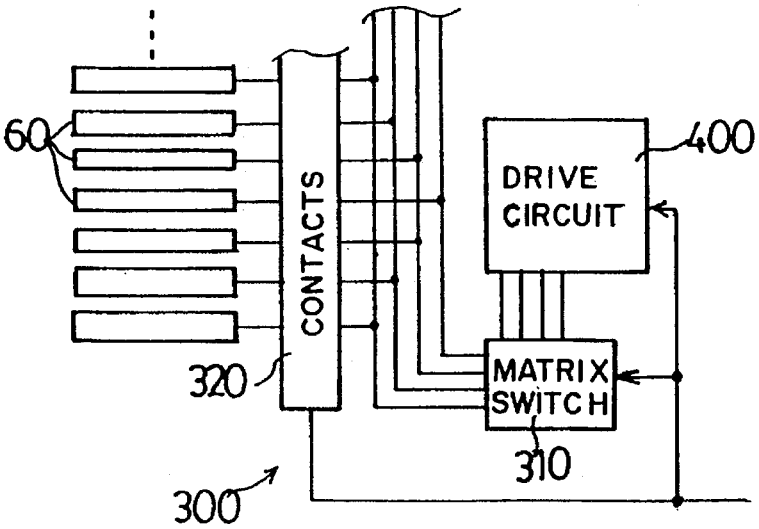
FIG. 10B is a block diagram of a circuit carried on the recording head shown in FIG. 10A.

FIG. 10A is a perspective view of a recording head, removing an ink reservoir, according to further another example, and FIG. 10B is a block diagram of a circuit carried on the recording head shown in FIG. 10A;

On the lower surface of an acoustic medium 210, there are fixed the ultrasonic transducers 60, and in addition the matrix switch 300 (the matrix switch 301 and the contacts 320 shown in FIG. 7) as shown in FIG. 3 and a drive circuit 400. The circuit portion having a large number of wires to be connected to the ultrasonic transducers 60 is disposed near the ultrasonic transducers 60 in this manner. This arrangement makes it possible to avoid the necessity for elongating a large number of wires, thereby contributing to preventing noises and also reducing the cost.

Next, there will be explained converging means capable of being used instead of the above-mentioned acoustic lens 220 (e.g. FIG. 3) for concentrating the ultrasonic waves in the direction Y perpendicularly intersecting the arrangement direction (direction X) of the ultrasonic transducers 60, or with such an acoustic lens 220.

Figure 11:
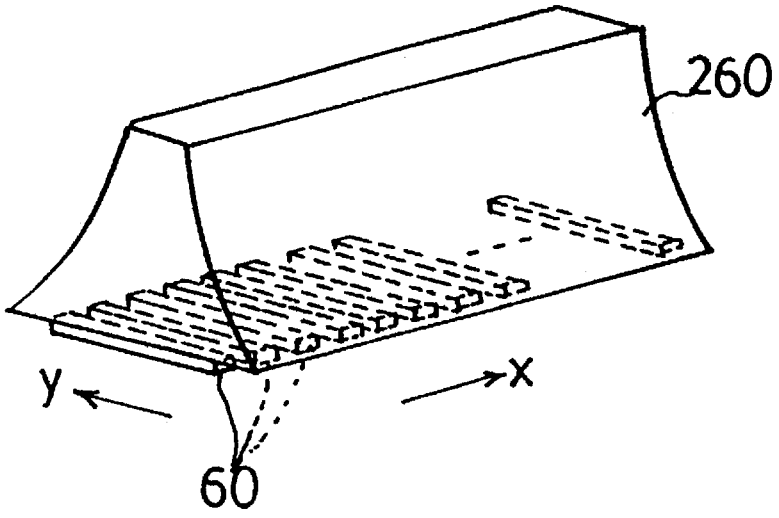
FIG. 11 is a perspective view of a recording head, removing an ink reservoir, according to still further another example.

FIG. 11 is a perspective view of a recording head, removing an ink reservoir, according to still further another example.

The recording head is provided with an acoustic horn 260 for concentrating the ultrasonic waves in the direction Y, with an array of ultrasonic transducers 60 being deposited on the lower surface of the acoustic horn 260. The ultrasonic waves radiated from the ultrasonic transducers 60 are converged while travelling the inside of the acoustic horn 260.

Figure 12:
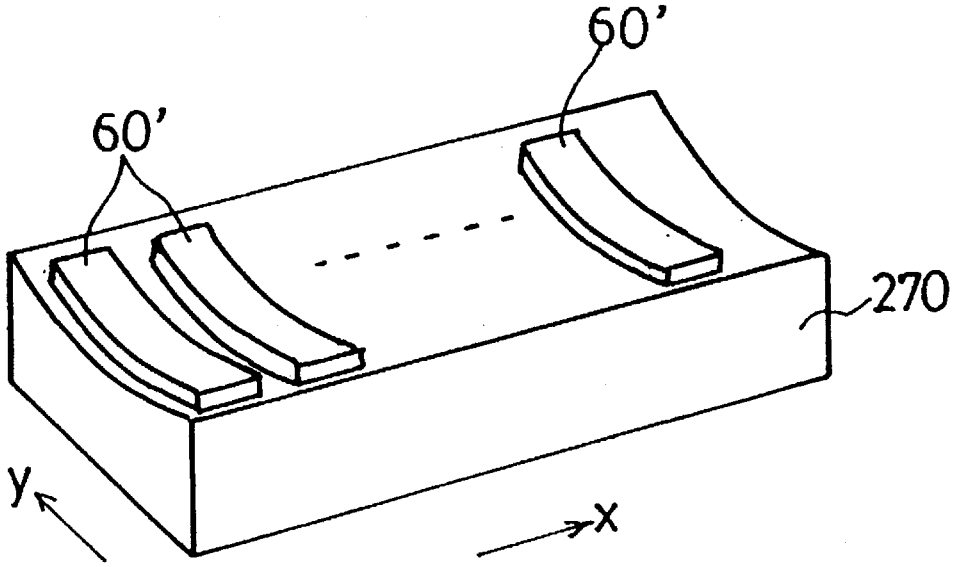
FIG. 12 is a perspective view of a recording head, removing an ink reservoir, according to still further another example.

FIG. 12 is a perspective view of a recording head, removing an ink reservoir, according to still further another example.

The recording head is provided with a rear base 270 on the top of which ultrasonic transducers 60' each having a ultrasonic radiation surface curved in the direction Y are fixed. When the curved ultrasonic transducer 60' emits ultrasonic waves, the emitted ultrasonic waves are converged in the direction Y, since the curvature of the ultrasonic transducer itself serves as the lens.

Figure 13:
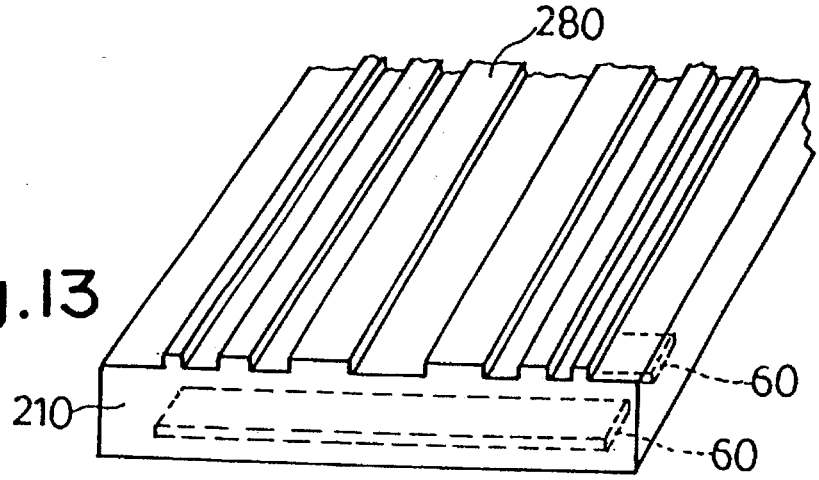
FIG. 13 is a perspective view of a recording head, removing an ink reservoir, according to still further another example.

FIG. 13 is a perspective view of a recording head, removing an ink reservoir, according to still further another example.

In FIG. 13, an array of ultrasonic transducers 60 are deposited on the back face of an acoustic medium 210, and an acoustic Fresnel lens 280 is formed on a front face thereof. The acoustic Fresnel lens 280 can be formed, when the acoustic medium 210 is constructed of a material such as a glass for example, by means of practicing the etching treatment such that the glass surface is provided with the configuration as shown in FIG. 13.

Figure 14A:
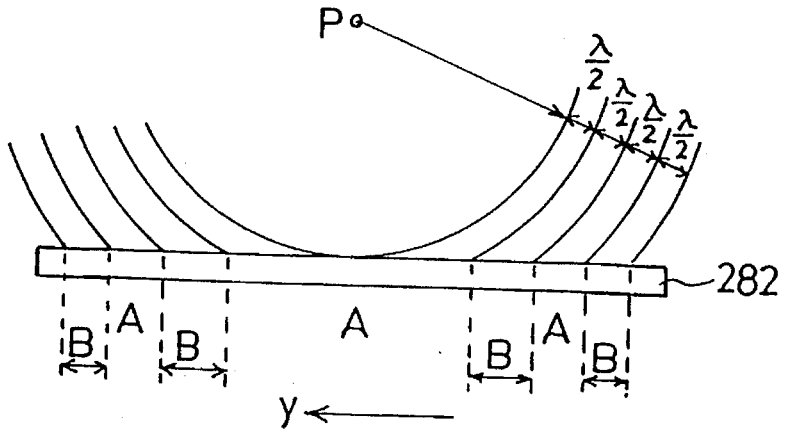
FIG. 14A is an explanatory view useful for understanding a principle of an acoustic Fresnel lens; converging of ultrasonic acoustic waves in a direction X.
Figure 14B:
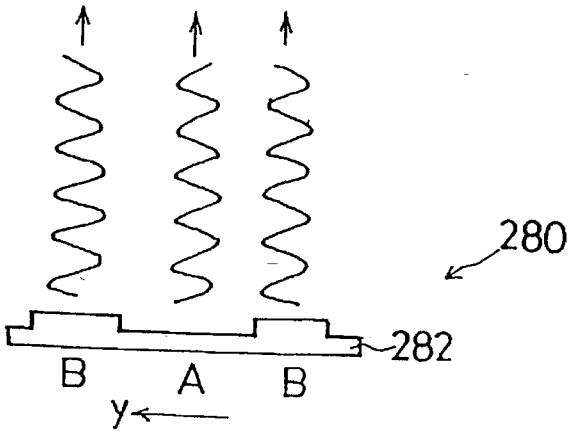
FIG. 14B is an explanatory view useful for understanding a principle of an acoustic Fresnel lens; converging of ultrasonic acoustic waves in a direction X.

FIGS. 14A and FIG. 14B are explanatory views useful for understanding a principle of an acoustic Fresnel lens.

As shown in FIG. 14A, circular arcs having radiuses sequentially increasing at intervals of half of wavelength $\lambda$ of the ultrasonic wave are depicted with a predetermined convergent point P in the center in a direction Y in such a manner that they intersect a surface of a substrate 282 of the acoustic Fresnel lens 280. The surface of the substrate 282 is segmented into areas put between the adjacent circular arcs. While areas B appearing every other one, as seen in FIG. 14A, are retained as they are, other areas A appearing every other one are subjected to the etching treatment by the corresponding thickness which is sufficient for inverting the phase of the ultrasonic wave. In this manner, the acoustic Fresnel lens 280 may radiate or emit ultrasonic waves which are inverted in phase and interfere with each other, so that the ultrasonic waves are converged onto the convergent point P.

As apparent from the above mentioned embodiments, there are considered various ones as converging means for converging the ultrasonic waves in the direction Y. Thus, among those converging means, it is possible to optionally use a suitable one or ones in their combination. Further, as described above, while array of ultrasonic transducers are used to converge the ultrasonic waves in the direction X, it is acceptable to apply those technologies to the systems in the direction Y. More specifically, a plurality of ultrasonic transducers are arranged not only in the direction X but also in the direction Y. By means of controlling the phases of drive signals for an array of ultrasonic transducers in the direction Y, it is possible to converge the ultrasonic waves also in the direction Y.

Next, there will be explained techniques for simultaneously forming a plurality of convergent ultrasonic waves.

Figure 15:
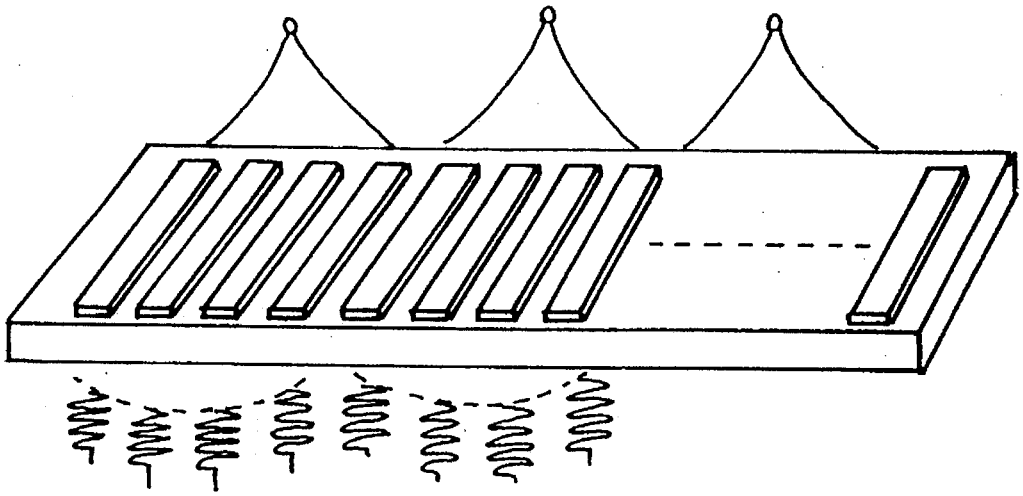
FIG. 15 is a typical illustration showing an example of techniques for simultaneously forming a plurality of convergent ultrasonic acoustic waves.

FIG. 15 is a typical illustration showing an example of techniques for simultaneously forming a plurality of convergent ultrasonic acoustic waves. According to the present example, a single convergent ultrasonic acoustic wave is formed with 4 pieces of ultrasonic transducers 60. A plurality of ultrasonic transducers 60 are segmented into a plurality of blocks each comprising 4 pieces of ultrasonic transducers 60. In one time of cycle for ejecting ink droplets, a single convergent ultrasonic wave is formed on each block of the ultrasonic transducers 60. Thus, N pieces of dots will be formed in one cycle, where N is an integer being representative of a total number of ultrasonic transducers/4.

In this manner, at least part of plural ultrasonic transducers of an array of ultrasonic transducers 60 are segmented into a plurality of blocks each including a plurality of ultrasonic transducers and excluding any ultrasonic transducers included in other blocks, and the convergent ultrasonic wave is formed on each block in one time of cycle for ejecting ink droplets. Thus, it is possible to reduce the time for recording.

Figure 16:
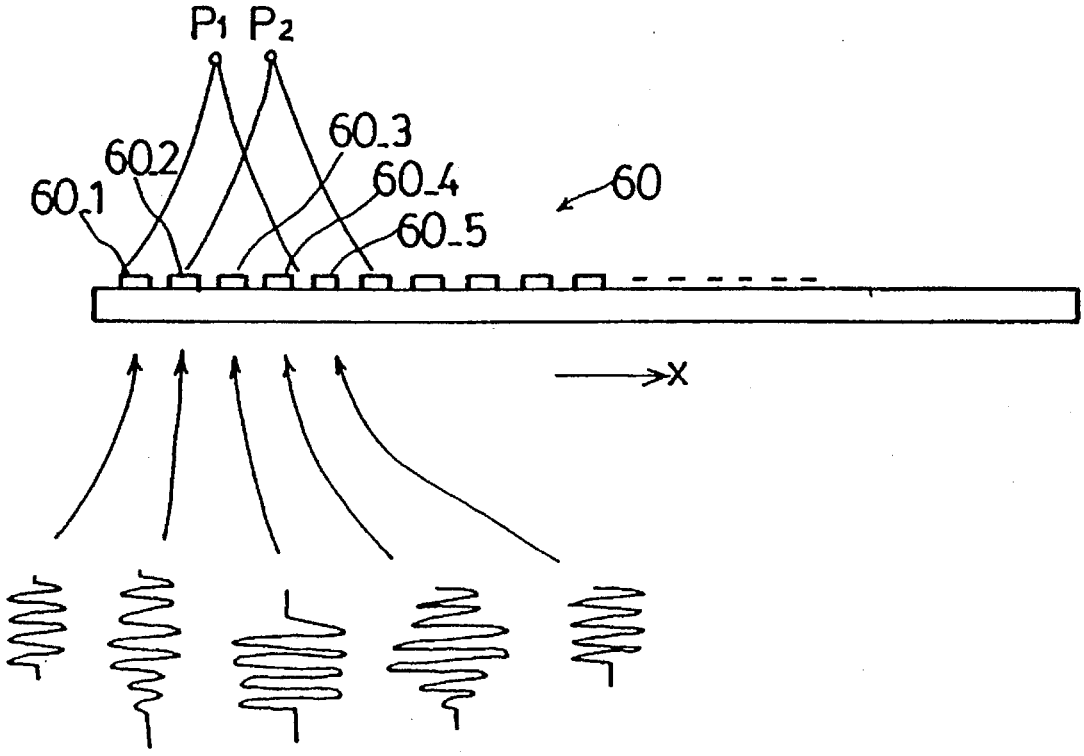
FIG. 16 is a typical illustration showing another example of techniques for simultaneously forming a plurality of convergent ultrasonic acoustic waves.

FIG. 16 is a typical illustration showing another example of techniques for simultaneously forming a plurality of convergent ultrasonic acoustic waves.

According to the present example, a convergent point $P_1$ is formed by ultrasonic waves radiated from 4 pieces of ultrasonic transducers 60_1, 60_2, 60_3 and 60_4, and a convergent point $P_2$ is formed by ultrasonic waves radiated from 4 pieces of ultrasonic transducers 60_2, 60_3, 60_4 and 60_5 shifted by one. Since the ultrasonic transducer 60_1 contributes to only the formation of the convergent point $P_1$, drive signal for the formation of the convergent point $P_1$ is applied to the ultrasonic transducers 60_1. Since the center ultrasonic transducers 60_2, 60_3 and 60_4 contribute to the formation of both the convergent points $P_1$ and $P_2$, drive signals for the formation of the convergent points $P_1$ and $P_2$ are applied to the ultrasonic transducers 60_2, 60_3 and 60_4 on a superposition basis. Finally, since the ultrasonic transducer 60_5 contributes to only the formation of the convergent point $P_2$, drive signal for the formation of the convergent point $P_2$ is applied to the ultrasonic transducers 60_5. Thus, two convergent points $P_1$ and $P_2$ are simultaneously formed.

In this manner, at least part of plural ultrasonic transducers (e.g. 5 pieces of ultrasonic transducers 60_1, 60_2, 60_3, 60_4 and 60_5 as shown in FIG. 16) of an array of ultrasonic transducers are segmented into a plurality of blocks one of which includes a plurality of ultrasonic transducers (ultrasonic transducers 60_1, 60_2, 60_3 and 60_4), part (the center 3 pieces of ultrasonic transducers 60_2, 60_3 and 60_4) of these being included also in another block, and the another block including a plurality of ultrasonic transducers (ultrasonic transducers 60_2, 60_3, 60_4 and 60_5), and there is provided such a control that the convergent ultrasonic wave is formed on each block in one time of cycle for ejecting ink droplets. Thus, also in this case, it is possible to reduce the time for recording.

Figure 17:
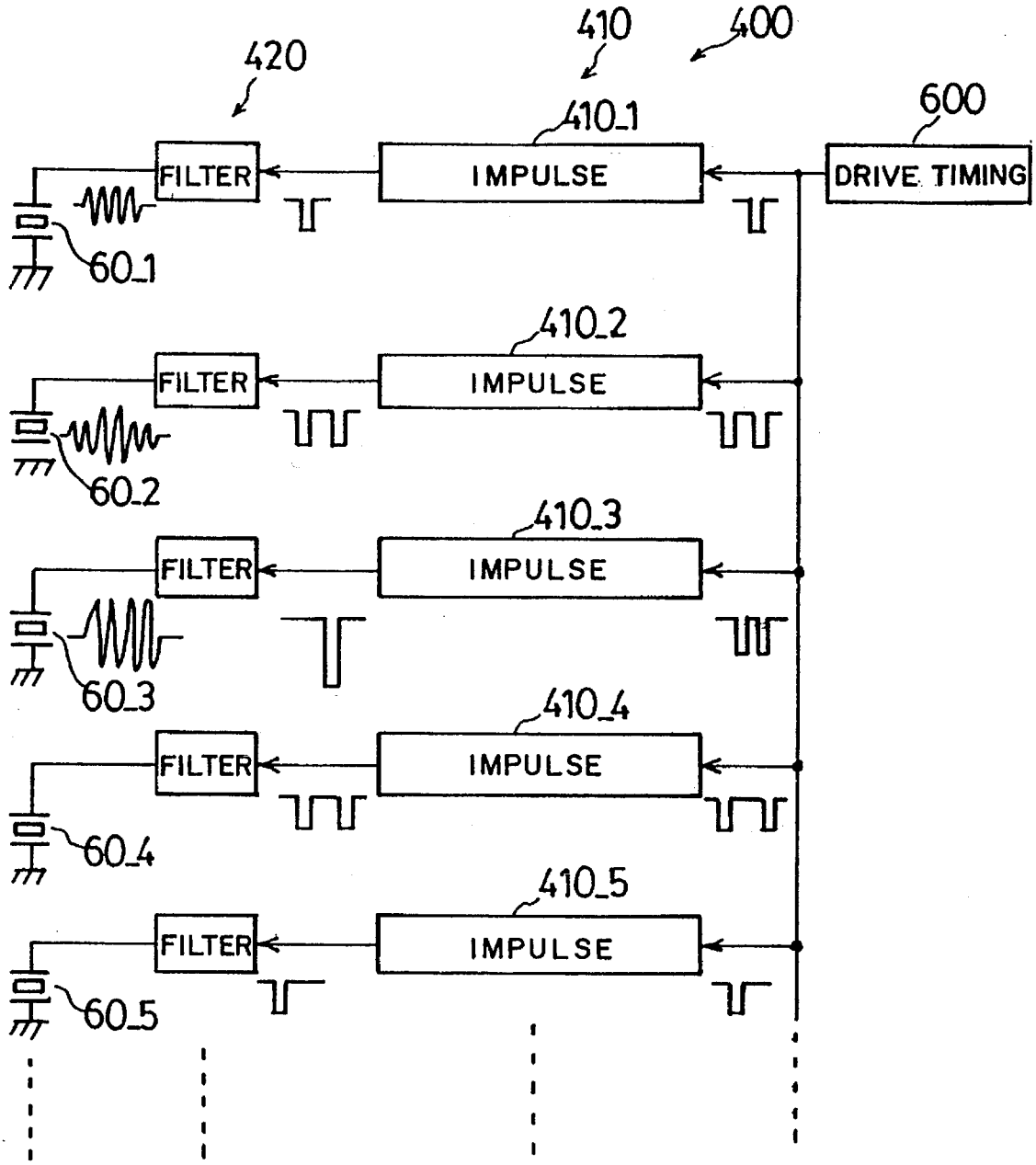
FIG. 17 is a diagram of a drive circuit by way of example which is applied to a system wherein a plurality of convergent ultrasonic acoustic waves are simultaneously formed as shown in FIG. 16.

FIG. 17 is a diagram of a drive circuit 400 (refer to FIG. 5) by way of example which is applied to a system wherein a plurality of convergent ultrasonic acoustic waves are simultaneously formed as shown in FIG. 16.

The drive circuit 400 comprises a high voltage impulse generating circuit 410 and a filter circuit 420. The high voltage impulse generating circuit 410 is for converting a timing signal derived from a drive timing generating circuit 600 into a high voltage impulse. As shown in a high voltage impulse generating circuit 410_3, when a plurality of timing signals (in this example, 2 timing signals) are continuously applied, the circuit generates a high voltage impulse corresponding to the number of timing signals (in this example, twice as large as the voltage of output impulses of other high voltage impulse generating circuits 410_1, 410_2, 410_4 and 410_5). Incidentally, if it is difficult to generate a voltage corresponding to the number of timing signals, it is acceptable to generate a high voltage impulse having, for example, double the pulse width to be equivalent in energy. High voltage impulse generating circuits 410_2 and 410_4 each receive two timing pulse signals which are mutually different in time, and generate high voltage impulses corresponding to the timing pulse signals at the time points when the timing pulse signals are applied, respectively.

The filter circuit 420 is a passive filter circuit comprising inductance L, capacitance C and resistance R in their combination, the passive filter circuit having a resonance point on a frequency of ultrasonic waves. Thus, upon receipt of the high voltage impulse output from the high voltage impulse generating circuit 410, the filter circuit 420 makes up a drive signal having a frequency which is the same as that of the ultrasonic waves, several to dozens of waves having duration necessary for ejection of inks. Consequently, when the drive timing generating circuit 600 transmits to the high voltage impulse generating circuits 410_1, 410_2, 410_3, 410_4 and 410_5 the associated timing signals at the respective timings corresponding to the formation of two convergent points $P_1$ and $P_2$ shown in FIG. 16, the filter circuit 420 makes up drive signals corresponding to the formation of two convergent points $P_1$ and $P_2$ in the form of their mixture. According to the scheme shown in FIG. 17, it is sufficient for recording a plurality of dots to supply a plurality of timing signals to the drive circuit 400, and a superposition of the drive signals are automatically performed in the filter circuit 420.

In FIGS. 16 and 17, there are shown a case where two convergent points $P_1$ and $P_2$ are formed. An expansion of this makes it possible in one cycle for ejecting ink droplets to perform a line of recording over the whole width of an array of ultrasonic transducers 60 in the direction X (see FIG. 16), thereby dramatically enhancing a recording speed.

While the above-mentioned examples are mainly involved in case that an arrangement pitch of the ultrasonic transducers 60 and a pitch of dots recorded on a recording sheet 50 (see FIG. 1) are equal to each other, according to the present invention, such a restriction is unnecessary.

Figure 18A:
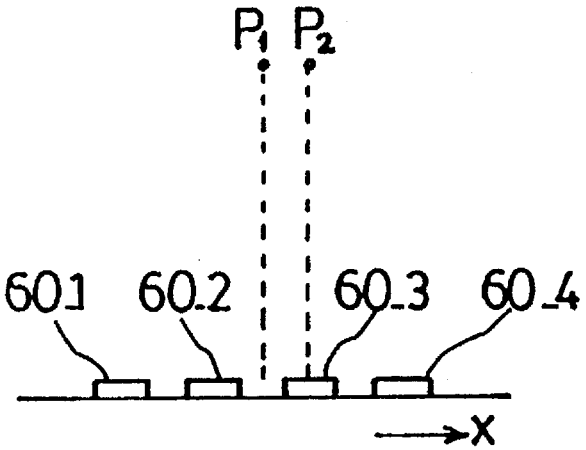
FIG. 18A is an explanatory view useful for understanding an example of techniques for varying a pitch of dots recorded on a recording sheet.
Figure 18B:
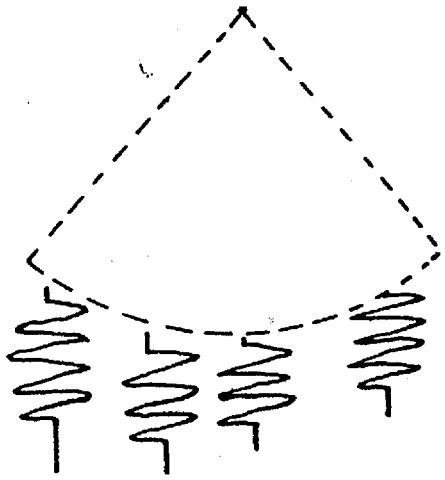
FIG. 18B is an explanatory view useful for understanding an example of techniques for varying a pitch of dots recorded on a recording sheet.
Figure 18C:
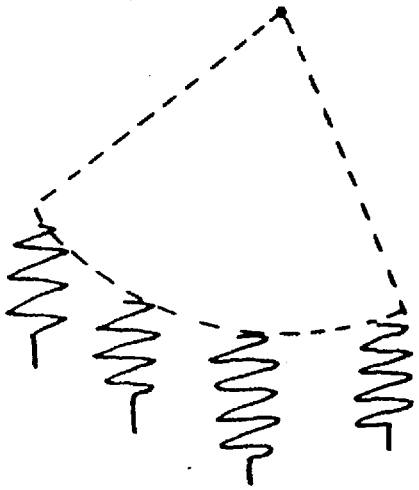
FIG. 18C is an explanatory view useful for understanding an example of techniques for varying a pitch of dots recorded on a recording sheet.

FIGS. 18A–18C are explanatory views useful for understanding an example of techniques for varying a pitch of dots recorded on a recording sheet 50;

When four ultrasonic transducers 60_1, 60_2, 60_3 and 60_4 shown in FIG. 18A receive drive signals having a phase pattern which is symmetric with respect to the direction X as shown in FIG. 18B, those ultrasonic transducers 60_1, 60_2, 60_3 and 60_4 will radiate ultrasonic waves which concentrate on a point $P_1$. On the other hand, when the four ultrasonic transducers 60_1, 60_2, 60_3 and 60_4 shown in FIG. 18A receive drive signals having a phase pattern which is slanted with respect to the direction X as shown in FIG. 18C, those ultrasonic transducers 60_1, 60_2, 60_3 and 60_4 will radiate ultrasonic waves which concentrate on a point $P_2$, for example, according to the skew.

In this manner, by means of modifying the phase pattern of the drive signals, it is possible to form dots with a dot pitch smaller than an arrangement pitch of the ultrasonic transducer 60. This permits the ultrasonic transducers 60 to be arranged with relatively wider pitch, thereby reducing the number of ultrasonic transducers 60 and in addition decreasing cost of the product.

Further, since an adoption of the scheme of modifying the phase pattern as mentioned above makes it possible to determine a dot pitch regardless of an arrangement pitch of the ultrasonic transducers 60, it may be so arranged that the dot pitch is variable, so that recording is carried out with a fine pitch in case that a high density of recording is needed, for example, in case of recording of pictures, otherwise with a rough pitch in case that a low density of recording is acceptable, for example, in case of recording of large characters.

Incidentally, when the dot pitch is modified in recording on the recording sheet 50 (see FIG. 1), it is preferable also to change a size of dots.

According to the present invention, it is also easy to vary the dot size.

The dot size depends on a spot size of the ultrasonic waves at the convergent point. Consequently, it is sufficient for varying the dot size to vary the spot size of the ultrasonic waves at the convergent point. For example, to reduce the dot size, a higher frequency of ultrasonic waves may be emitted with increasing the drive frequency, or the number of ultrasonic transducers 60 to be driven for formation of a single convergent ultrasonic acoustic beam may be increased. Assuming that a dot size is 0.06 mm when a frequency of ultrasonic waves is given with 50 MHz, and the number of ultrasonic transducers to be driven for formation of a single convergent ultrasonic acoustic beam is 16 pieces, when it is modified that either the frequency of ultrasonic waves is given with 100 MHz, or the number of ultrasonic transducers to be driven for formation of a single convergent ultrasonic acoustic beam is increased to 32 pieces, the dot size may be increased to 0.03 mm.

Figure 19:
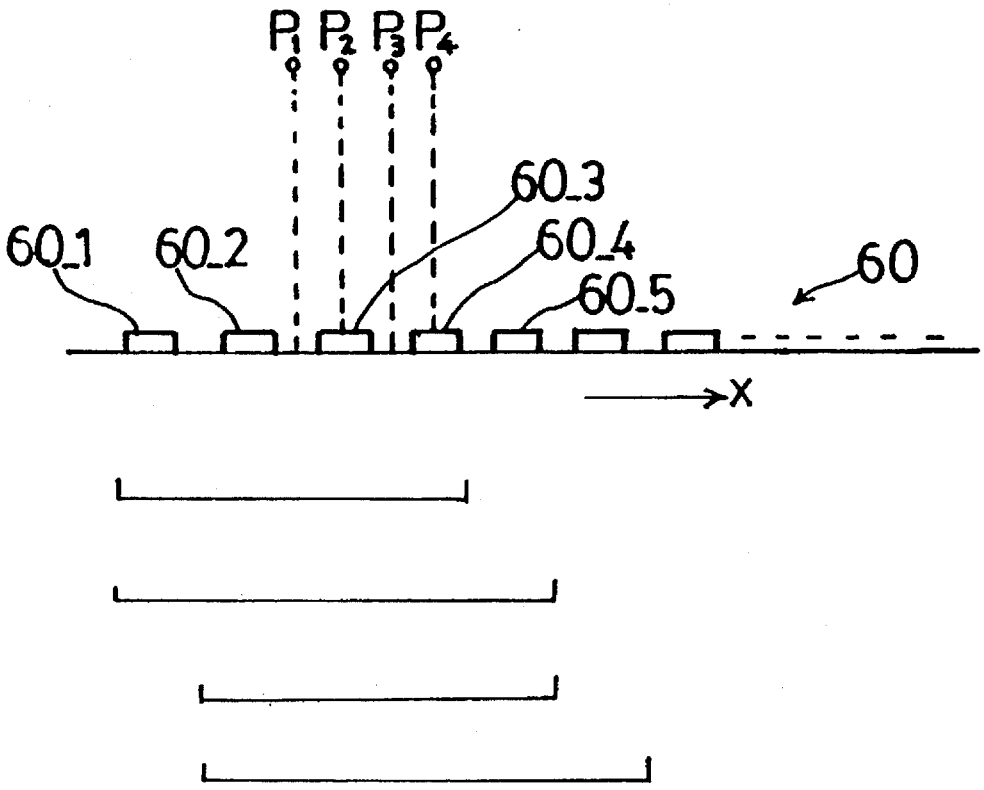
FIG. 19 is an explanatory view useful for understanding another example of techniques for forming dots of a closer pitch than an-arrangement pitch of ultrasonic acoustic transducers.

FIG. 19 is an explanatory view useful for understanding another example of techniques for forming dots of a closer pitch than an arrangement pitch of ultrasonic acoustic transducers, wherein the number of ultrasonic transducers to be driven for formation of a single convergent ultrasonic acoustic beam is varied.

According to the example shown in FIG. 19, there are used 4 pieces of ultrasonic transducers 60_1, 60_2, 60_3 and 60_4 for formation of a convergent point $P_1$; 5 pieces of ultrasonic transducers 60_1, 60_2, 60_3, 60_4 and 60_5 for formation of the adjacent convergent point $P_2$; 4 pieces of ultrasonic transducers 60_2, 60_3, 60_4 and 60_5 for formation of the adjacent convergent point $P_3$; and 5 pieces of ultrasonic transducers 60_2, 60_3, 60_4, 60_5 and 60_6 for formation of the adjacent convergent point $P_4$. In this case, there is performed, in accordance with necessity, switching of power for the drive signals and/or the phase patterns between a case where 4 pieces of ultrasonic transducers are driven and a case where 5 pieces of ultrasonic transducers are driven.

In this manner, to form one and another of two dots which are adjacent each other in the direction X, even number and odd number of ultrasonic transducers 60 are driven, so that dots having a pitch of one half of an arrangement pitch of ultrasonic transducers may be formed.

Figure 20A:
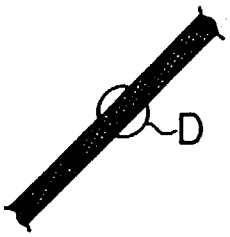
FIG. 20A is a view showing a slant-recorded thick line.
Figure 20B:
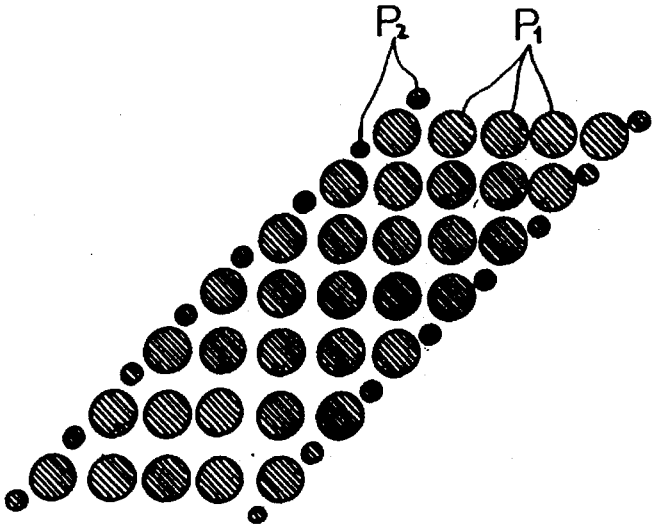
FIG. 20B is a partially enlarged view of the thick line shown in FIG. 20A.

FIG. 20A is a view showing a slant-recorded thick line, which is intended to explain an advantageous point of a matter that a dot size and a dot pitch are varied, and FIG. 20B is a partially enlarged view of the thick line circled by a circle D in FIG. 20A;

In case that the slanted thick line is recorded, it involves such a problem that there appear notched portions on the slash with only relatively large size of dots $P_1$. In view of this matter, relatively small size of dots $P_2$ each are recorded between the relatively large size of dots $P_1$. As a result, the slash looks like a remarkably smooth line.

As apparent from the above-described embodiments, an ultrasonic printer according to the present invention has a significant flexibility, and thus may be arranged with various modifications.

Figure 21:
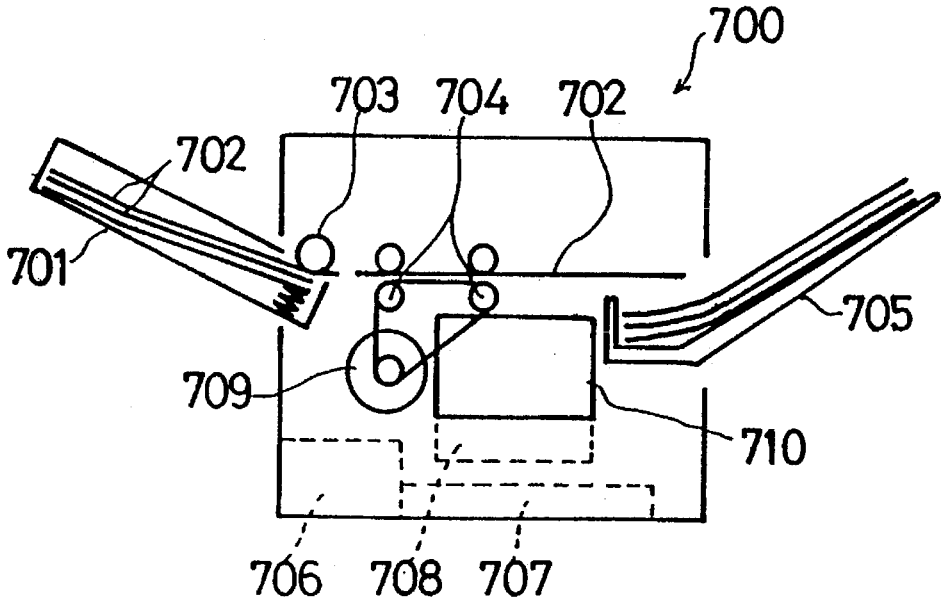
FIG. 21 is an illustration of an ultrasonic printer according to another embodiment of the present invention.

FIG. 21 is an illustration of an ultrasonic printer according to another embodiment of the present invention.

In FIG. 21, an ultrasonic printer 700 has a hopper 701 for accommodating recording sheets 702. The recording sheets 702 are transferred one by one by a pickup roller 703 from the hopper 701 into the inside of the printer apparatus. The recording sheet 702, which has been transferred into the apparatus, is conveyed by a sheet feed roller 704 driven by a sheet feed motor 709 to the upper position of a recording head 710. When the recording sheet 702 is carried at a desired position, the recording head 710 ejects ink droplets toward the recording sheet 702, so that printing is implemented on the recording sheet 702. The recording sheet 702, which is subjected to printing, are further conveyed and finally stacked.

The ultrasonic printer 700 further comprises a power source 706, a main board 707 for receiving and transmitting ultrasonic waves or the like, drive circuit 708 and the like.

Figure 22:
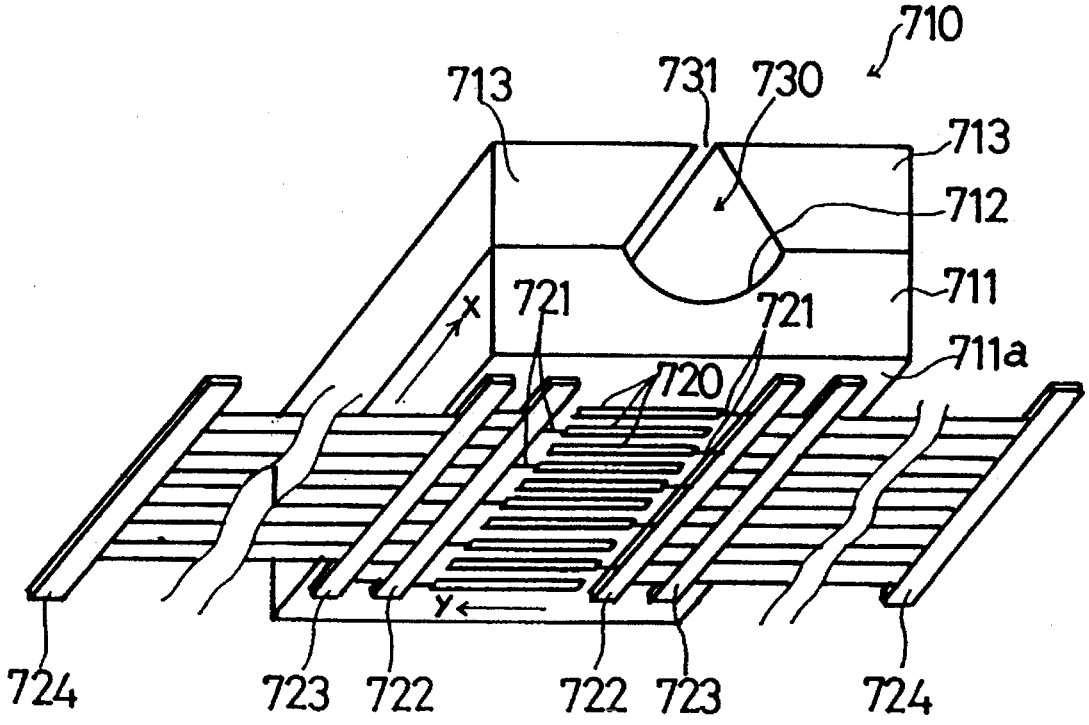
FIG. 22 is an enlarged perspective view of a recording head.

FIG. 22 is an enlarged perspective view of the recording head. This view is depicted looking the recording head 710 sideways at the bottom.

A multiple ultrasonic transducers 720 are arranged in a predetermined arrangement direction (direction X shown in FIG. 22) in an array configuration, and deposited on a lower surface 711*a* of an acoustic medium 711. There is formed on the upper surface of the acoustic medium 711 an acoustic cylindrical lens 712 having a semi-cylindrical configuration of recess provided with a curvature with respect to a direction Y perpendicularly intersecting the array direction X. Between members 713 fixed on the acoustic medium 711, there is formed an ink reservoir 730 a bottom of which is formed with the acoustic cylindrical lens 712. The ink reservoir 730 is of a fan-like configuration in section circle. An ink droplet ejecting aperture 731 is formed on the upper surface of the ink reservoir 730. The aperture 731 is shaped as a slit.

From the multiple ultrasonic transducers 720 deposited on the lower surface 711*a* of the acoustic medium 711, every other transducer extended are lead wires 721 which are connected through a multiplexer 722 and an amplifier 723 for use in ultrasonic wave transmission and reception to a connector 724. The connector 724 is connected to the main board 707 shown in FIG. 21.

Figure 23:
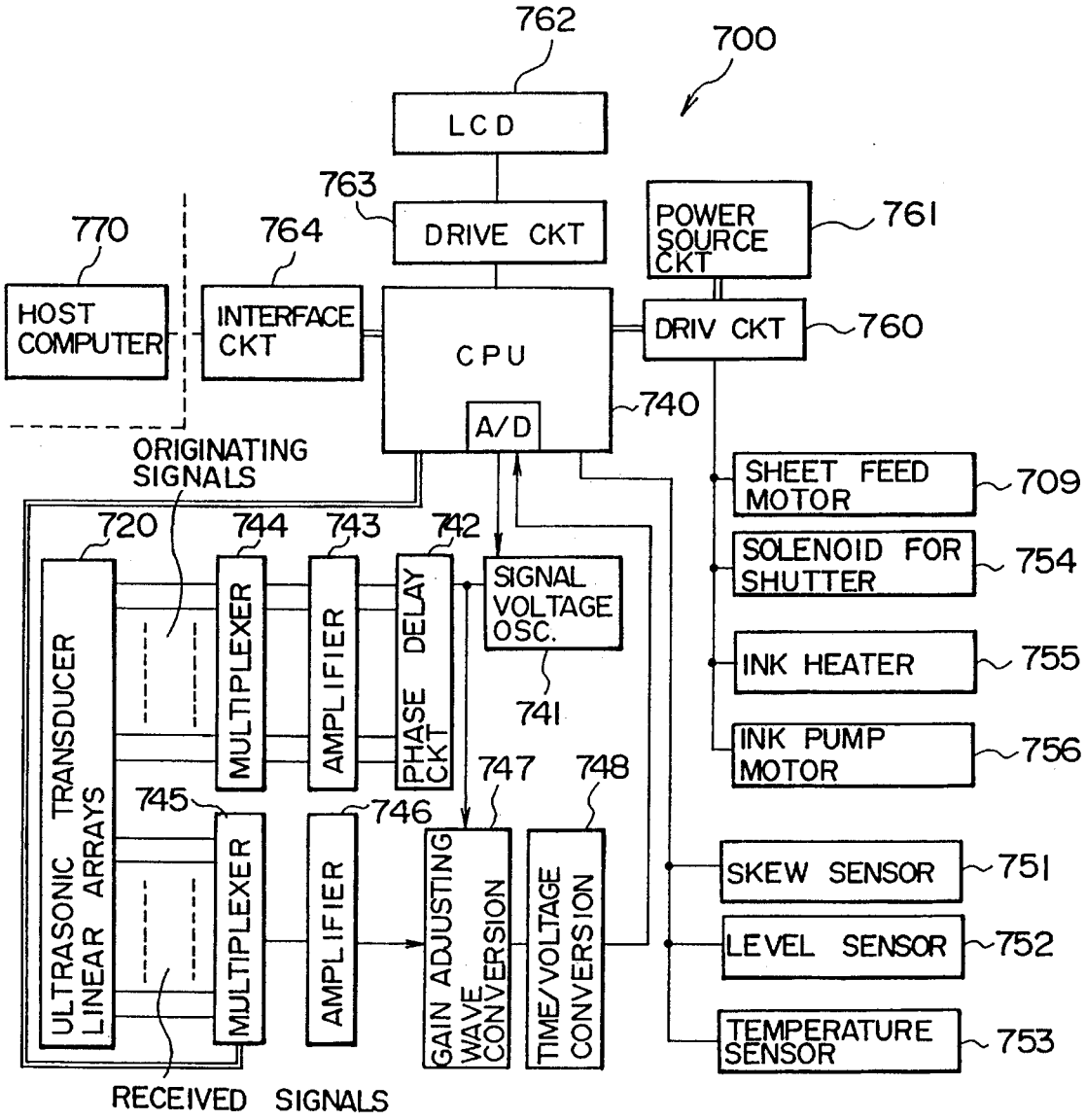
FIG. 23 is a block diagram showing an internal arrangement of the ultrasonic printer shown in FIG. 21.

FIG. 23 is a block diagram showing an internal arrangement of the ultrasonic printer shown in FIG. 21.

In FIG. 23, a signal voltage oscillator 741 adopts a PLL VFO (Phase-Locked-Loop Variable Frequency Oscillator) and constantly oscillates at a specified frequency (about 100 MHz) designated by a CPU 740. This signal passes through a phase delay circuit 742 and is converted to several sorts of signals delayed in phase. The phase advance time from the original oscillation frequency is given by the following equation:

$$t_1 = -(\sqrt{(d^2 + (a \cdot i)^2)} - d)/c$$

where d is a level of inks a is an arrangement pitch of ultrasonic transducers c is a velocity of ultrasonic waves travelling in inks i is integers 0-n (n is a number of ultrasonic transducers simultaneously driven / 2)

The several sorts of signals delayed in phase are amplified by an amplifier 743 and supplied to a multiplexer 744. The multiplexer 744 receives from the CPU 740 data representative of a position at which an ejection of an ink droplet is desired, and applies to the ultrasonic transducer corresponding to the associated position a signal as to the phase advance time $t_0$; to the subsequent ultrasonic transducer a signal as to the phase advance time $t_1$; and to the ith ultrasonic transducer a signal as to the phase advance time $t_i$. The ultrasonic transducers excited by those signals generate acoustic vibrations which propagate through the acoustic medium 711 to inks. While these vibrations completely serve as parallel waves with respect to a sheet feed direction (direction Y), they are refracted owing to the shape of the cylindrical acoustic lens 12 on the upper surface of the acoustic medium 711 and concentrated on a liquid surface of inks. With respect to a direction (direction X) perpendicularly intersecting the sheet feed direction, the phase advances with vibration at the position located farther apart from the position at which an ejection of an ink droplet is desired. Thus, the peripheral advanced phase of vibrations in the same phase arrive at the liquid surface of the inks the moment the vibration just below the position at which an ejection of an ink droplet is desired arrives at the liquid surface of the inks, so that these vibrations are converged on the liquid surface of inks. In this manner, those vibrations are converged on a two dimensional basis with respect to both the sheet feed direction (direction Y) and the perpendicular direction (direction X), so that a focal point is formed. On the focal point, the ultrasonic waves are converged in the same phase with higher energy density, thus the liquid surface of inks raises at the focal point, and finally an ink droplet is ejected from the liquid surface of inks toward a recording sheet, whereby a printing is implemented.

Connected to the ultrasonic transducers 720 constituting the ultrasonic printer 700 is a multiplexer 745 to which an amplifier 746 for amplifying received signals from the ultrasonic transducers 720 is connected. At receiving, the multiplexer 745 selects received signal for an arbitrary ultrasonic transducer in accordance with an instruction from the CPU 740 and sends out the selected signal to the amplifier 746. A received signal of the ultrasonic transducer is given in the form of a superposition of an originating signal by the amplifier 743 at originating side and a received signal by reflected waves at the liquid surface. This signal is separated by a gain adjustment and waveform conversion circuit 747 to the originating signal and the received signal, and then converted to a signal including only the received signal. A time difference Δt between the originating signal and the received signal is by the following equation:

$$\Delta t = 2d/c$$

where d is a liquid level of ink c is a velocity of ink

From the above equation, the liquid level of ink d is expressed by $d = \Delta t \cdot c/2$. Thus, it is possible to attain the liquid level of ink. A time-to-voltage conversion circuit 748 converts the time difference Δt to a voltage, and the CPU 740 receives the same.

Figure 24:
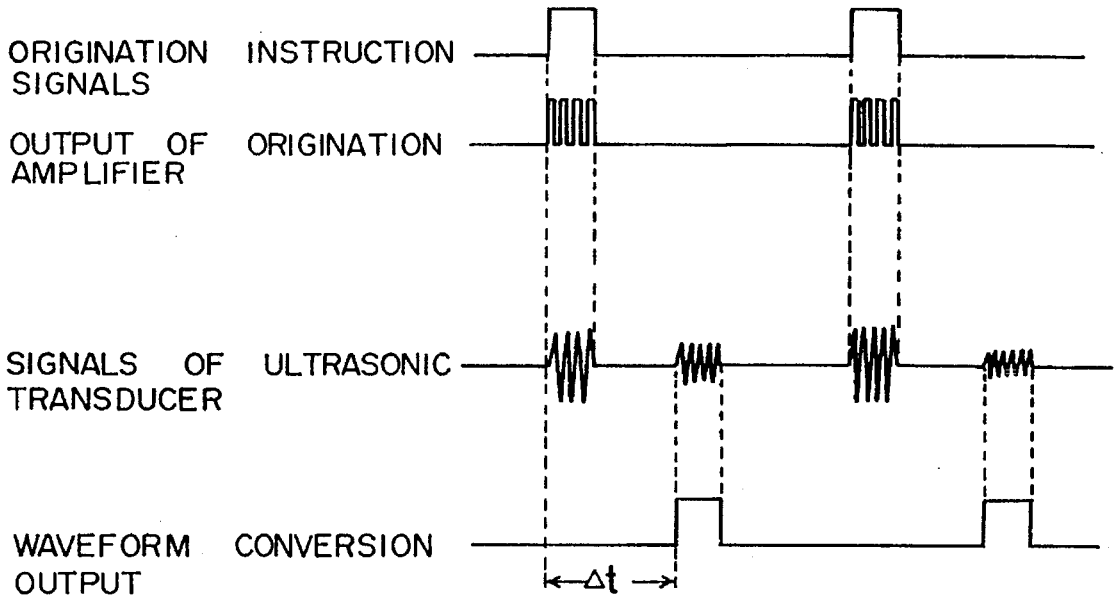
FIG. 24 is an explanatory view for signals to attain a liquid level.

FIG. 24 is an explanatory view for signals to attain a liquid level.

The signals shown in FIG. 24 are in turn an originating instruction signal, an output of originating amplifier 743, a signal of an ultrasonic transducer 720, and a waveform conversion output. From these signals, it is possible to attain the time difference Δt.

Returning to FIG. 23, the explanation will be continued.

The ultrasonic printer 700 further comprises a skew sensor 751 for detecting a skew of the ultrasonic printer 700, a level sensor for detecting a liquid level of inks of the inside of an ink reservoir 730 (FIG. 22) and liquid temperature sensor 753 for detecting a liquid temperature of inks of the inside of an ink reservoir 730. These sensors are monitored by the CPU 740.

The ultrasonic printer 700 still further comprises a sheet feed motor 709 (see FIG. 21) for feeding recording sheets, a shutter driving solenoid 754 for driving a shutter which will be described later, an ink heater 755, and an ink pump motor 756. These are driven, with an electric power from a power source circuit 761, by a drive circuit 760 according to an instruction of the CPU 740.

The ultrasonic printer 700 still further comprises a liquid crystal display panel 762 adapted for performing a predetermined display by a drive circuit 763 according to an instruction of the CPU 740.

The CPU 740 is connected through an interface circuit 764 to an external host computer 770 from which information to be printed is transmitted to the CPU 740. Upon receipt of the information, the CPU 740 controls the ultrasonic transducers and the like to perform a predetermined printing on a recording sheet.

Figure 25:
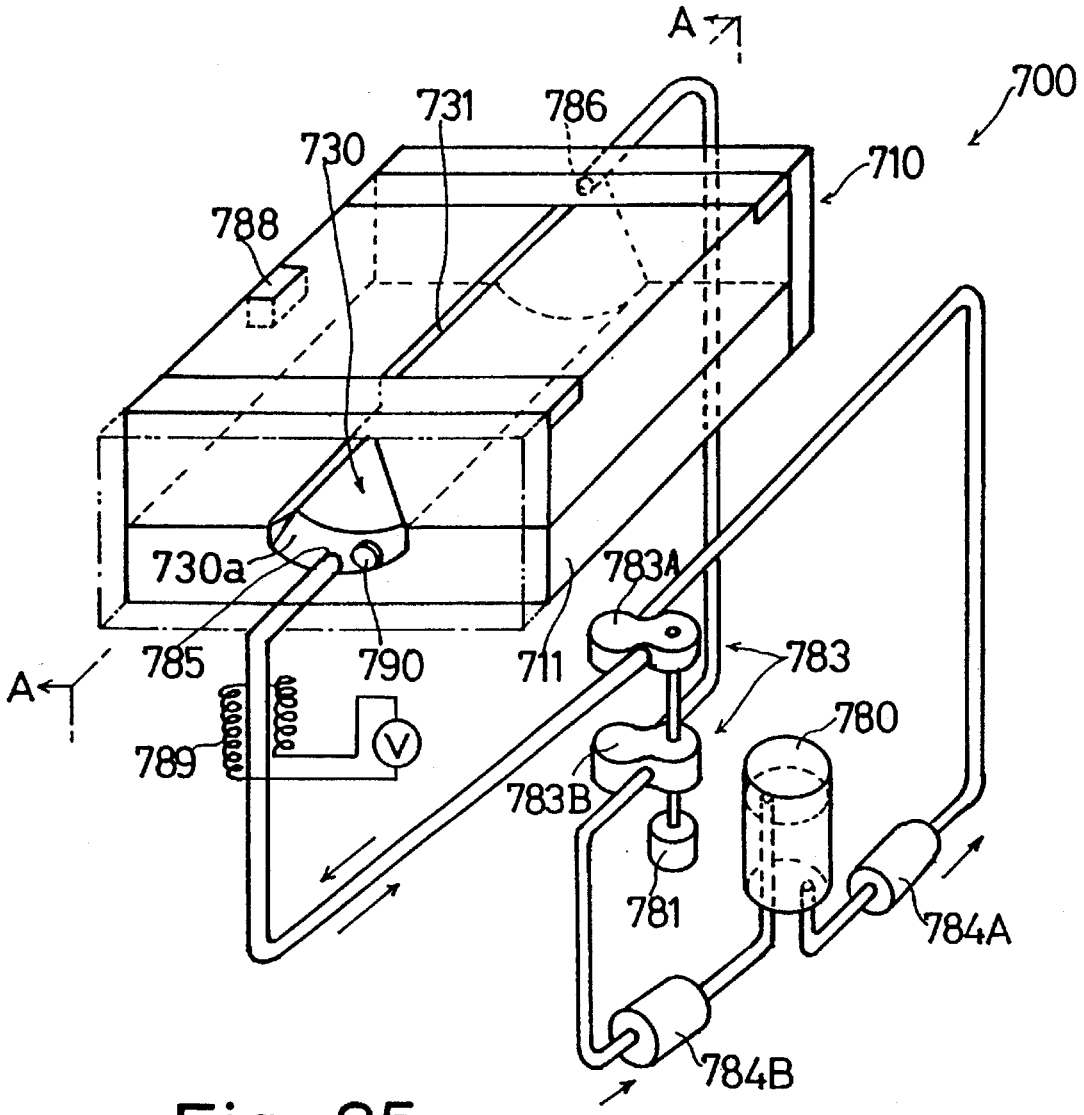
FIG. 25 is an illustration of an example of an ink supplying mechanism of the ultrasonic printer shown in FIG. 21.
Figure 26:
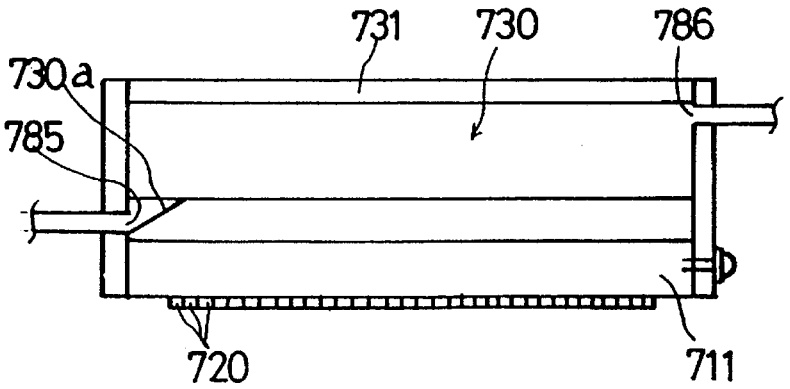
FIG. 26 shows a view taken along the line A—A of FIG. 25.

FIG. 25 is an illustration of an example of an ink supplying mechanism of the ultrasonic printer shown in FIG. 21, and FIG. 26 shows a view taken along the line A—A of FIG. 25.

Before the power source on the printer 700 is turned, inks are in a reservoir tank 780. When the power source is turned, a pump motor 781 rotates, so that a pump 783 ejects the inks. In this embodiment, while the pump 783 uses a gear type of pump by way of example, it is acceptable to adopt any other type of pumps such as a blade pump, a piston pump, etc. The inks in the inside of the reservoir tank 780 are drawn through a filter 784A into a pump 783A, and then exhausted from an ink supply inlet and ink draw outlet 785. When the ink reservoir 730 filled with inks, the ink reservoir 730 overflows an overflow suction outlet 786. The overflowed inks are drawn by a pump 783B and discharged through a filter 784B to the reservoir tank 780. In this manner, by means of calculating inks through filters 784A and 784B, it is possible to filter extraneous materials such as paper particles, etc., even if those foreign objects are mixed into the inks, and in addition to maintain a liquid level constant at the highness of the overflow suction outlet 786.

A skew sensor 788 is incorporated into the recording head 710, so that a skew of the printer body including the recording head 710 can be detected. As the skew sensor 788, it is possible to use the conventional skew sensors, for example, a potentiometer type of skew sensor having such a structure that a pendulum is mounted on a sliding shaft of a potentiometer, and a torque balance type of skew sensor having such a structure that a current flowing through a bridge circuit is detected in accordance with a pendular angle of a pendulum.

In a case where inks are pumped from the reservoir tank 780 into the ink reservoir 730, prior to the pumping up, a skew check is performed. As a result, if the printer apparatus is skewed over a predetermined skew extent, the liquid crystal panel indicates such an alarm message that "printer is skewed", or there is transmitted a signal to inform the host computer of such an information through the interface to the host computer. Thus, it is inhibited, until the skew is regulated, that inks are pumped. During the printing operation, the skew check is carried out at intervals of 20 msec. If the skew is detected, the printing operation is interrupted, and the liquid crystal panel indicates such an alarm message that "printer is skewed", or there is transmitted the signal to inform the host computer of such an information through the interface to the host computer. When inks are withdrawn from the ink reservoir 730, the motor 781 is reversely rotated so that the inks in the ink reservoir 730 are discharged from the ink supply inlet and ink draw outlet 785. To ensure a reliable ink discharge, there is provided a slant section 730*a* near the ink supply inlet and ink draw outlet 785 on the ink reservoir 730. The slant section 730*a* serves to immediately return inks to the reservoir tank 780, thereby preventing the inks from being overflowed inside the printer.

On an ink supply path, there are disposed an ink heater 789 near the ink supply inlet and ink draw outlet 785, and a liquid temperature sensor 790 behind the heater 789. The ink heater 789 heats the inks to be supplied to the ink reservoir 730 to a desired temperature. There is formed a feedback loop to regulate the heating with the ink heater 789 so as to keep the liquid temperature of inks constant at a suitable value by the liquid temperature sensor 790. If the liquid temperature is varied, it will be a cause of varying the viscosity of inks. As a result, it is difficult to drive the ultrasonic transducers under the stable optimum condition. In view of the foregoing, there is need to provide the temperature regulation.

Figure 27:
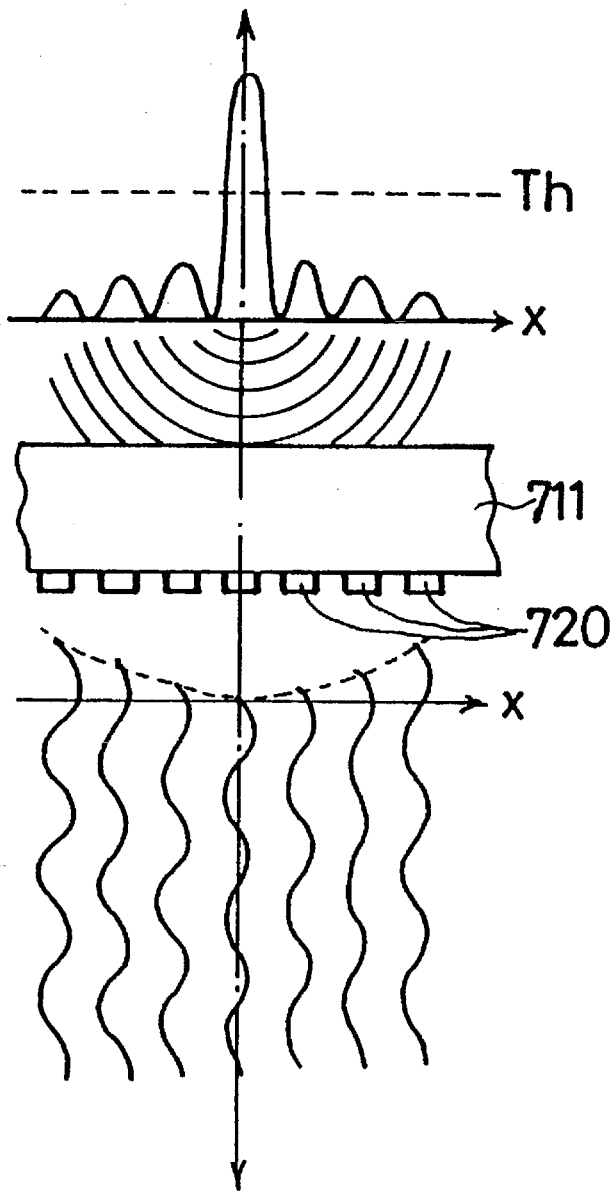
FIG. 27 is an illustration showing a state in which the phase regulation is performed in such a manner that in the regular printing, ultrasonic acoustic waves are concentrated on a surface of inks.
Figure 28:
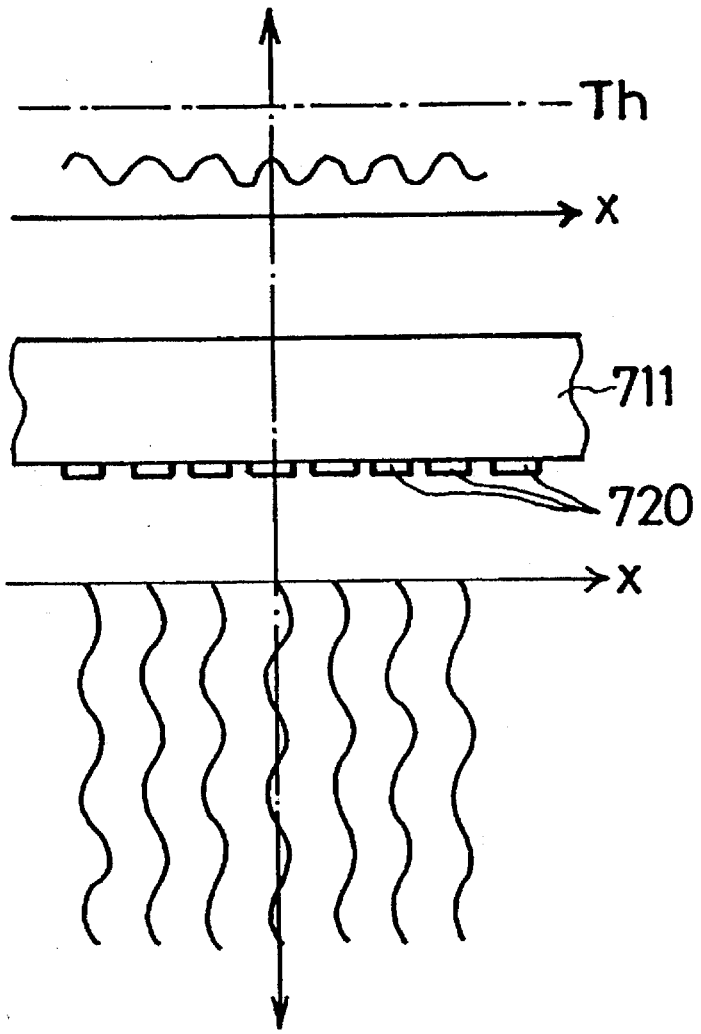
FIG. 28 is an illustration showing a state, at the time of thermal insulation, in which ultrasonic transducers are driven with equalized phases.

FIG. 27 is an illustration showing a state in which the phase regulation is performed in such a manner that in the regular printing, ultrasonic acoustic waves are concentrated on a surface of inks, and FIG. 28 is an illustration showing a state, at the time of thermal insulation, in which ultrasonic transducers are driven with equalized phases.

When the ultrasonic transducers 720 are driven in a phase pattern as shown in FIG. 27, ultrasonic energy will be concentrated on a predetermined point on a liquid surface of inks. Such an energy exceeds a threshold level Th at which an ink droplet is ejected from an ink liquid surface 791. Thus, the ink droplet is emitted from the associated point so that printing is implemented on a recording sheet (not illustrated).

On the other hand, in the heating process, as shown in FIG. 28, the ultrasonic transducers 720 are excited in alignment of phase not so as to form a focal point on any positions on the liquid surface. If the focal point is not formed, an energy density does not exceed the threshold level Th at which an ink droplet is ejected. Thus, printing is not implemented. At that time, a shutter, which will be described later) is closed. The acoustic vibrations applied to the ultrasonic transducers 720 are multi-reflected between the ink liquid surface and an acoustic medium 711 and gradually attenuated. During the attenuation, the acoustic vibration energy is transferred finally to a thermal energy which serves to heat inks. Thus, it is possible to use the ultrasonic transducers 720 as thermal insulating and heating means.

Figure 29:
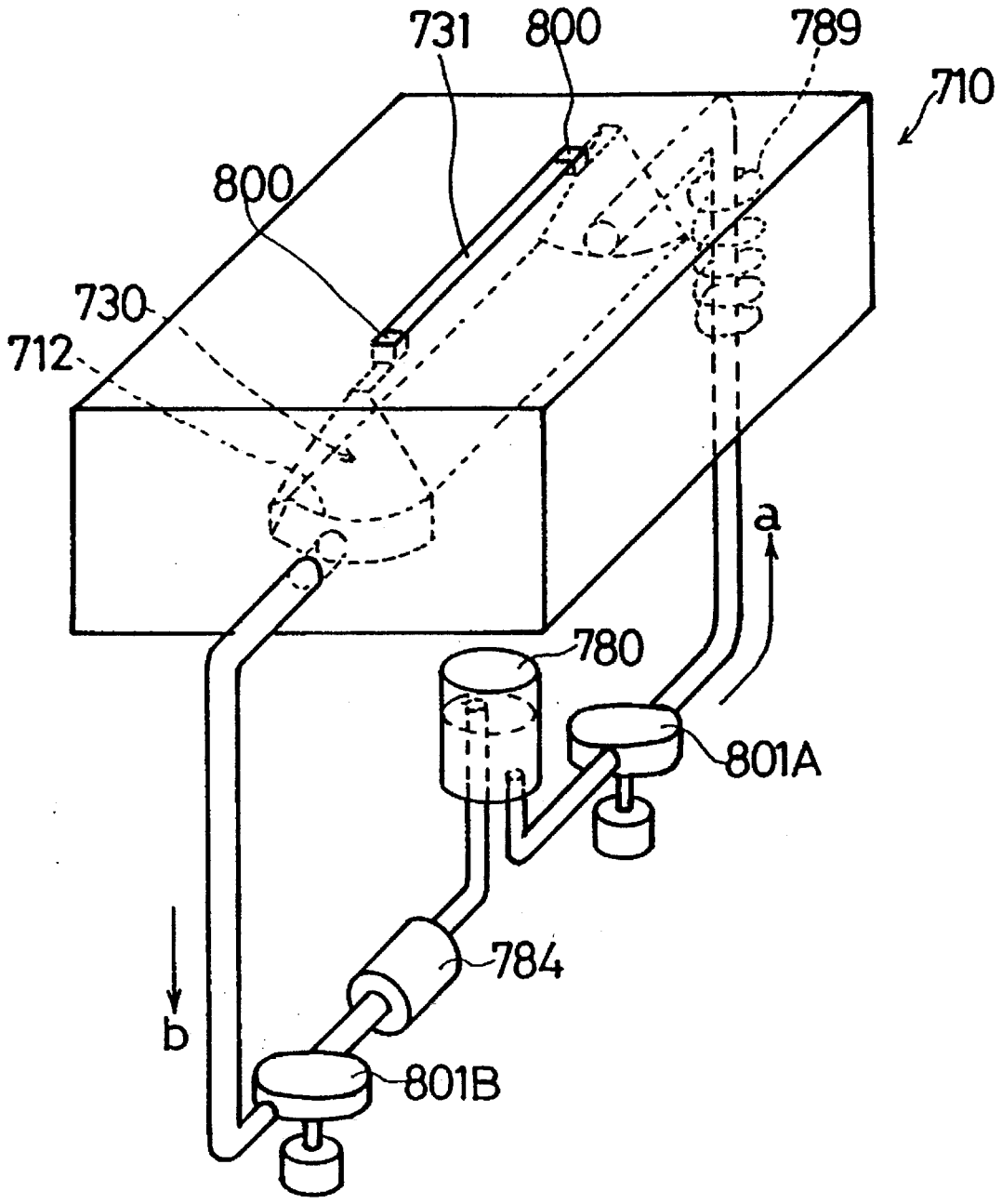
FIG. 29 is an illustration of another example of an ink supplying mechanism of the ultrasonic printer shown in FIG. 21.

FIG. 29 is an illustration of another example of an ink supplying mechanism of the ultrasonic printer shown in FIG. 21.

Ink level sensors 800 are mounted at the level of a focal point of an acoustic lens 712. When inks are supplied to the ink reservoir 730 of the recording head 710, a pump 801A is rotated so that inks move toward the arrow a shown in FIG. 29. In response to actuation of the pump 801A, the inks in the reservoir tank 780 are discharged into the ink reservoir 730. When the ink reservoir 730 fills with inks, the ink level sensors 800 detect the rising of the liquid surface and energizes a pump 801B. With respect to an amount of discharged inks of the pump 801B, there is formed a feedback loop in such a manner that an ink level is stably maintained at a focal point of the acoustic lens 712 according to an output of the ink level sensors 800.

As seen from the figure, there are provided two pieces of ink level sensors 800 at both ends, right and left. Thus, it is possible to observe a skew of the recording head 710 by means of calculating a difference between both ink level sensors 800. If the recording head 710 is inclined, it will be a cause of the deviation of the ink level from the highness of the focal point of the acoustic lens 712. This results in a blooming on the focal point on the liquid surface. Thus, it happens that a desired emission of inks can not be performed, and in addition it is feared that inks will be leaked from the slit 731 for discharging inks. Consequently, if it is sensed that the recording head 710 is inclined, immediately printing is stopped and the pump 801A is stopped, and inks are discharged by the pump 801B in the arrow b direction. To measure a skew of the recording head 710, it is acceptable to provide a skew sensor capable of a skew of the recording head 710 itself independently of the ink level sensor.

As shown in FIG. 29, in a case where it is so arranged that the ink level sensors 800 for measuring the level of the liquid surface of inks are mounted so as to maintain the liquid surface of inks constant, it is possible to measure parameters other than the above-mentioned level of the liquid surface of inks by means of receiving the ultrasonic waves which are originated from the ultrasonic transducers and reflected from the liquid surface of inks.

As one example, voltages of the originating signal and the received signal are compared with each other so that an attenuation factor of ultrasonic waves travelling in inks can be attained. To attain the attenuation factor, a voltage of the received signal is measured under an level of the liquid surface of inks, a liquid temperature and an ink viscosity which have been exactly measured prior to providing the printer apparatus as a system. The voltage of the received signal is amplified suitably, and A/D converted. The converted value (referred to as nominal attenuation value, hereinafter) is stored in a ROM. In measurement during the operation of the printer, the received signal is amplified suitably and A/D converted, and the A/D converted value is compared with the value stored in the ROM. When printed, energy supplied to the recording head is controlled in accordance with a ratio of attenuation, that is, a ratio of a nominal attenuation factor and a measured attenuation factor. As a method of controlling the energy, there are two ways: (a) a burst time of the burst wave is elongated; and (b) an amplification of the amplifier is increased. By the way, in case of a large attenuation factor, it happens that energy to be supplied exceeds a tolerance of the drive circuit, and thus ink droplets are not ejected in a desired timing. This results in, in printing, blank areas caused by poor dot-ejection. In such a case, as a cause, it is considered that the viscosity of the inks is increased, or dry inks are deposited on a periphery of the portion of the ink ejecting slit. Therefore, in this case, inks are temporarily withdrawn in its entirety from the ink reservoir, and new inks are supplied from the reservoir tank. While this operation is carried out, the printing operation is impossible. Consequently, the liquid crystal display (LCD) of the control panel indicates that "now in interchanging inks", or if the control panel is of a LED (Light Emitting Diode) type, the LED involved in the item "now in interchanging inks" is turned on. Further, during such a period of time, it is impossible to receive print data, and then control code representative of such information is transmitted to the host computer. In case that even if the inks are interchanged, the attenuation factor is not recovered, it is considered that ink itself in the reservoir tank is deteriorated. Accordingly, it is indicated on the control panel that "exchange ink in reservoir", or this information is transmitted through the interface to the host computer.

Figures 30A, 30B, 30C:
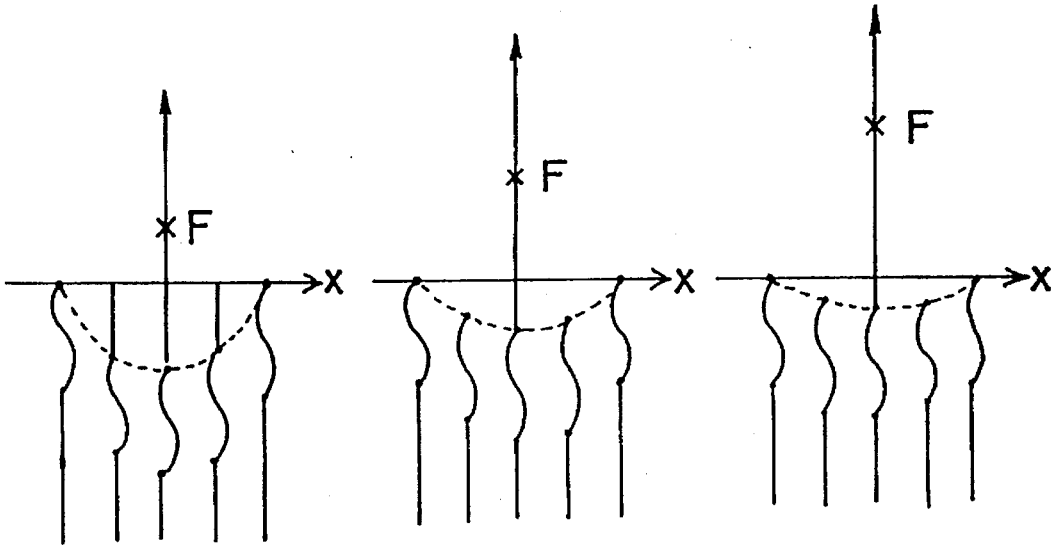
FIG. 30A is an illustration showing a corresponding relation between a phase pattern and a focal point.
FIG. 30B is an illustration showing a corresponding relation between a phase pattern and a focal point.
FIG. 30C is an illustration showing a corresponding relation between a phase pattern and a focal point.
Figure 31:
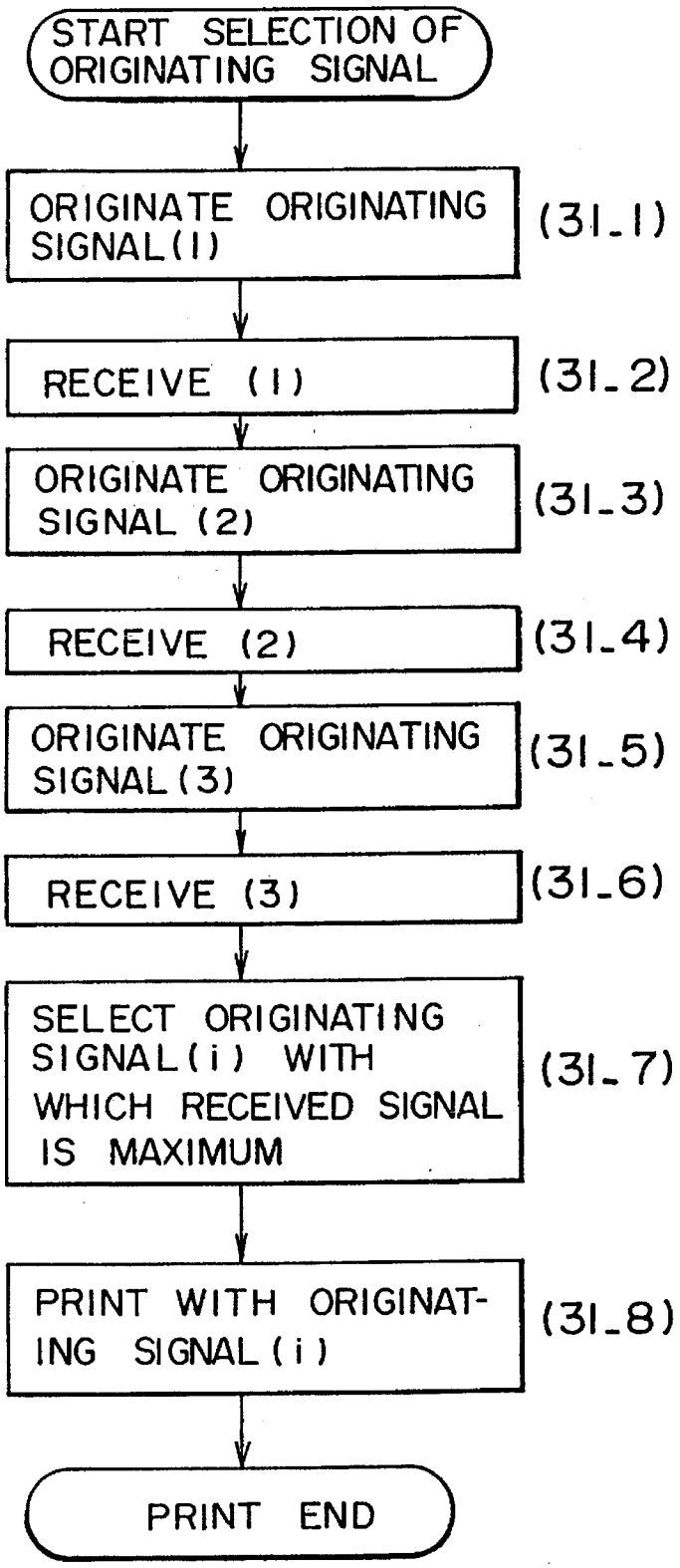
FIG. 31 is a flowchart of a sequence for selecting the most efficient originating signal.

FIGS. 30A–30C each are an illustration showing a corresponding relation between a phase pattern and a focal point. FIG. 31 is a flowchart of a sequence for selecting the most efficient originating signal.

Upon receipt of print data, prior to printing, the printer sets up mutually different focal points several ways. First, originating signals are applied to the associated ultrasonic transducers, respectively, in the form of pulse by one, in such a manner that alignment of phases can be attained on the first focal point (FIG. 30A, and step 31_1 in FIG. 31). The ultrasonic transducer just below the focal point F, as receiving element, receives reflected waves from the liquid surface and amplifies (step 31_2 in FIG. 31). And the maximum value of amplitude of the received signal is recorded. Likewise, originating signals are applied, in such a manner that alignment of phases can be attained on the second focal point and third focal point, respectively, obtaining the received signals, and recording the maximum values of amplitude of the received signals (FIGS. 30B and 30C, and steps 31_3–31_6 in FIG. 31). There is selected an originating signal at the originating end, from which a largest amplitude is attained among the respective maximum amplitudes of the respective received signals (step 31_7), and an originating signal is applied with the same pattern as said selected originating signal, so that ink droplets are emitted to perform printing according to the print data (step 31_8). What is meant by the fact that the maximum amplitude is obtained indicates that the maximum reflection is attained at the liquid surface of ink, in other words, the supplied energy is maximum at the liquid surface of ink, and it is most efficient.

Figure 32:
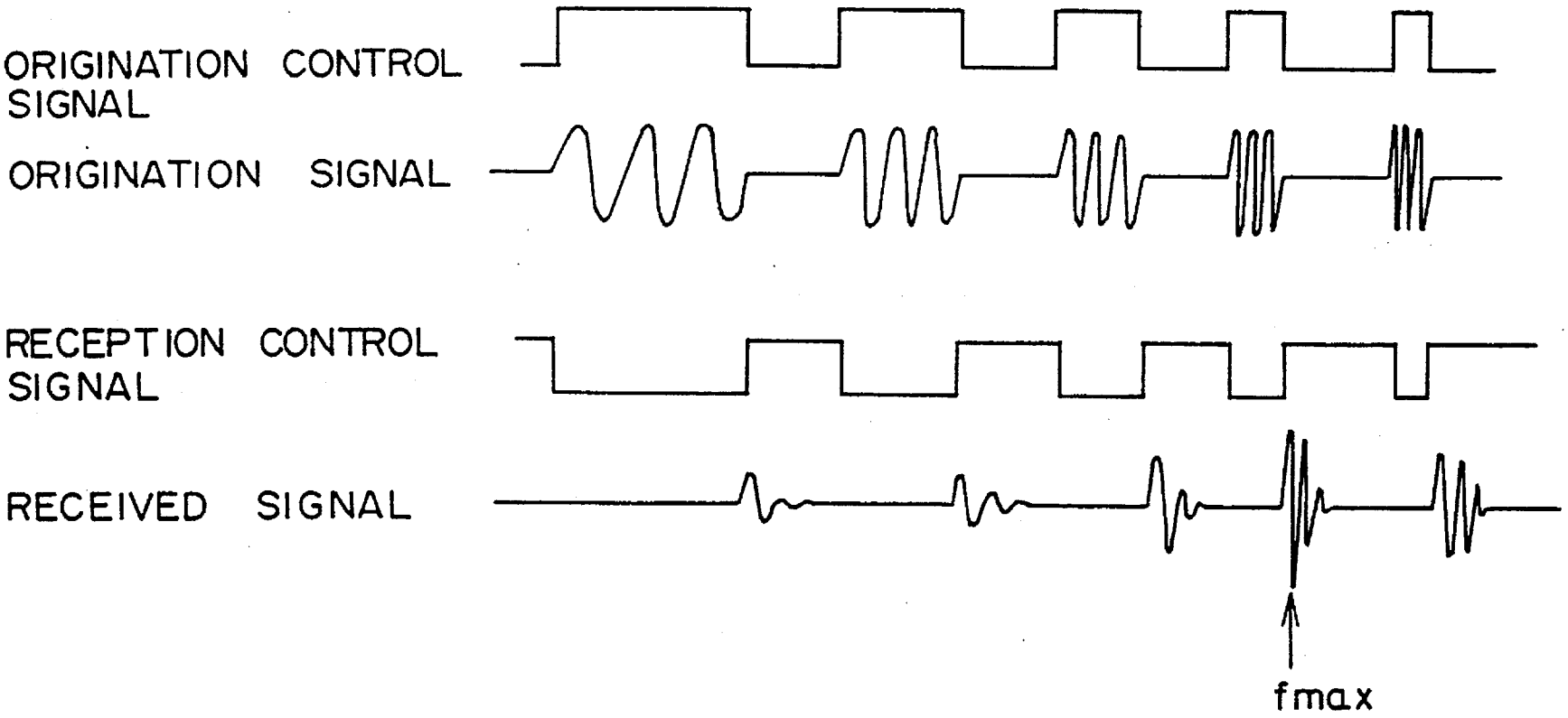
FIG. 32 is an illustration of an embodiment in which the most efficient originating frequency is selected.

FIG. 32 is an illustration of an embodiment in which the most efficient originating frequency is selected. The signals shown in FIG. 32 are in turn an originating control signal, an originating signal, a receiving control signal and received signal.

An ultrasonic transducer is driven with a several way of frequencies. Reflection waves are received immediately after application of drive voltage. There is selected a largest frequency $f_{max}$ with which the maximum amplitude appears. Thereafter, this frequency of drive signal is applied to the ultrasonic transducer.

Figure 33A:
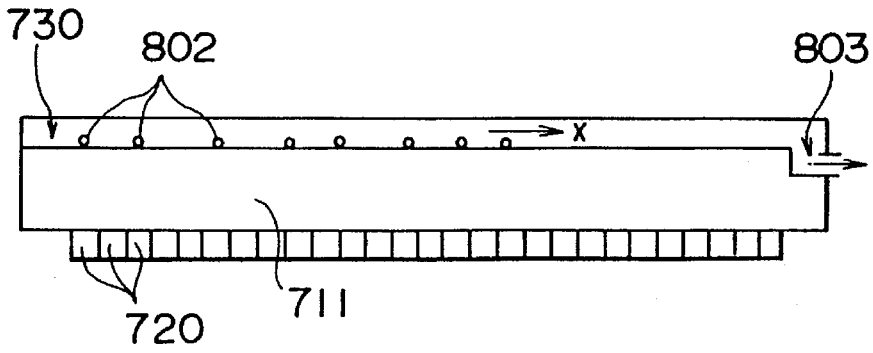
FIG. 33A is an illustration of an example in which progressive waves are applied to the ultrasonic transducers, so that ink droplets in an ink reservoir are moved to an exhaust port.
Figure 33B:
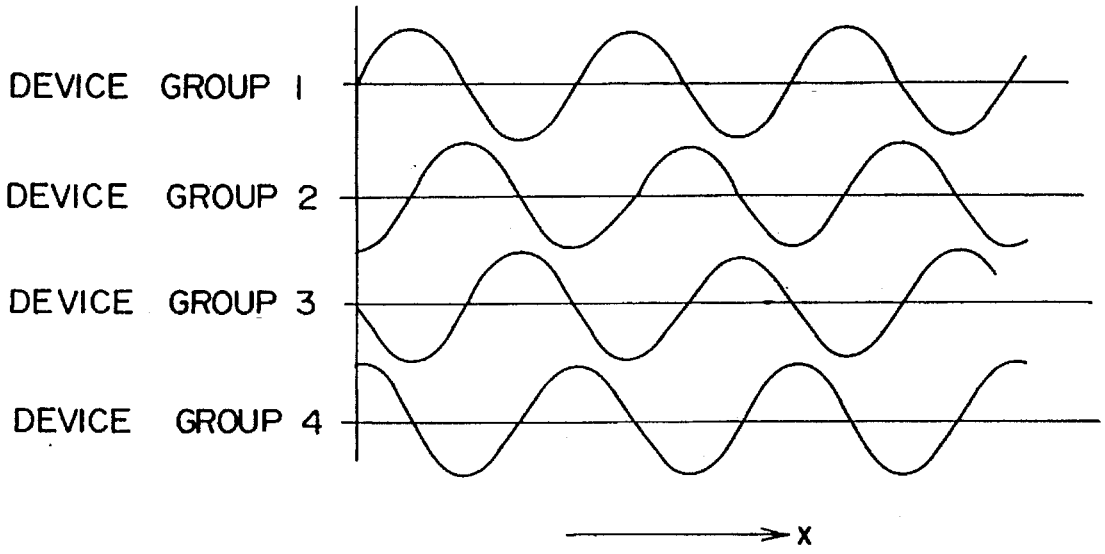
FIG. 33B is an illustration of an example in which progressive waves are applied to the ultrasonic transducers, so that ink droplets in an ink reservoir are moved to an exhaust port.

FIGS. 33A and 33B each are an illustration of an example in which progressive waves are applied to the ultrasonic transducers, so that ink droplets in an ink reservoir are moved to an exhaust port.

In FIG. 33A, a linear array of ultrasonic transducers is placed in a group. Each group comprises four adjacent ultrasonic transducers. Applied to group 1 is an AC signal involved in a wavelength$\lambda$, and to group 2 is an AC signal which is shifted in phase by a wavelength $\lambda\times 1/4$. Further, applied to groups 3 and 4 are AC signals which are shifted in phase by wavelength $\lambda\times 2/4$ and wavelength $\lambda\times 3/4$, respectively. Thus, the ultrasonic acoustic vibration is transferred in the form of a progressive wave to an ink reservoir 730, so that ink droplets 802 travel in a direction of the progressive wave. If the direction of the progressive wave coincides with a direction of an ink discharge outlet or exhaust port 803, the ink droplets 802, which still remain at the bottom of the ink reservoir 730 after inks of the inside of the ink reservoir 730 are discharged, are completely discharged. Thus, the inks of the ink reservoir 730 may be completely withdrawn.

Figure 34:
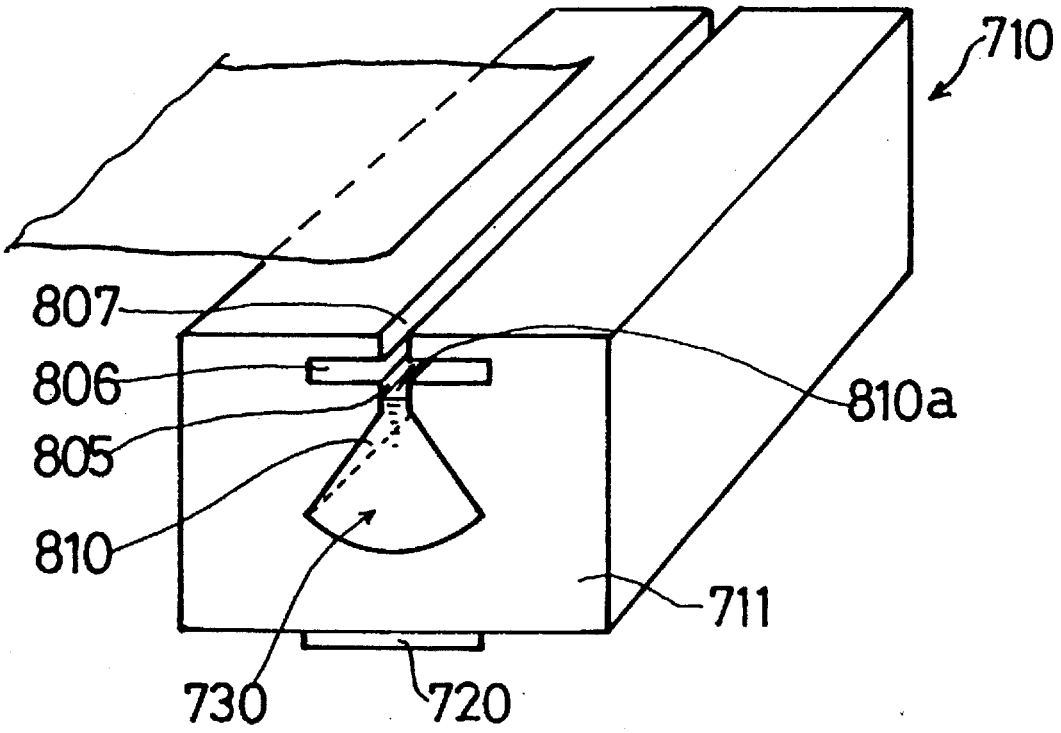
FIG. 34 is a sectional projected plan of a recording head according to another embodiment.

FIG. 34 is a sectional projected plan of a recording head according to another embodiment.

A top of a first slit shaped aperture 805 of the upper portion of the ink reservoir 730 is provided with a cavity 806 of which the top having a second slit shaped aperture 807. A surface 810a of inks 810 in the ink reservoir 730 is controlled so as to locate in the first aperture 805. If the printer body undergoes a shock, the liquid surface **810*a* of the inks will waver, and the inks 810 will overflow the first aperture 805 and enter the cavity 806. In addition, since there is provided the second aperture 807 beyond the cavity 806, there is no possibility that the inks overflow the second aperture 807 so far as much an amount of inks than the volume of the cavity 806** does not overflow. Consequently, even if the printer unexpectedly undergoes in use a shock, for example, such a case that a desk on which the printer is placed is erroneously kicked, it is possible to avoid such a situation that inks overflow and unfavorably deposit on a recording sheet.

Next, there will be explained a technique as to how a size of printing dots or a size of ink droplets are varied.

A particle diameter of ink droplets is determined by an area in which the energy density of ultrasonic waves at a liquid surface of inks exceeds a threshold. Usually, since the liquid surface of inks is adjusted to meet the level of the focal point, the area in which the energy density of ultrasonic waves at a liquid surface of inks exceeds a threshold is smaller with the smallest particle diameter of ink droplets, and at that time the ink droplets having the smallest particle diameter are ejected, so that the highest resolution of printing result can be attained. Meanwhile, in this case, since the time needed for developing print data into a bit map increases in proportion to the square of resolution, the printing speed will slow down. In view of the foregoing, in case that there is desired only an image quality in such an extent that any one is acceptable, as the image quality, which is readable even if not clear, for drafts and the like, it will be required that the printing result is more rapidly output, while the resolution is degraded. Thus, it is considered to contribute to the higher speed printing with the larger particle diameter of ink droplets and compression of the developing time of the bit map.

Figure 35A:
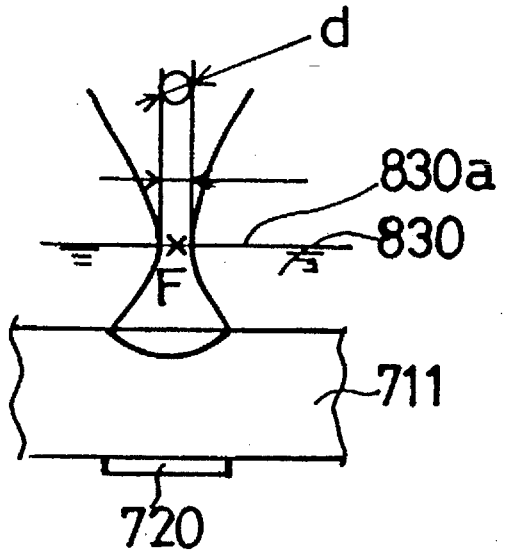
FIG. 35A is an explanatory view of a first embodiment in which a particle diameter of an ink droplet is varied.
Figure 35B:
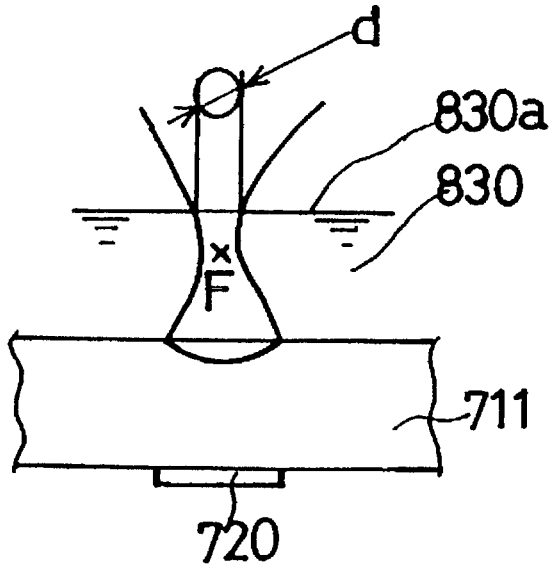
FIG. 35B is an explanatory view of a first embodiment in which a particle diameter of an ink droplet is varied.

FIGS. 35A and 35B each are an explanatory view of a first embodiment in which a particle diameter of an ink droplet is varied.

When a level of a liquid surface 830*a* of inks 830, which is usually adjusted to meet the distance of the focal point as shown in FIG. 35A, is set up to a position higher than the distance of the focal point F as shown FIG. 35B, the diameter d of the ultrasonic acoustic beam is enlarged at the liquid surface 830*a*. As a result, the ink droplet ejected therefrom is of a globular form having a diameter which is the same as the diameter d of the ultrasonic acoustic beam. Thus, it is possible to emit the ink droplet having a larger particle diameter than the nominal particle diameter in case of FIG. 35A.

Figure 36A:
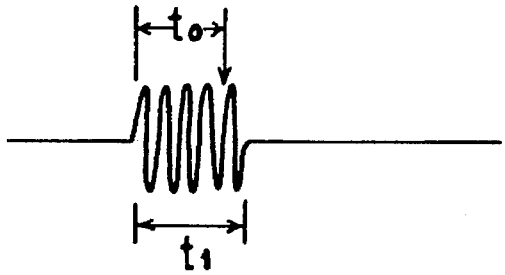
FIG. 36A is an explanatory view of a second embodiment in which a particle diameter of an ink droplet is varied.
Figure 36B:
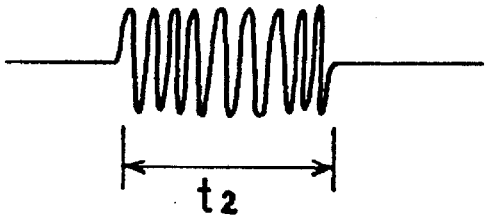
FIG. 36B is an explanatory view of a second embodiment in which a particle diameter of an ink droplet is varied.
Figure 36C:
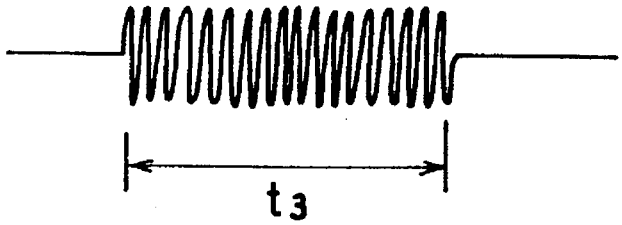
FIG. 36C is an explanatory view of a second embodiment in which a particle diameter of an ink droplet is varied.

FIGS. 36A–36C each are an explanatory view of a second embodiment in which a particle diameter of an ink droplet is varied.

Assuming that a drive burst time required for ejection of a piece of ink droplet is $t_0$, burst signals applied to ultrasonic transducers, including margin corresponding $\alpha$, as shown in FIGS. 36A–36C, are varied as $t_1=t_0+\alpha$, $t_2=2t_0+\alpha$, $t_3=t_0+\alpha$, respectively. As a result, the ink droplets are ejected by one drop, two drops and three drops toward the same point on a recording sheet, respectively. In this manner, the ink droplets deposited on the recording sheet are expanded in accordance with the number of ink droplets. Thus, it is possible to vary the dot diameter on the recording sheet.

Figure 37B:
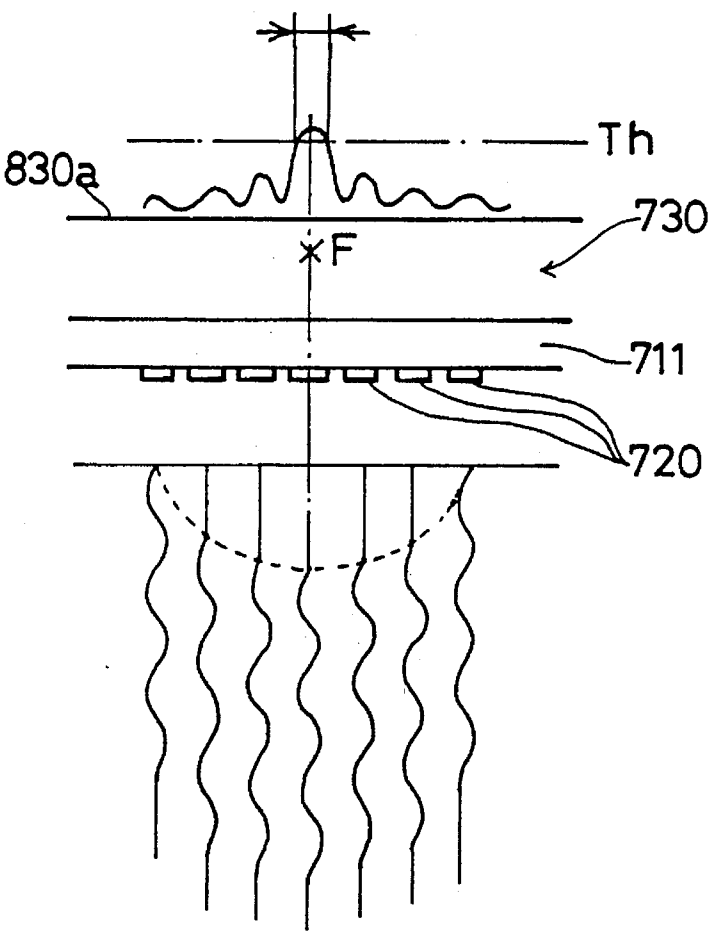
FIG. 37B is an explanatory view of an embodiment in which a particle diameter of an ink droplet is varied in a phased array scheme.
Figure 37A:
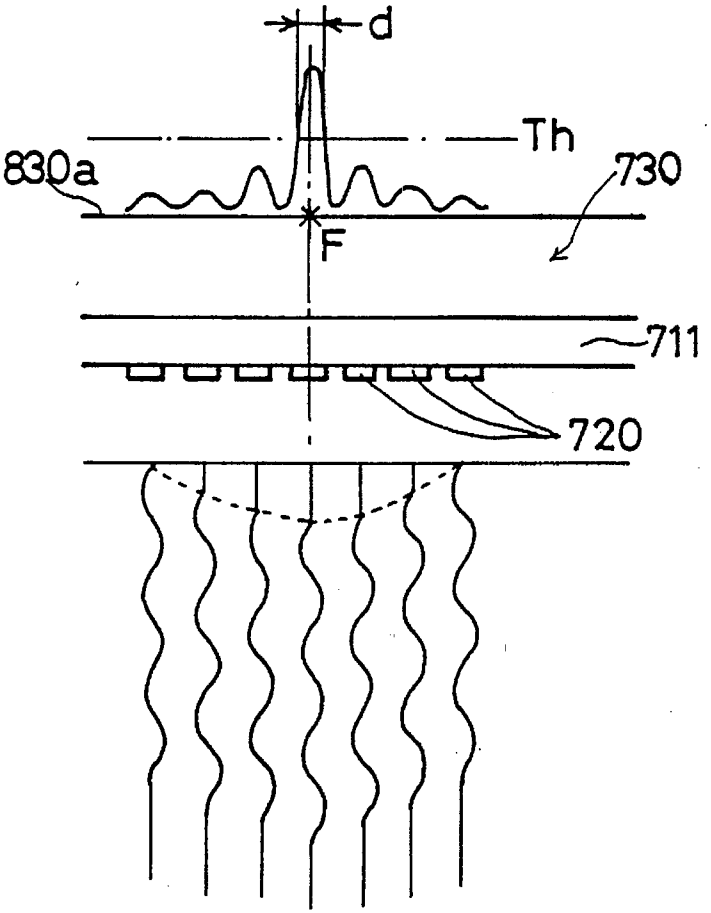
FIG. 37A is an explanatory view of an embodiment in which a particle diameter of an ink droplet is varied in a phased array scheme.

FIGS. 37A and 37B each are an explanatory view of an embodiment in which a particle diameter of an ink droplet is varied in a phased array scheme.

Usually, as shown in FIG. 37A, ultrasonic transducers, which contribute to emission of a piece of ink droplet, are driven in a phase pattern of a timing such that the ultrasonic waves radiated from the above-mentioned ultrasonic transducers arrive at a focal point F, which is set up on a liquid surface 830*a* of inks, with the matched phase. In a case where a particle diameter d of the ink droplet is enlarged, as shown in FIG. 37B, the focal point F is set up below more than the liquid surface 830*a* and the ultrasonic transducers 720 are driven by drive signals with a phase pattern larger than the nominal phase pattern. This results in blooming and lower peak of the energy density. On the other hand, however, there will be increased by the corresponding reduced energy density the width of the energy density which exceeds a threshold level involved in emission of the ink droplet. Thus, it is possible to emit the ink droplet having a larger particle diameter d than the nominal diameter.

Incidentally, in a case where the particle diameter of the ink droplets is expanded in accordance with the schemes or technologies shown in FIG. 35A, FIG. 35B, FIGS. 36A–36C, FIG. 37A and FIG. 37B, since the energy density at the ink ejecting point is reduced by the corresponding expanded beam diameter, the voltage of the drive signal is increased by the corresponding reduced energy density, or the burst time of the drive signal is elongated by the corresponding reduced energy density. According to the above-described embodiments, the focal point is set up below more than the liquid surface of inks, but it should be noticed that the equivalent effect can be expected also when the focal point is set up above more than the liquid surface of inks.

Figure 38:
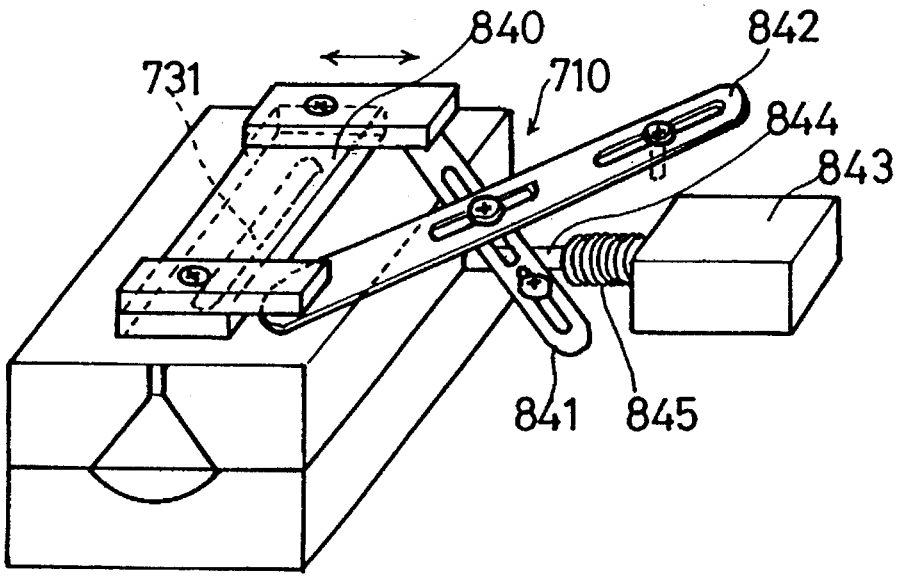
FIG. 38 is a perspective view of a shutter, by way of example, which is adapted to open and close an aperture of an ink reservoir of a recording head.
Figure 39A:
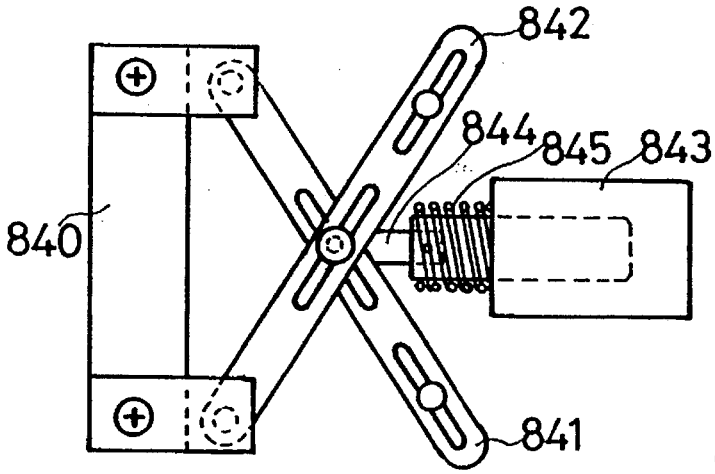
FIG. 39A is a plan view of the shutter shown in FIG. 38.
Figure 39B:
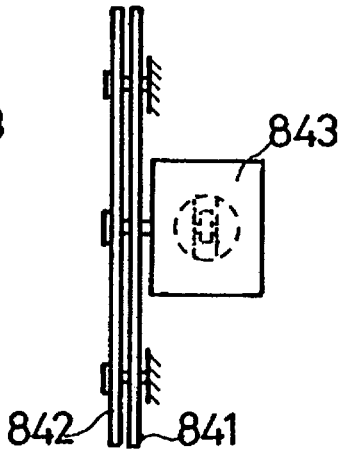
FIG. 39B is a side view of the shutter shown in FIG.38.
Figure 39C:
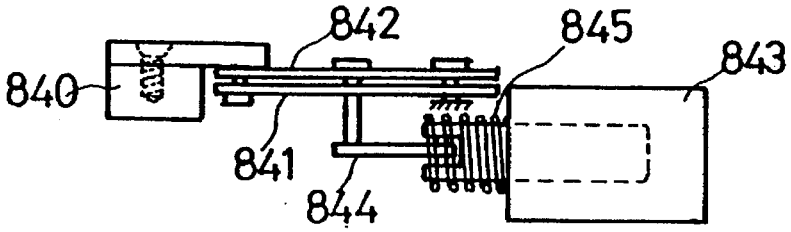
FIG. 39C is an elevational view of the shutter shown in FIG. 38.

FIG. 38 is a perspective view of a shutter, by way of example, which is adapted to open and close an aperture of an ink reservoir of a recording head. FIGS. 39A–39C are a plan view of the shutter shown in FIG. 38, a side view of the shutter shown in FIG.38 and an elevational view of the shutter shown in FIG. 38, respectively.

A recording head 710 is provided with a slit shaped aperture section 731 for discharging inks. Accordingly, there are possibilities such that volatile components of ink evaporate, or when the printer wavers the ink overflow. In view of the foregoing, when the print is not performed, a shutter mounted on the top of the recording head 710 is travelled to close an aperture section 731 of the recording head 710, thereby preventing inks from being evaporated and being overflown.

The shutter 840 is pivotally connected to links 841 and 842. The links 841 and 842 are slidably connected to a plunger 844 of a solenoid 843 fixed on a frame (not illustrated). The solenoid 843 is provided with a compression spring 845. When the solenoid 843 is not excited, the shutter 840 closes the aperture section 731 of the recording head 710 by the spring force of the compression spring 845. When the printing is performed, the solenoid 843 is excited to open the shutter 840.

Figure 40A:
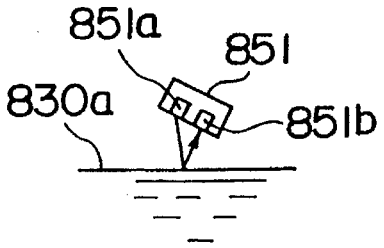
FIG. 40A is a view showing an example of an ink level sensor.
Figure 40B:
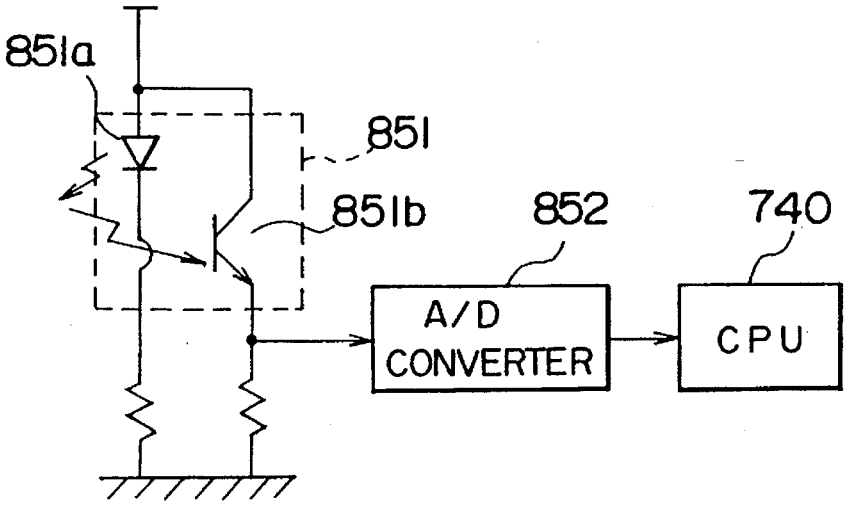
FIG. 40B is a view showing a detecting circuit of the. ink level sensor shown in FIG. 40A.
Figure 40C:
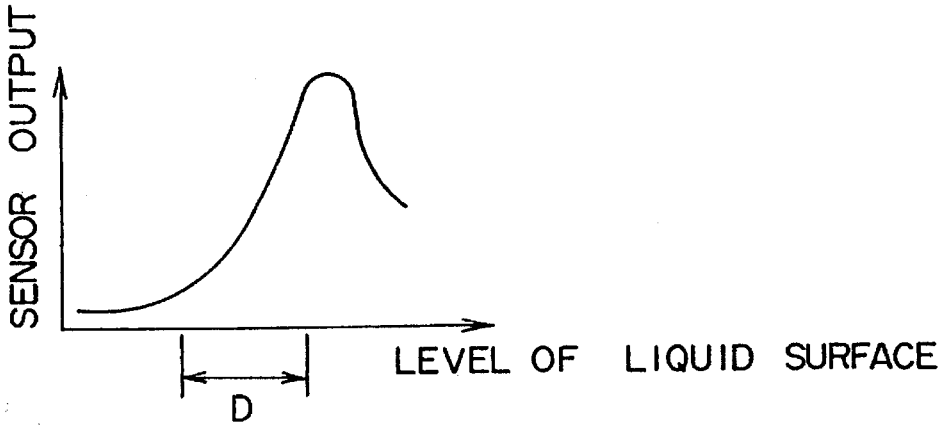
FIG. 40C is a graphical representation showing characteristic of the ink level sensor shown in FIG. 40A.

FIG. 40A is a view showing an example of an ink level sensor, FIG. 40B is a view showing a detecting circuit of the ink level sensor shown in FIG. 40A, and FIG. 40C is a graphical representation showing characteristic of the ink level sensor shown in FIG. 40A.

A reflection photosensor (photoreflector) 851 is disposed toward a liquid surface 830*a* of inks. The reflection photosensor 851 comprises a light emitting element (LED) 851*a* and a light intercepting (phototransister) 851*b*. While it is acceptable to dispose the reflection photosensor 851 in parallel to the liquid surface 830*a* of inks, a larger S/N ratio may be provided when the reflection photosensor 851 is inclined so that the LED 851*a* is farther with respect to the object. An output of the reflection photosensor 851 is, as shown in FIG. 40B, converted by an A/D converter 852 to digital signals and is passed to the CPU (refer FIG. 23). The output is as shown in FIG. 40C, while strictly not straight, the limit D near the straight line is available for sensing. If it is difficult to attain a sufficient reflection, it is acceptable to float a float on the liquid surface of inks.

Figure 41A:
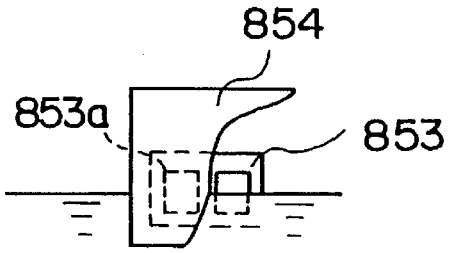
FIG. 41A is a front view of an ink level sensor according to another example.
Figure 41B:
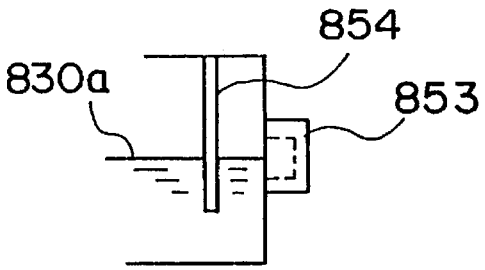
FIG. 41B is a side view of the ink level sensor shown in FIG. 41A.
Figure 41C:
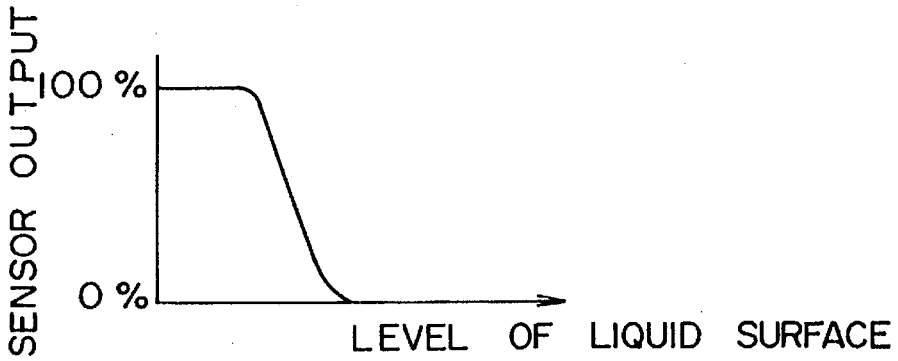
FIG. 41C is a graphical representation showing characteristic of the ink level sensor shown in FIGS. 41A and 41B.

FIGS. 41A–41C are a front view of an ink level sensor according to another example, a side view of the ink level sensor shown in FIG. 41A, and a graphical representation showing characteristic of the ink level sensor shown in FIGS. 41A and 41B, respectively.

A reflection photosensor 853 is disposed, as shown in FIGS. 41A–41B, to face a reflection plate 854. When the liquid surface 830*a* of inks is sufficiently low, light of the light emitting device 853*a* is reflected by the reflection plate 854, so that 100% of output can be obtained as seen from FIG. 41C. When the liquid surface 830*a* of inks rises, ink liquid gradually enters between the sensor 853 and the reflection plate 854, so that an amount of reflections is decreased. When the liquid surface 830*a* of inks completely rises, the output of the sensor 853 is 0%.

Figure 42A:
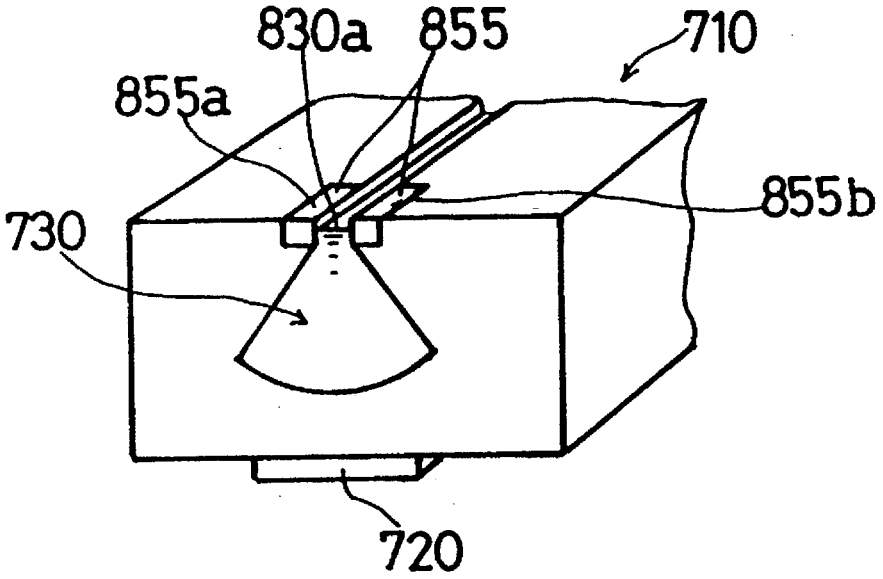
FIG. 42A is a perspective view of an ink level sensor according to still another example.
Figure 42B:
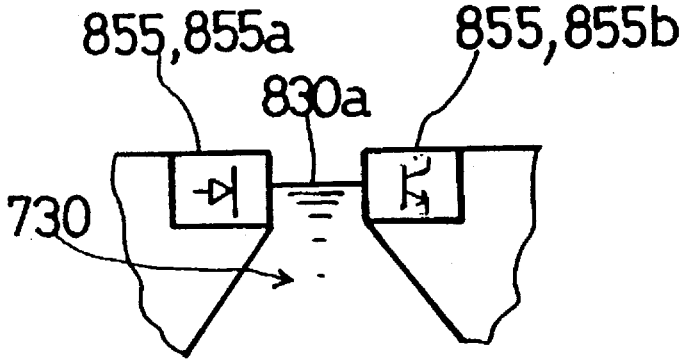
FIG. 42B is a partially enlarged front view of the ink level sensor shown in FIG. 42A.

FIG. 42A is a perspective view of an ink level sensor according to still another example, and FIG. 42B is a partially enlarged front view of the ink level sensor shown in FIG. 42A.

The sensor 855 comprises a light emitting device 855*a* and a light intercepting device 855*b* which are disposed in a face-to-face configuration. The space between the light emitting device 855*a* and the light intercepting device 855*b* is covered with inks. In principle, it is the same as the reflection sensor shown in FIGS. 41A–41C.

Figure 43A:
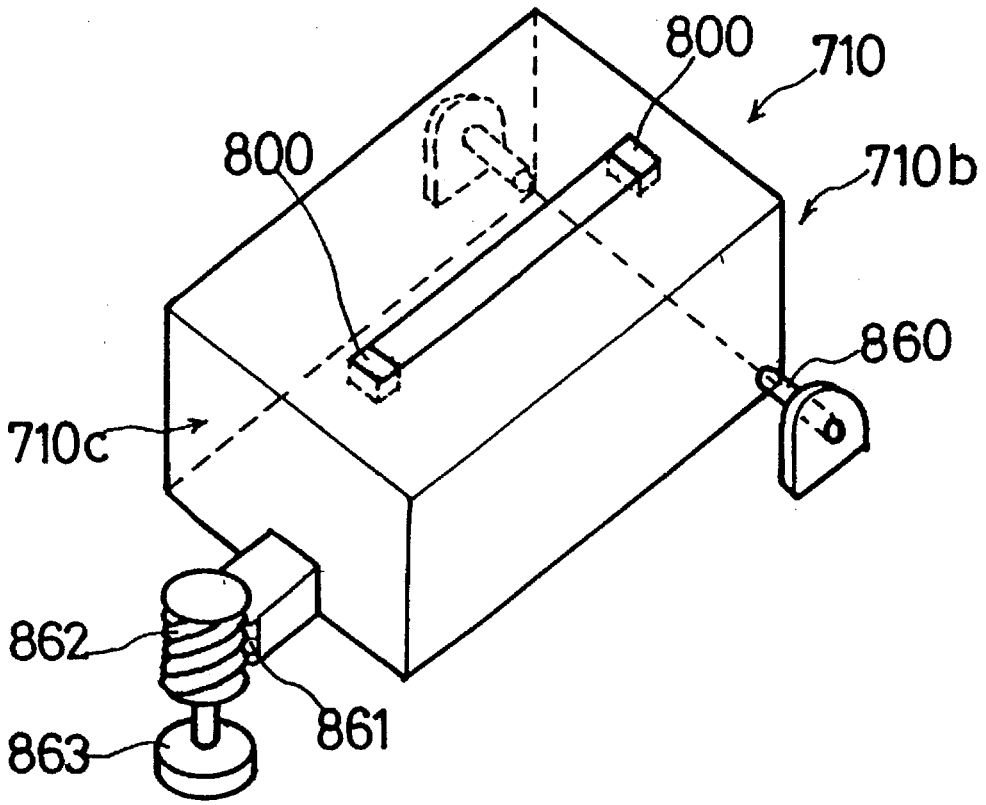
FIG. 43A is a perspective view of a recording head.
Figure 43B:
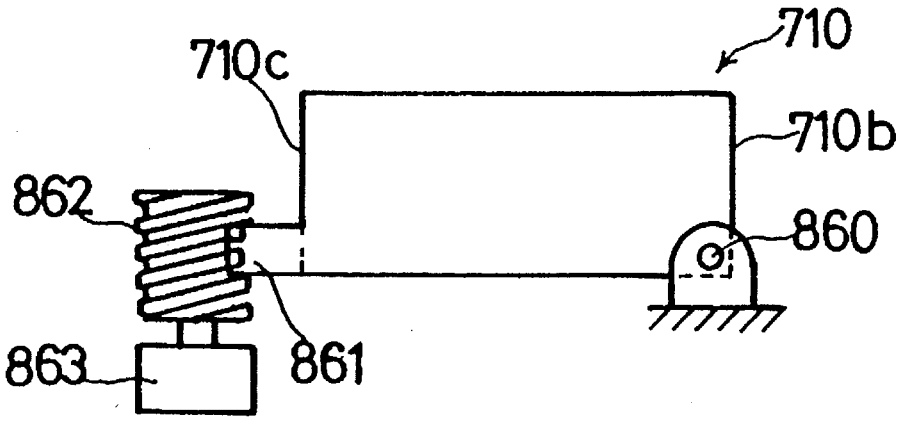
FIG. 43B is a side view of the recording head shown in FIG. 43A.

FIG. 43A is a perspective view of a recording head, and FIG. 43B is a side view of the recording head shown in FIG. 43A.

One end 710*b* of the recording head 710 is pivoted with respect to a shaft 800, and another end 710*c* may move up and down in a vertical line. A partial worm gear 861 is fixed on the end 710*c* movable up and down, the gear 861 being engaged with a worm 862 which is fixed on a shaft of a motor 863. As the motor 863, a stepping motor, a DC motor and the like are available. When a skew of the recording head 710 is detected by two level sensors 800, the shaft of a motor 863 rotates to move the partial worm gear 861 up and down so that the recording head 710 is maintained horizontally. According to the present embodiment, while the worm 862 is used, any one is acceptable as the mechanism which converts a rotary motion into a linear reciprocation.

Figure 44:
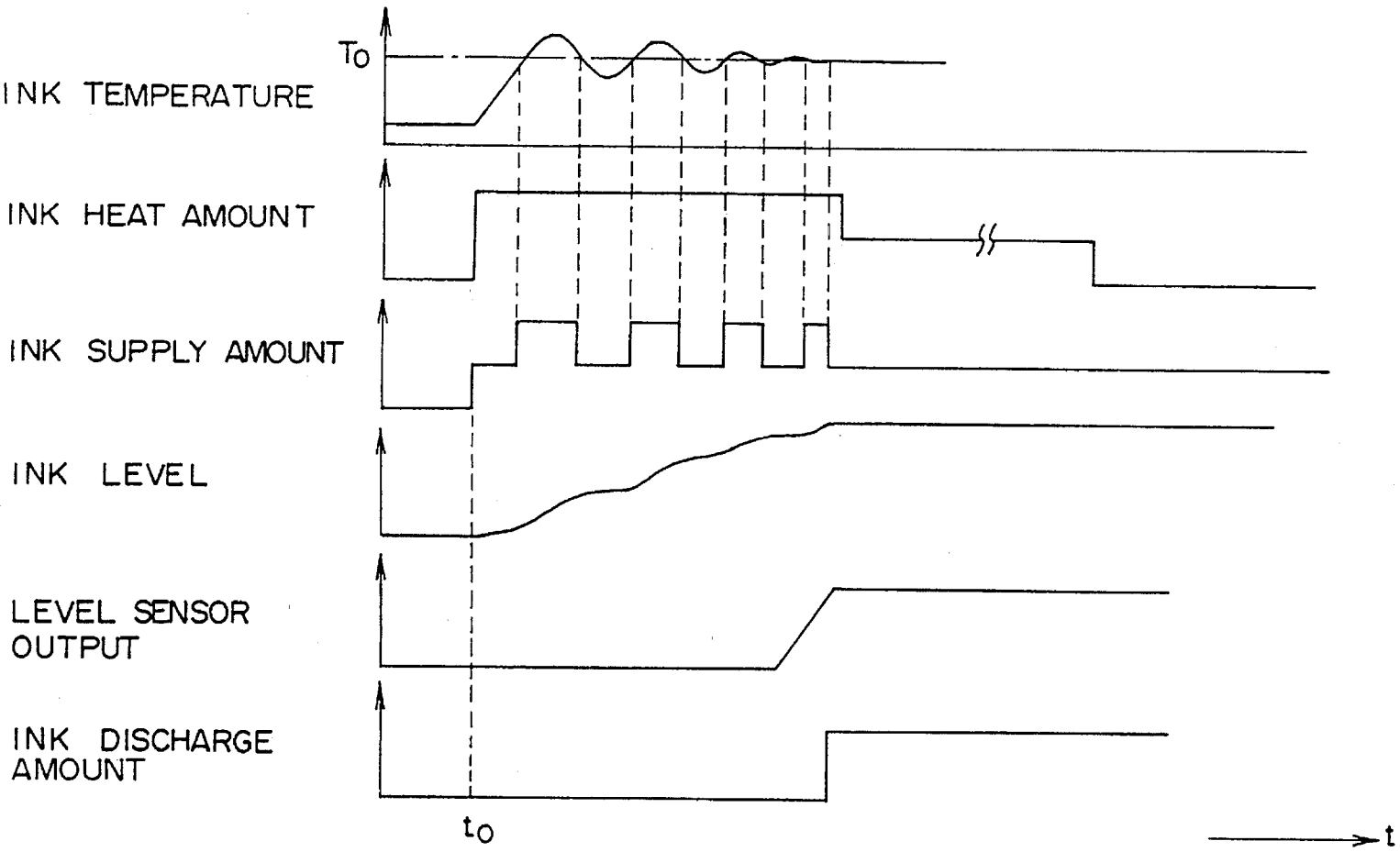
FIG. 44 is a time chart for control of a liquid temperature of inks assuming the practice of the embodiment of the ink supply system shown in FIG. 29.

FIG. 44 is a time chart for control of a liquid temperature of inks assuming the practice of the embodiment of the ink supply system shown in FIG. 29. The chart represents in turn an ink temperature, an ink heat amount, an ink supply amount, an ink level, a level sensor output and an ink discharge amount.

When a power turns on at time $t_0$, inks are heated with full power by the heater 789 which is disposed on an ink channel, and the ink supply pump 801A is driven to supply inks to the empty ink reservoir 730 of the recording head 710. When the heated inks enter the ink reservoir 730, an output of the ink temperature sensor rises. When the ink temperature exceeds a target $T_0$, the ink supply pump 801A is accelerated to increase an amount of ink supply. As a result, time required for inks passing through the heater 789 is shortened, so that the temperature of inks supplied to the ink reservoir 730 goes down. When the temperature of inks goes down, the ink supply velocity is again decelerated so that the temperature of inks to be supplied goes up. When the ink reservoir 730 fills with the inks through the repeated control as mentioned above, an output value of the level sensor 800 approaches the target. When the ink level reaches the target, the ink heat amount and the ink supply amount are decreased, and the ink discharge pump 801B is driven. If the ink discharge amount is set up to be the same as the ink supply amount, the liquid surface of inks or the ink level becomes constant. However, since the ink level will deviate from the target as the long time proceeds, either the ink supply amount or the ink discharge amount is controlled on a feedback basis in accordance with an output of the level sensor. When an ink circulation advances, and in addition the ink temperature of the reservoir tank rises, and thus there is no need to heat the inks, the ink heating is suspended. Thereafter, when the ink temperature goes down, the heating is performed, otherwise, it is suspended. This control is repeated.

Figure 45:
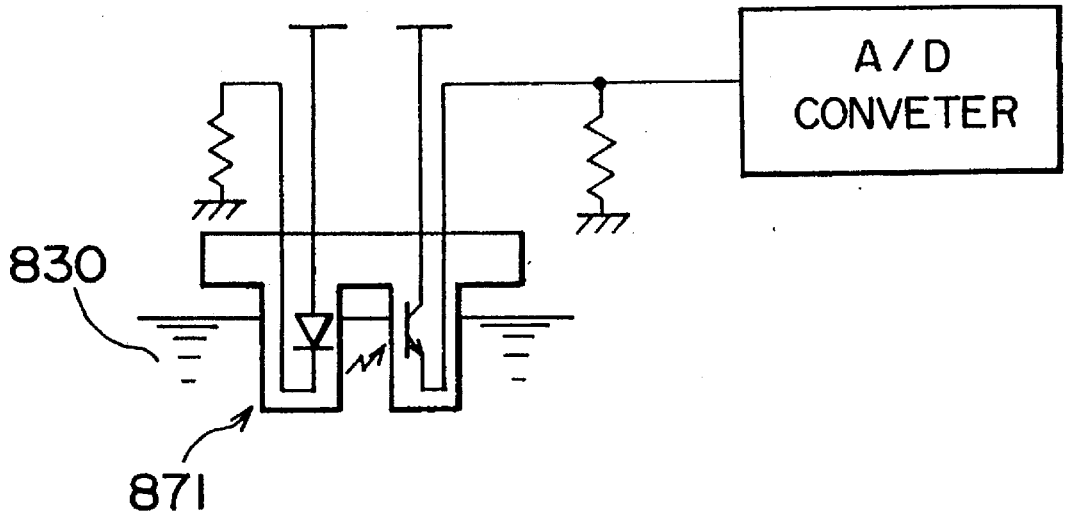
FIG. 45 is a view useful for understanding an example of the detection of an ink density.

FIG. 45 is a view useful for understanding an example of the detection of an ink density.

A transmission type photosensor 871 is steeped in inks of the tank 830, and the ink density is measured through the transmitted light. When the ink density exceeds a certain value, inks dry and the viscosity of the inks rises. These have an effect on the printing. Thus, the message is passed via the control panel of the printer or the interface to the host computer.

Figure 46:
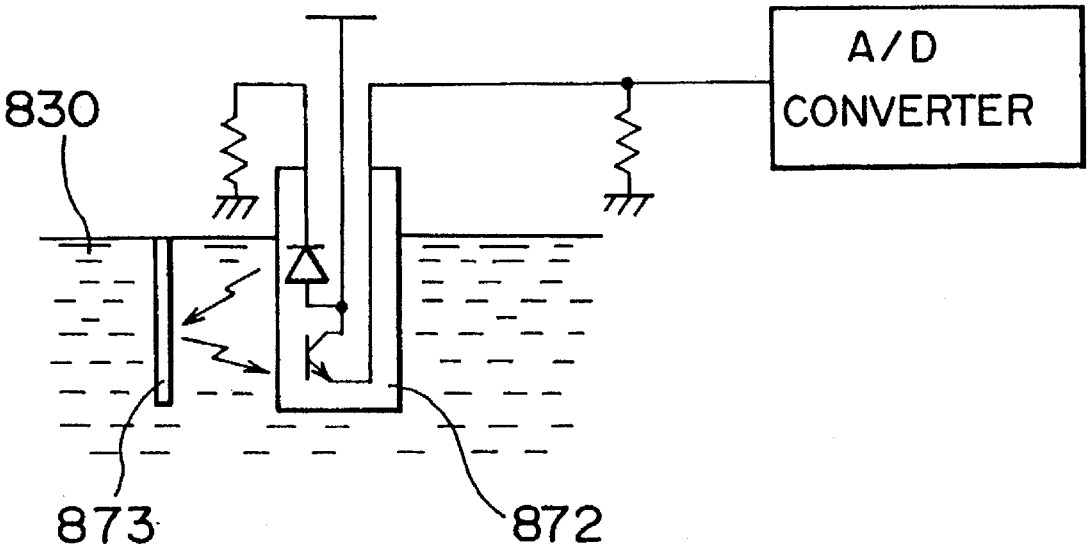
FIG. 46 is a view useful for understanding another example of the detection of an ink density.

FIG. 46 is a view useful for understanding another example of the detection of an ink density.

A reflection type photosensor 872 and a reflection plate 873 are soaked in inks of the tank 830, and the amount of reflected light is measured to attain the ink density. The after processing is the same as that in the transmission type photosensor shown in FIG. 45.

Figure 47A:
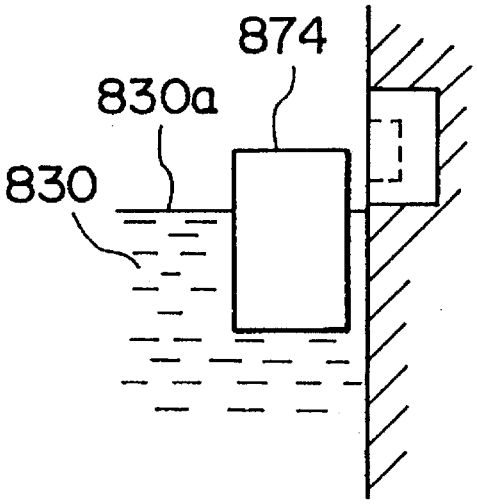
FIG. 47A is a view useful for understanding still another example of the detection of an ink density.
Figure 47B:
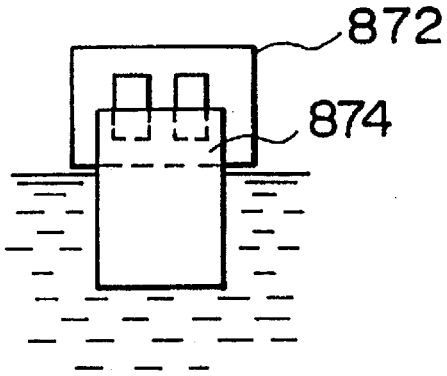
FIG. 47B is a view useful for understanding the same example as the detection of an ink density shown in FIG. 47A.

FIG. 47A and 47B each are a view useful for understanding still another example of the detection of an ink density.

A reflection type photosensor 872 is disposed above more than a liquid surface 830*a* of inks 830, and a float 874 is floated on the inks 830. The float 874 is composed of a material of which a specific gravity is sightly smaller relative to the inks 830.

When the ink density is varied, the float 874 is varied in a vertical line relative to the liquid surface of inks. Such a variation is detected by the reflection type photosensor 872.

Figure 48A:
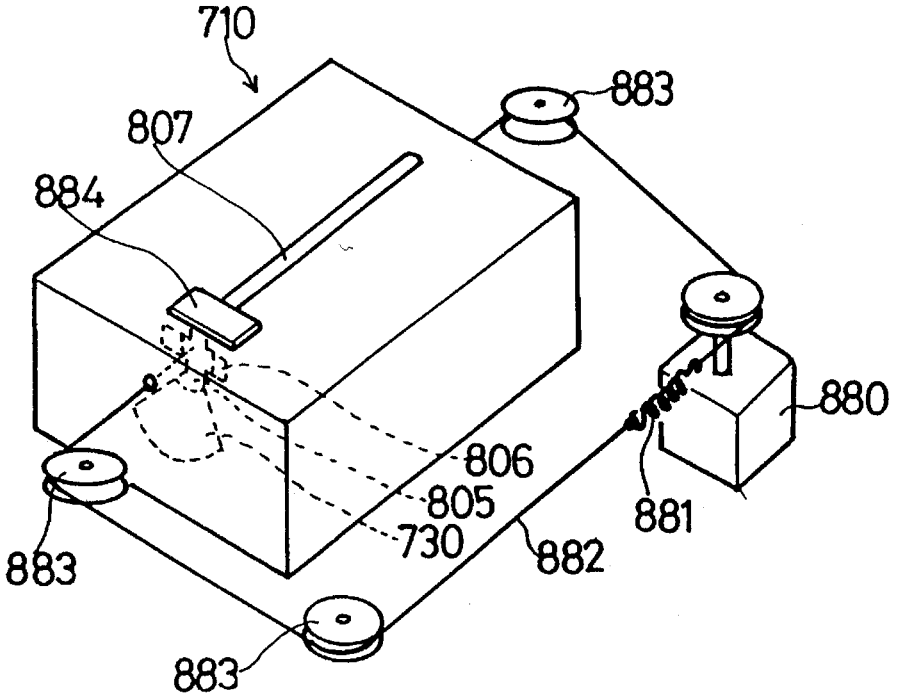
FIG. 48A is a perspective view of a recording head provided with a wiper.
Figure 48B:
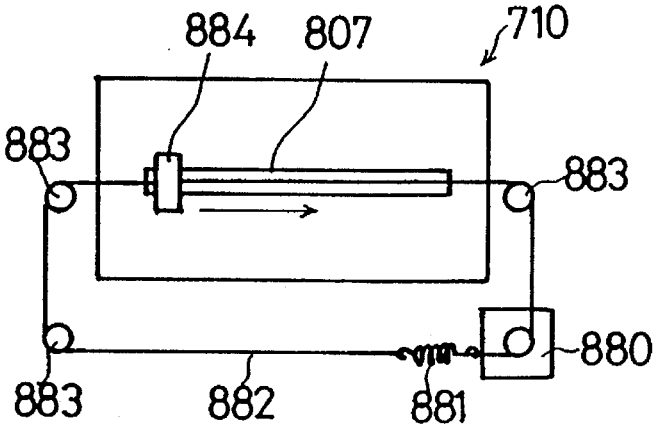
FIG. 48B is a plan view of the recording head shown in FIG. 48A.
Figure 48C:
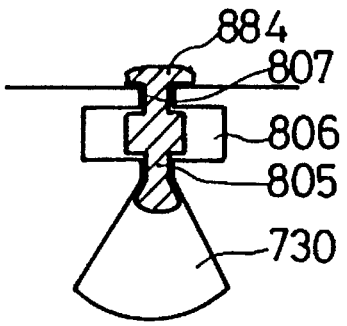
FIG. 48C is a side view of the recording head shown in FIGS. 48A and 49B.
Figure 49A:
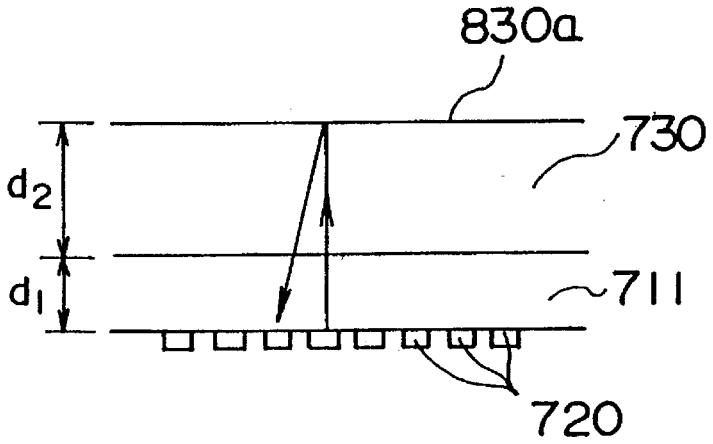
FIG. 49A is an explanatory view useful understanding a technique for measuring an attenuation factor of ultrasonic acoustic waves propagating in inks.
Figure 49B:
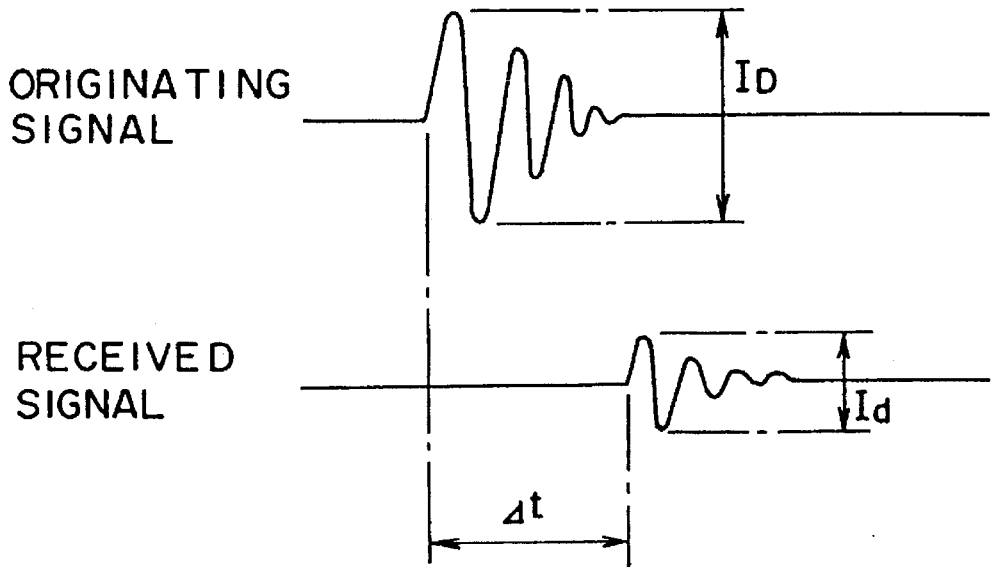
FIG. 49B is an explanatory view useful understanding a technique for measuring an attenuation factor of ultrasonic acoustic waves propagating in inks.

FIG. 48A is a perspective view of a recording head provided with a wiper, FIG. 48B is a plan view of the recording head shown in FIG. 48A, and FIG. 48C is a side view of the recording head shown in FIGS. 48A and 49B.

It is supposed that the recording head shown in FIG. 34 is adopted.

The recording head 710 is provided with a wiper 884 which is coupled via a rope 882 suspended by pulleys 883 and a tension spring 881 to a motor 880. The wiper 884 is placed, in printing, at the corner apart from the printing area on an aperture 807. In cleaning, the motor 880 rotates to move the wiper 884 in an arrow direction shown in FIG. 48B, so that the cleaning of a first aperture 805, a cavity 806 and a second aperture 806 are performed. Instead of the wiper 884, or in addition to the use of the wiper 884, it is acceptable to drive ultrasonic transducers (not shown in FIGS. 48A–48C) so that the cleaning of the neighbor portions of the ink surface on the ink reservoir 730 is performed by ultrasonic waves radiated from the energized ultrasonic transducers.

FIGS. 49A and 49B each are an explanatory view useful understanding a technique for measuring an attenuation factor of ultrasonic acoustic waves propagating in inks.

As shown in FIG. 49A, when an ultrasonic transducer 720 radiates ultrasonic waves, the emitted ultrasonic waves are reflected on the liquid surface 830*a* and returns to the ultrasonic transducer 720. The received signal at that time delays by time $\Delta t$, as shown in FIG. 49B, in comparison with the originating signal, and in addition its amplitude is reduced. An attenuation factor $\alpha$, including a reflectivity of the ultrasonic waves at the liquid surface of inks, can be attained, using the respective amplitudes $I_D$ and $I_d$ of the originating signal and the received signal, from the following equations:

$$I_d = I_D \exp(-\alpha)$$

$$\alpha = \log_e(I_D/I_d) \quad (1)$$

In general, while the attenuation factor is referred to one per an unit distance, the attenuation factor $\alpha$ denoted by equation (1) includes also components involved in a distance between the ultrasonic transducer 720 and the liquid surface 830*a* of inks.

Figures 50A, 50B, 50C:
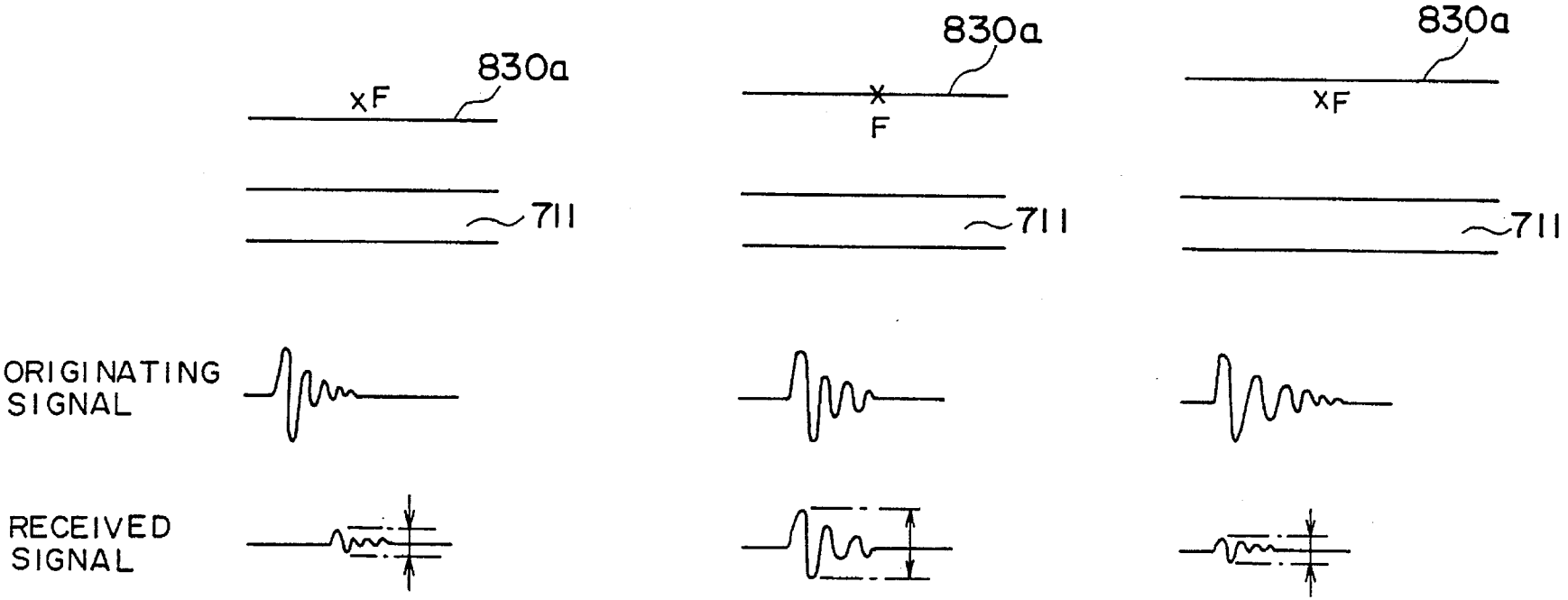
FIG. 50A is a view showing a corresponding relation between a liquid level of inks and a received signal.
FIG. 50B is a view showing a corresponding relation between a liquid level of inks and a received signal.
FIG. 50C is a view showing a corresponding relation between a liquid level of inks and a received signal.
Figure 51:
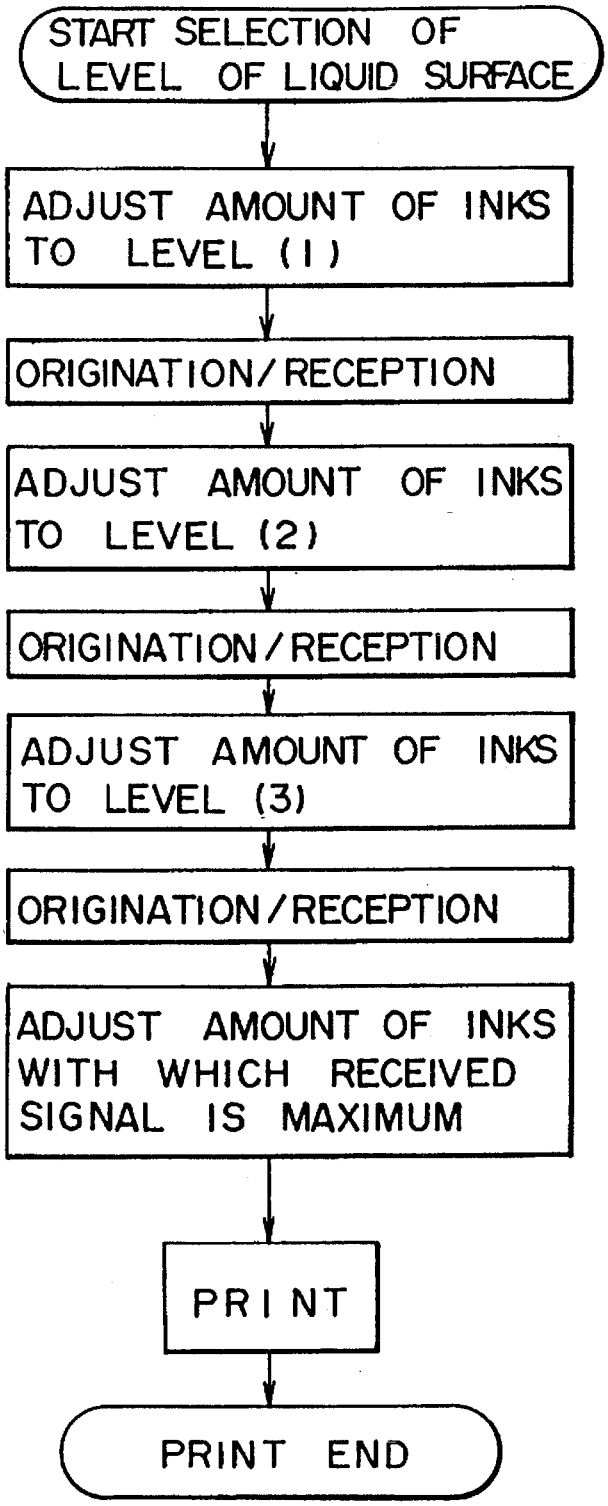
FIG. 51 is a flowchart showing a sequence for selecting the liquid level of inks.

FIGS. 50A–50C each are a view showing a corresponding relation between a liquid level of inks and a received signal, and FIG. 51 is a flowchart showing a sequence for selecting the liquid level of inks.

When the level of a liquid surface 830*a* of inks are sequentially varied and the transmission and reception of the ultrasonic waves are repeated, as shown in FIG. 50B, there appears the maximum received signal when a coincidence of the focal point F of the ultrasonic wave and the liquid surface 830*a* of inks is attained. Noticing this, prior to printing, the level of a liquid surface at which the maximum received signal appears is located, the liquid surface 830*a* of inks are adjusted to such a level, and then printing is initiated. This technique makes it possible to perform a stable printing.

Figure 52:
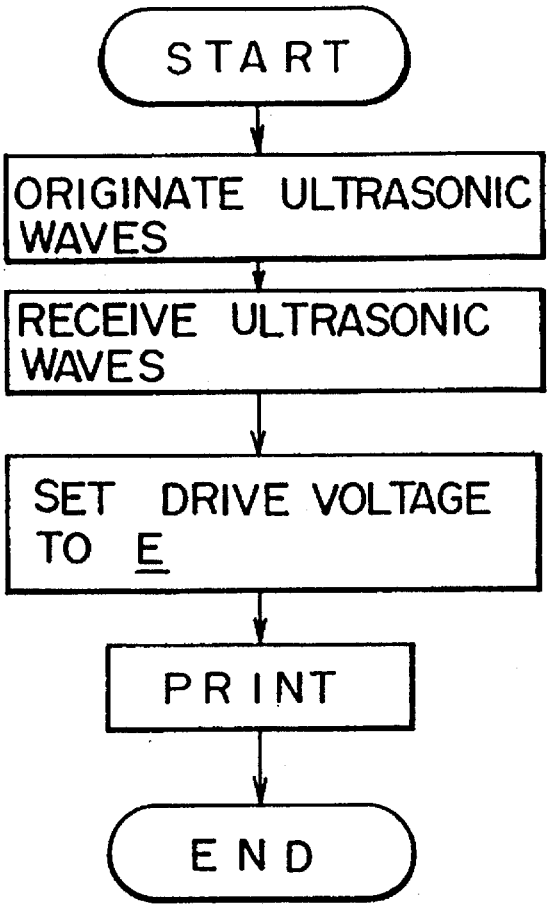
FIG. 52 is a flowchart showing a sequence in which an attenuation factor of ultrasonic acoustic waves propagating in inks is measured, and a drive voltage of an ultrasonic transducer is set up in accordance with a measured attenuation factor.

FIG. 52 is a flowchart showing a sequence in which an attenuation factor of ultrasonic acoustic waves propagating in inks is measured, and a drive voltage of an ultrasonic transducer is set up in accordance with a measured attenuation factor.

Ultrasonic waves are originated and received, and an attenuation factor $\alpha$ is attained based on the above noted equation (1). A drive voltage E, at the attenuation factor $\alpha$, is expressed by:

$$E=E_0\cdot\exp(\alpha_0-\alpha) \quad (2)$$

where $\alpha_0$ is a standard value of the attenuation factor, and $E_0$ is a standard value of the drive voltage of the ultrasonic transducer.

The drive voltage is attained based on the equation (2), the attained drive voltage is applied to the ultrasonic transducer. Thus, the ultrasonic energy on the liquid surface of inks is always maintained at a predetermined value, so that a stable printing is available.

Figure 53:
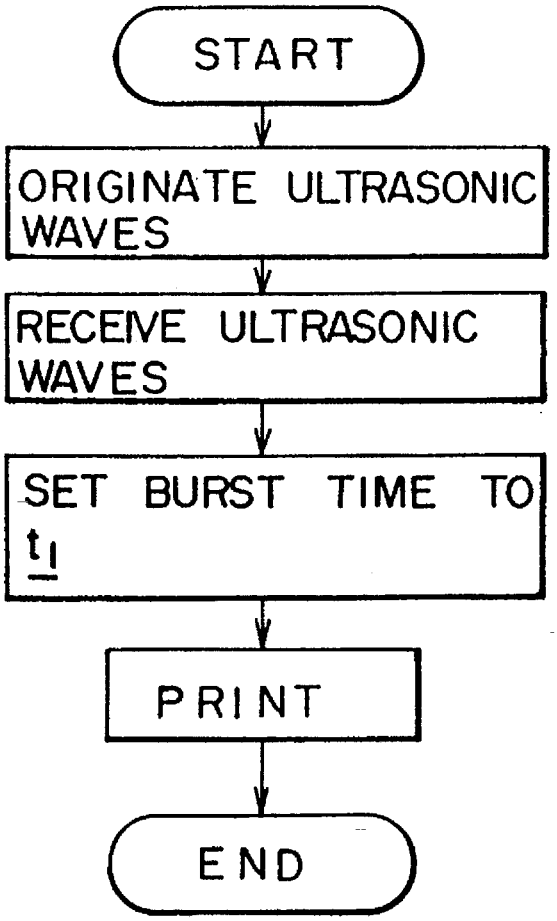
FIG. 53 is a flowchart showing a sequence in which an attenuation factor of ultrasonic acoustic waves propagating in inks is measured, and a drive burst time of an ultrasonic transducer is set up in accordance with a measured attenuation factor.

FIG. 53 is a flowchart showing a sequence in which an attenuation factor $\alpha$ of ultrasonic acoustic waves travelling in inks is measured, and a drive burst time of an ultrasonic transducer is set up in accordance with a measured attenuation factor.

Ultrasonic waves are originated and received, and an attenuation factor $\alpha$ is attained based on the above noted equation (1). A burst time t, at the attenuation factor $\alpha$, is expressed by:

$$t=(T_0=a)\exp\alpha_0-\alpha)+b \quad (3)$$

where a and b are constant, and $\alpha_0$ is a standard value of the attenuation factor.

The burst time is attained based on the equation (3), the drive voltage is applied by the attained burst time to the ultrasonic transducer. Thus, the ultrasonic energy on the liquid surface of inks is always maintained at a predetermined value, so that a stable printing is available.

Figure 54:
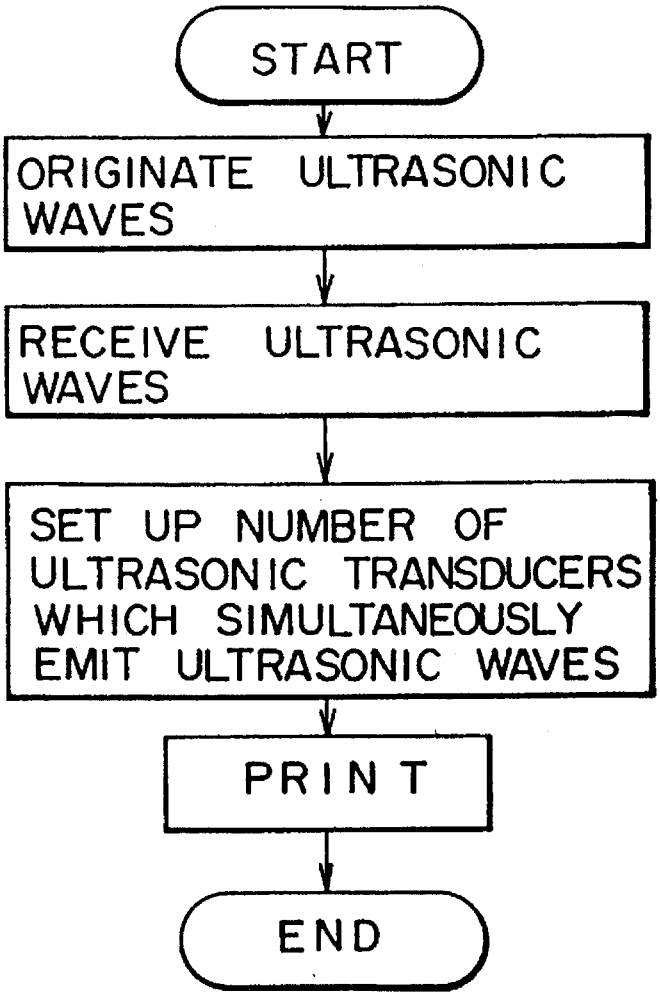
FIG. 54 is a flowchart showing a sequence in which an attenuation factor of ultrasonic acoustic waves propagating in inks is measured, and a number of ultrasonic transducers used for ejecting a piece of ink droplet is set up in accordance with a measured attenuation factor.

FIG. 54 is a flowchart showing a sequence in which an attenuation factor $\alpha$ of ultrasonic acoustic waves propagating in inks is measured, and a number of ultrasonic transducers used for ejecting a piece of ink droplet is set up in accordance with a measured attenuation factor.

Ultrasonic waves are originated and received, and an attenuation factor $\alpha$ is attained based on the above noted equation (1). It is assumed that a standard value of the attenuation factor $\alpha$ is given by $\alpha_0$, and a predetermined standard variation is given by $\Delta\alpha$. If the attained attenuation factor $\alpha$ is $\alpha=\alpha_0-\Delta\alpha\leqq\alpha\leqq\alpha_0+\Delta\alpha$, a standard $N_0$ pieces of ultrasonic transducers are driven for emission of a piece of ink droplet; if it is $\alpha<\alpha_0-\Delta\alpha$, a number of ultrasonic transducers more than $N_0$ are driven; and if it is $\alpha_0+\Delta\alpha<\alpha$, the number of ultrasonic transducers less than $N_0$ are driven. Thus, the ultrasonic energy on the liquid surface of inks is always maintained substantially at a predetermined value, so that a stable printing is available.

Figure 55A:
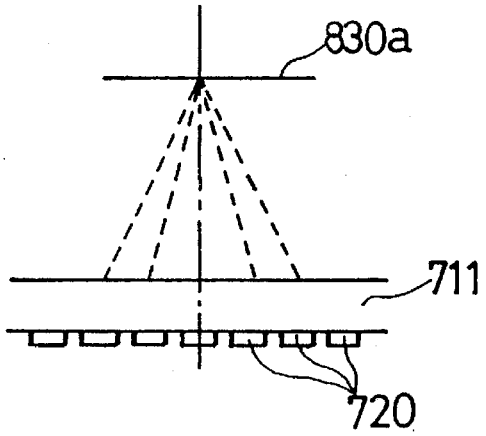
FIG. 55A is an illustration showing an example in which a number of ultrasonic transducers used for ejecting a piece of ink droplet is varied by addition and subtraction.
Figure 55B:
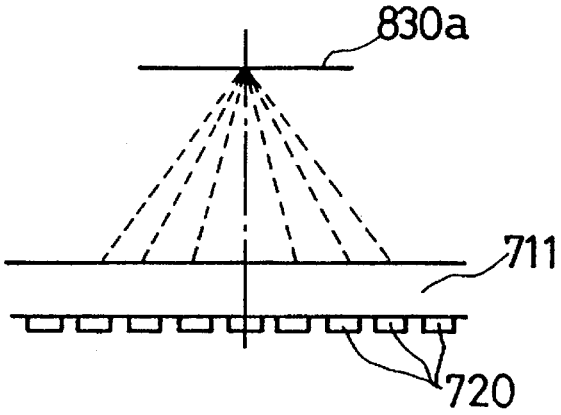
FIG. 55B is an illustration showing an example in which a number of ultrasonic transducers used for ejecting a piece of ink droplet is varied by addition and subtraction.
Figure 55C:
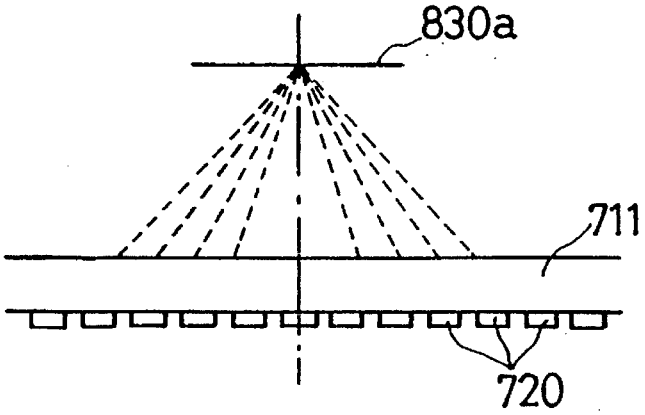
FIG. 55C is an illustration showing an example in which a number of ultrasonic transducers used for ejecting a piece of ink droplet is varied by addition and subtraction.

FIGS. 55A–55C each are an illustration showing an example in which a number of ultrasonic transducers used for ejecting a piece of ink droplet is varied by addition and subtraction.

FIGS. 55A, 55B and 55C show cases where to eject a piece of ink droplet, 6 pieces, 7 pieces and 9 pieces of ultrasonic transducers are driven, respectively. It is a standard case that 7 pieces of ultrasonic transducers are driven (FIG. 55B).

In such cases that the attenuation of ultrasonic waves travelling in inks is less than standard, the ink viscosity is less than standard, or the ink temperature is higher than standard, the number of ultrasonic transducers 720 less than standard are driven, as shown in (FIG. 55A). Whereas, in such cases that the attenuation of ultrasonic waves travelling in inks is much than standard, the ink viscosity is larger than standard, or the ink temperature is lower than standard, the number of ultrasonic transducers 720 much than standard are driven, as shown in (FIG. 55C). Thus, the ultrasonic energy on the liquid surface of inks is always maintained substantially at a predetermined value, so that a stable printing is available.

Figure 56C:
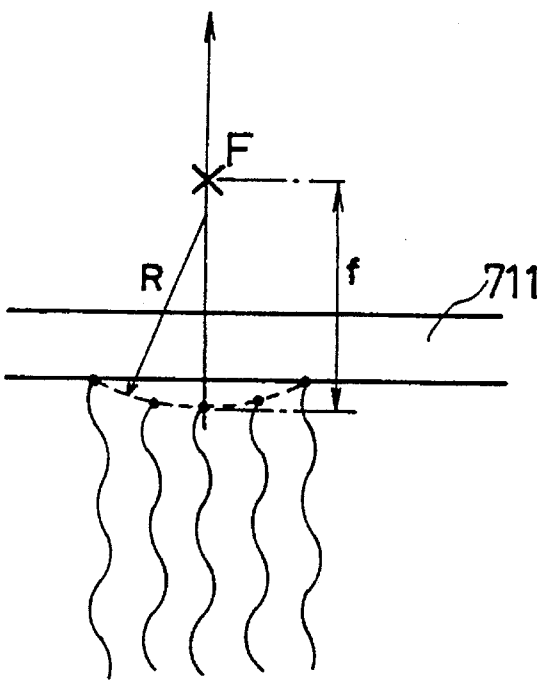
FIG. 56C is an illustration showing an example in which a phase pattern is controlled.
Figure 56B:
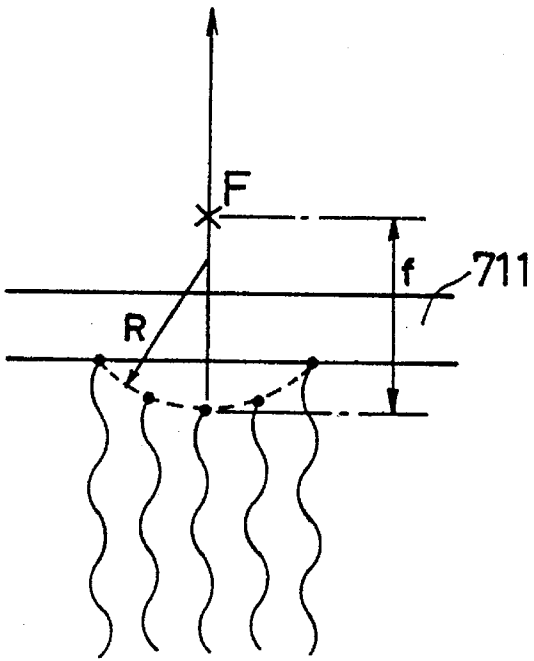
FIG. 56B is an illustration showing an example in which a phase pattern is controlled.
Figure 56A:
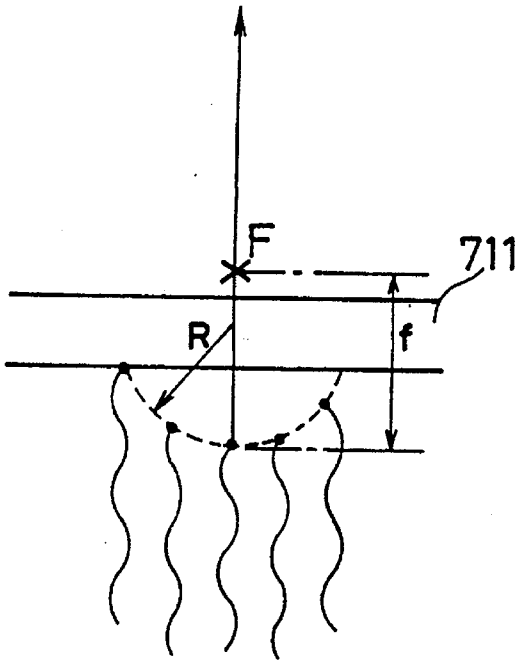
FIG. 56A is an illustration showing an example in which a phase pattern is controlled.

FIGS. 56A–56C each are an illustration showing an example in which a phase pattern is controlled.

FIGS. 56A, 56B and 56C show cases where a radius R of a phase pattern is relatively smaller, standard and relatively larger, respectively.

Assuming that a velocity of ultrasonic waves travelling in an acoustic medium 711 is denoted by $C_1$, and a velocity of ultrasonic waves travelling in inks is denoted by $C_2$, there is a relation between the radius R and a focal length f as expressed by the following equation:

$$R=(1-C_1/C_2)\cdot f \quad (4)$$

In such cases that the velocity $C_2$ of the inks is higher than standard, or the level of a liquid surface of the inks is lower than standard, the phase patter having the smaller radius R is used, as shown in (FIG. 56A). Whereas, in such cases that the velocity $C_2$ of the inks is lower than standard, or the level of a liquid surface of the inks is higher than standard, the phase patter having the larger radius R is used, as shown in (FIG. 56C). Thus, a focal point is always formed on the liquid surface of the inks, and a stable printing is available.

Figure 57:
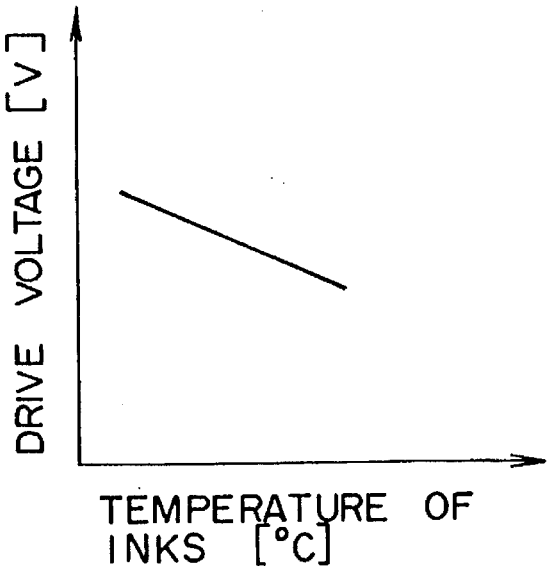
FIG. 57 is a view showing a relation between a liquid temperature of inks and an optimum drive voltage at that temperature.
Figure 58:
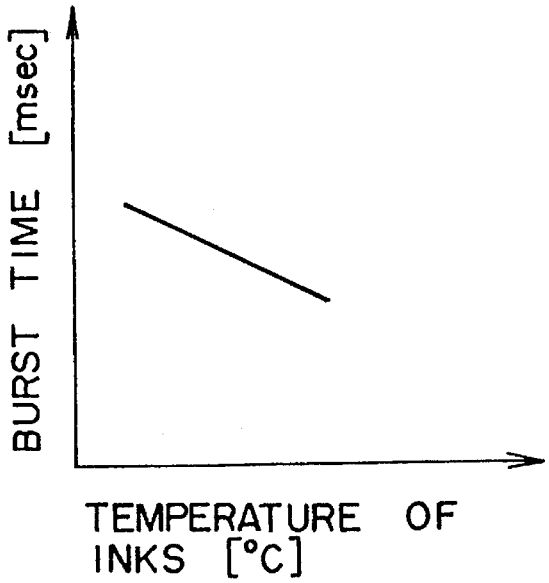
FIG. 58 is a view showing a relation between a liquid temperature of inks and an optimum drive burst time at that temperature.
Figure 59:
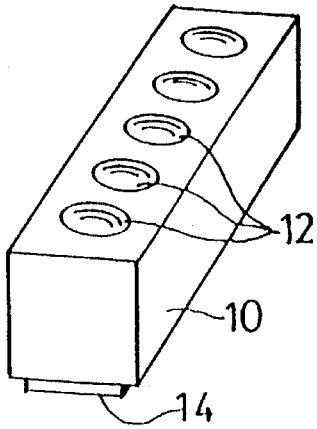
Fig. 59 (PRIOR ART)
FIG. 59 is a perspective view of a recording head of the conventional ultrasonic printer.
Figure 60:
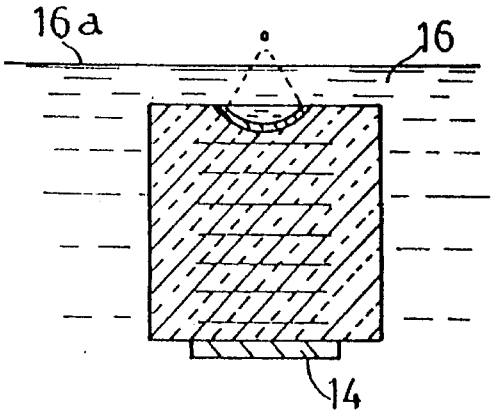
Fig. 60 (PRIOR ART)
FIG. 60 is a cross sectional view of the recording head shown in FIG. 59, with the recording head being submerged in a pool of ink.
Figure 61:
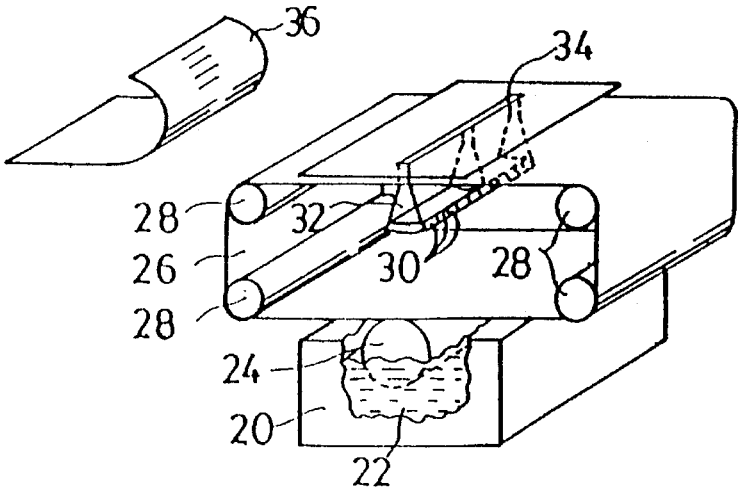
Fig. 61 (PRIOR ART)
FIG. 61 is a schematic diagram showing a functional structure of another embodiment of the prior art ultrasonic printer.

FIG. 57 is a view showing a relation between a liquid temperature of inks and an optimum drive voltage at that temperature. FIG. 58 is a view showing a relation between a liquid temperature of inks and an optimum drive burst time at that temperature.

Upon previously attaining the relations as shown in those figures, a liquid temperature of inks is measured in printing, and ultrasonic transducers are driven with the drive voltage or the drive burst time according to the detected temperature. Thus, a stable printing is always available, without regard to the liquid temperature.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

We claim:

1. An ultrasonic printer comprising:

ink supplying means; and means for producing convergent ultrasonic acoustic waves which eject an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, said means for producing convergent ultrasonic acoustic waves comprising:

a plurality of ultrasonic transducers for radiating ultrasonic acoustic waves;

drive circuits each for driving an associated one of said plurality of ultrasonic transducers; and a control circuit for controlling said drive circuits such that at least part of said plurality of ultrasonic transducers are driven with at least two or more phases mutually different to converge the ultrasonic acoustic waves radiated from said plurality of ultrasonic transducers onto a predetermined position.

2. An ultrasonic printer according to claim 1, wherein said control circuit has a plurality of counters each for counting a number of clock pulses of a predetermined reference clock, and transmits to said drive circuits each a timing signal for instructing drive of the associated one of said ultrasonic transducers in timing when a counted value of the associated counter reaches a respective predetermined value.

3. An ultrasonic printer according to claim 1, wherein said plurality of ultrasonic transducers are arranged in a predetermined arrangement direction in the form of array.

4. An ultrasonic printer according to claim 3, wherein said plurality of ultrasonic transducers are arranged in a predetermined arrangement direction over the entire width of said recording medium.

5. An ultrasonic printer according to claim 3, wherein said printer further comprises a movement mechanism for moving relatively said recording medium and said ultrasonic transducers in a direction intersecting the arrangement direction.

6. An ultrasonic printer according to claim 3, wherein said printer further comprises converging means for converging the ultrasonic waves radiated from said ultrasonic transducers in a direction intersecting the arrangement direction.

7. An ultrasonic printer according to claim 6, wherein said conveying means is an acoustic lens which varies in a thickness thereof in the intersecting direction.

8. An ultrasonic printer according to claim 6, wherein said converging means is an acoustic horn.

9. An ultrasonic printer according to claim 6, wherein said converging means is an acoustic Fresnel lens.

10. An ultrasonic printer according to claim 6, wherein said convenging means is formed by the ultrasonic transducer having an ultrasonic wave radiation surface which is formed with a recess shaped configuration with respect to the intersecting direction.

11. An ultrasonic printer according to claim 6, wherein said converging means is provided with an acoustic absorption member for absorbing from among the ultrasonic waves radiated from ultrasonic transducer components which do not contribute to formation of the convergent ultrasonic waves.

12. An ultrasonic printer according to claim 3, wherein said control circuit controls said drive circuits so that in one cycle for ejecting ink droplets recording over the whole width of said array of ultrasonic transducers in the arrangement direction is performed.

13. An ultrasonic printer according to claim 3, wherein said control circuit controls said drive circuits to form dots with a dot pitch smaller than an arrangement pitch of said an array of ultrasonic transducers.

14. An ultrasonic printer according to claim 3, wherein said control circuit controls said drive circuits so that a pitch of the dots in the arrangement direction can be varied.

15. An ultrasonic printer according to claim 3, wherein said control circuit controls said drive circuits so that to form one and another of two dots which are adjacent each other in the arrangement direction, even number and odd number of ultrasonic transducers are driven, so that dots having a pitch of one half of an arrangement pitch of ultrasonic transducers may be formed.

16. An ultrasonic printer according to claim 1, wherein said control circuit provides such a control that when at least part of said plurality of ultrasonic transducers are segmented into a plurality of blocks each including a plurality of ultrasonic transducers and excluding any ultrasonic transducers included in other blocks, a convergent ultrasonic wave is formed on each block in one time of a cycle for ejecting ink droplets.

17. An ultrasonic printer according to claim 1, wherein said control circuit provides such a control that when at least part of said plurality of ultrasonic transducers are segmented into a plurality of blocks one of which includes a plurality of ultrasonic transducers, part of said ultrasonic transducers being included also in another block, and the another block including a plurality of ultrasonic transducers, a convergent ultrasonic wave is formed on each block in one time of a cycle for ejecting ink droplets.

18. An ultrasonic printer according to claim 1, wherein said control circuit controls said drive circuits so that the dot pitch in the arrangement direction can be varied.

19. An ultrasonic printer comprising:

ink supplying means; and means for producing convergent ultrasonic acoustic waves which ejects an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, said means for producing convergent ultrasonic acoustic waves comprising:

a plurality of ultrasonic transducers for radiating ultrasonic acoustic waves; and drive circuits each for driving an associated one of said plurality of ultrasonic transducers;

the printer further comprising:

a sensor for measuring a value of an item selected from the group consisting of a viscosity of inks, a density of inks, a velocity of ultrasonic acoustic waves ejecting said inks and an attenuation factor of said ultrasonic acoustic waves ejecting said inks; and a control circuit for controlling said drive circuits so that said ultrasonic transducers are driven in accordance with said value measured by said sensor, said control circuit controlling said drive circuits so as to adjust drive burst times in accordance with said value.

20. An ultrasonic printer according to claim 19, wherein said ultrasonic transducers also serve as said sensor.

21. An ultrasonic printer comprising:

ink supplying means; and means for producing convergent ultrasonic acoustic waves which eject an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, said means for producing convergent ultrasonic acoustic waves comprising:

a plurality of ultrasonic transducers for radiating ultrasonic acoustic waves; and drive circuits each for driving an associated one of said plurality of ultrasonic transducers;

the printer further comprising:

a sensor for measuring an ink characteristic value; and a control circuit for controlling said drive circuits so that said ultrasonic transducers are driven in accordance with said value measured by said sensor, wherein said control circuit controls said drive circuits so that at least part of said plurality of ultrasonic transducers are driven with at least two or more phases mutually different to converge the ultrasonic acoustic waves radiated from said ultrasonic transducers onto a predetermined position, and said control circuit also controls said drive circuits to adjust at least one selected from said phases and a number of said ultrasonic transducers to be driven for ejecting an ink droplet, in accordance with said value.

22. An ultrasonic printer comprising:

ink supplying means; and means for producing convergent ultrasonic acoustic waves which eject an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots;

a sensor for measuring a first ink characteristic value; and an ink control mechanism for controlling a second ink characteristic value in accordance with said first value measured by said sensor, said second ink characteristic value being selected from a group consisting of a level of a liquid surface of inks in said ink supplying means, an ink supply amount and an ink discharge amount.

23. An ultrasonic printer comprising:

ink supplying means; and means for producing convergent ultrasonic acoustic waves which eject waves an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, the ultrasonic printer further comprising:

a sensor for measuring a value of an item selected from the group consisting of a level of a liquid surface of inks in said ink supplying means, a density of inks and an attenuation factor of ultrasonic waves which eject the ink;

determining means for determining whether or not said value measured by said sensor is within a predetermined range; and output means for issuing, when it is determined by said determining means that said value measured by said sensor is out of the predetermined range, a message representative of this information.

24. An ultrasonic printer comprising:

ink supplying means; and means for producing convergent ultrasonic acoustic waves which eject an ink from the ink supplying means near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots, said ink supplying means including:

an ink reservoir for reserving inks through which the convergent ultrasonic acoustic waves travel;

a reserve tank for saving inks;

an ink circulation mechanism for providing such a circulation for inks that the inks saved in said reserve tank are supplied to said ink reservoir and the inks supplied to said ink reservoir are discharged to said reserve tank;

said printer further comprising:

a sensor for measuring ink characteristic value of inks supplied to said ink reservoir;

determining means for determining whether or not said value measured by said sensor, is within a predetermined range; and an ink circulation control circuit for controlling said ink circulation mechanism so that when it is determined by said determining means that said value measured by said sensor, is out of the predetermined range, the inks supplied to said ink reservoir are exchanged with the inks saved in said reserve tank;

wherein said value is a value of an item selected from the group consisting of a density of inks and an attenuation factor of the ultrasonic waves traveling in the inks.

25. An ultrasonic printer comprising:

ink supplying means; and means for producing convergent ultrasonic acoustic waves which eject an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, said means for producing convergent ultrasonic acoustic waves comprising:

a plurality of ultrasonic transducers for radiating ultrasonic acoustic waves;

drive circuits each for driving an associated one of said plurality of ultrasonic transducers;

receiving circuits each for receiving reflected ultrasonic acoustic waves returned to an associated one of said plurality of ultrasonic transducers; and a measuring circuit for measuring an ink characteristic value of inks, based on received signals received by said receiving circuits.

26. An ultrasonic printer according to claim 25, wherein said value is a value of an item selected from the group consisting of a level of a liquid surface of inks, a liquid temperature of inks, a viscosity of inks, a density of inks, a velocity of ultrasonic acoustic waves traveling in inks, and an attenuation factor of ultrasonic acoustic waves traveling in inks.

27. An ultrasonic printer comprising:

ink supplying means; and means for producing convergent ultrasonic acoustic waves which eject an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, said means for producing convergent ultrasonic acoustic waves comprising:

a plurality of ultrasonic transducers for radiating ultrasonic acoustic waves;

drive circuits each for driving an associated one of said plurality of ultrasonic transducers;

receiving circuits each for receiving reflected ultrasonic acoustic waves returned to an associated one of said plurality of ultrasonic transducers; and condition selecting means for selecting a print condition from among mutually different conditions so that prior to printing of dot formation on the recording medium, said ultrasonic transducers are driven under mutually different conditions to measure received signals at the driving time.

28. An ultrasonic printer according to claim 27, wherein said condition selecting means selects as the condition at least one from among a level of a liquid surface of inks and center frequency of the ultrasonic waves radiated from said ultrasonic transducers.

29. An ultrasonic printer according to claim 27, wherein said printer further comprises a control circuit for controlling said drive circuits so that at least part of said plurality of ultrasonic transducers are driven with at least two or more phases mutually different to converge the ultrasonic acoustic waves radiated from said plural ultrasonic transducers onto a predetermined position, and said condition selecting means selects as the condition the phases.

30. An ultrasonic printer comprising ink supplying means; and means for producing convergent ultrasonic acoustic waves which eject an ink from said ink supplying means near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots, said ultrasonic printer further comprising:

a dot adjusting mechanism for adjusting at least one of a level of a liquid surface of inks, a level of the convergent point, and a beam diameter of the ultrasonic acoustic waves at the convergent point.

31. An ultrasonic printer comprising ink supplying means; and means for producing convergent ultrasonic acoustic waves which eject an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, said means for producing convergent ultrasonic acoustic waves comprising:

a plurality of ultrasonic transducers for radiating ultrasonic acoustic waves; and drive circuits each for driving an associated one of said plurality of ultrasonic transducers;

said ink supplying means including:

an ink reservoir for reserving inks through which the convergent ultrasonic acoustic waves travel;

a reserve tank for saving inks; and an ink circulation mechanism for providing such a circulation for inks that the inks saved in said reserve tank are supplied to said ink reservoir and the inks supplied to said ink reservoir are discharged to said reserve tank; and said printer further comprising:

a control circuit for controlling said drive circuits so that when the inks supplied to said ink reservoir are discharged to said reserve tank, said ultrasonic transducers emit ultrasonic progressive waves toward an ink discharge port of said ink reservoir.

32. An ultrasonic printer comprising ink supplying means; and means for producing convergent ultrasonic acoustic waves positioned at said ink supplying means for ejecting an ink therefrom near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, said ink supplying means comprising:

an ink reservoir for reserving inks through which the convergent ultrasonic acoustic waves travel, said ink reservoir having on a top thereof a first slit shaped aperture, a cavity having a width wider than said first aperture, said cavity being provided on the top of said first aperture, and a second slit shaped aperture having a width narrower than said cavity, said second slit being provided on the top of said cavity.

33. An ultrasonic printer comprising ink supplying means; and means for producing convergent ultrasonic acoustic waves radiated therefrom and ejecting an ink from said ink supplying means near a convergent point of the convergent ultrasonic acoustic waves in the form of an ink droplet to deposit the ink droplet on a recording medium so as to form dots on the recording medium, this cycle being repeatedly performed plural number of times, thereby implementing a recording on the recording medium with multiple ink dots, said ink supplying means comprising:

an ink reservoir for reserving inks through which the convergent ultrasonic acoustic waves travel, said ink reservoir having on a top thereof a slit shaped aperture for ink discharge; and a skew regulation mechanism for regulating a skew with respect to a longitudinal direction of said ink reservoir.

34. An ultrasonic printer comprising ink supplying means; and means for generating convergent ultrasonic acoustic waves radiated therefrom and ejecting an ink from said ink supplying means near a convergent point of the convergent ultrasonic acoustic waves in the form of an ink droplet and deposit the ink droplet on a recording medium so as to form dots on the recording medium, this cycle being repeatedly performed plural number of times, thereby implementing a recording on the recording medium with multiple ink dots, said ink supplying means comprising:

an ink reservoir for reserving inks through which the convergent ultrasonic acoustic waves travel, said ink reservoir having on a top thereof a slit shaped aperture for ink discharge;

a reserve tank for saving inks;

an ink circulation mechanism for providing such a circulation for inks that the inks saved in said reserve tank are supplied to said ink reservoir and the inks supplied to said ink reservoir are discharged to said reserve tank;

a skew sensor for detecting a skew of said ink reservoir with respect to a longitudinal direction of said aperture for ink discharge; and an ink circulation control circuit for controlling said ink circulation mechanism so that when said skew sensor detects a skew which exceeds a predetermined value, the inks supplied to said ink reservoir are discharged into said reserve tank.

* * * * *